US005526249A

United States Patent [19]

Karasawa et al.

[11] Patent Number: 5,526,249

[45] Date of Patent: Jun. 11, 1996

[54] LIGHT SOURCE DEVICE

[75] Inventors: Isamu Karasawa, Hachioji; Toshiaki Noguchi, Tachikawa; Masato Toda, Hachioji; Masanobu Koitabashi, Hachioji; Keiji Handa, Hachioji; Akihiro Amemiya, Hachioji; Yoshihiro Okada, Hachioji; Toshiaki Nishikori, Sagamihara; Tsuguhisa Sasai, Tsukui-machi; Kazufumi Takamizawa, Chofu, all of Japan

[73] Assignee: Olympus Optical Co., Ltd., Tokyo, Japan

[21] Appl. No.: 22,121

[22] Filed: Feb. 25, 1993

[30] Foreign Application Priority Data

Jun. 17, 1992 [JP] Japan ..... 4-158238
Oct. 1, 1992 [JP] Japan ..... 4-263809

[51] Int. Cl.[6] ..... F21V 25/04

[52] U.S. Cl. ..... 362/362; 362/21; 362/94; 362/155; 362/373; 362/802

[58] Field of Search ..... 362/20, 21, 226, 362/254, 276, 362, 373, 374, 375, 802, 94, 155; 439/135, 136, 911; 200/61.62, 61.71–61.75

[56] References Cited

U.S. PATENT DOCUMENTS

| | | | |
|---|---|---|---|
| 2,140,474 | 12/1938 | Gullicksen | 200/61.75 |
| 3,529,146 | 9/1970 | Betlejewski et al. | 362/254 |
| 3,848,088 | 11/1974 | Bentz | 439/911 |
| 4,356,534 | 10/1982 | Hattori | 362/276 |
| 4,706,171 | 11/1987 | Ruterbusch | 362/254 |
| 4,855,875 | 8/1989 | Onose et al. . | |
| 4,975,810 | 12/1990 | Vanderbel | 362/254 |
| 5,020,926 | 6/1991 | Wilhelm | 200/61.71 |
| 5,230,555 | 7/1993 | Stephenson et al. | 362/32 |
| 5,283,718 | 2/1994 | Stephenson et al. | 362/276 |

FOREIGN PATENT DOCUMENTS

| | | | |
|---|---|---|---|
| 723035 | 12/1965 | Canada | 362/254 |

*Primary Examiner*—Denise L. Gromada
*Assistant Examiner*—Alan B. Cariaso
*Attorney, Agent, or Firm*—Armstrong, Westerman, Hattori, McLeland & Naughton

[57] ABSTRACT

A light source device including a lamp-exchanging door which is attached/removed when a lamp is replaced and an electrode-connection/separation arrangement for making connection/separation between an electrode of a lamp driving circuit and an electrode of a lamp when the lamp-exchanging door is attached/removed.

5 Claims, 42 Drawing Sheets

LIGHT SOURCE DEVICE

BACKGROUND OF THE INVENTION

1. Field of the Invention

The present invention relates to a light source connected to an endoscope, for providing light to the endoscope.

2. Description of Related Art Statement

There are several types of endoscopes such as medical endoscopes, used for observing viscera in a body cavity or industrial endoscopes for observing the inside of boilers, turbines, engines, or chemical plants. In order to perform examination or observation by means of the above endoscopes, additional peripheral devices such as a controller, light source, and monitor are required.

In a conventional device for providing light to an endoscope, a lamp acting as a light source, such as a xenon lamp, is supported with a heat sink and electric power is supplied to the lamp via the heat sink.

When a lamp of such an apparatus is replaced, operation of lamp replacement must be performed after a lamp-exchanging door is opened and the lamp is removed from the apparatus together with a heat sink. Such operation is dangerous because there is some possibility for an operator to get an electric shock. In order to avoid this, an interlock switch is usually provided so that the electric power supply may be cut off when the lamp-exchanging door is opened. Another interlock switch is also provided so as to discharge the charges stored in a capacitor connected to the amp in parallel.

FIG. 1 is a schematic diagram showing a configuration of a lamp drive circuit in a conventional light source device.

The lamp drive circuit of this light source device has a switching regulator 4 acting as a power supply circuit for a lamp, which is connected to an AC power line 1 via a fuse 2 and first interlock switch 3. This interlock switch 3 acts in conjunction with a lamp-exchanging door so that whenever the lamp-exchanging door is opened the interlock switch 3 breaks the circuit so as to interrupt power supply to the switching regulator 4. The switching regulator 4 includes a transformer 5 composed of an inverter transformer, in which reinforced insulation is provided between the secondary and primary circuits to ensure safety. The secondary output of the switching regulator 4 is connected to a xenon lamp 7 via a starter 6 for generating a high voltage required for turning on the xenon lamp. Furthermore, a second interlock switch 9 and a discharging resistor 8 are provided between the switching regulator 4 and the starter 6 in such a manner that the second interlock switch 9 may connect between two terminals on the secondary side via the discharging resistor 8 so as to discharge the charges stored in a capacitor disposed in the secondary circuit.

The second interlock switch 9, as in the case of the first interlock switch 3, operates in conjunction with the amp-exchanging door so that when the lamp-exchanging door is opened the second interlock switch 9 may make the secondary circuit closed via the discharging resistor 8 so as to discharge the charges stored in the secondary circuit.

However, in the conventional light source device described above, a large size is required for the first interlock switch 3 to directly shut off the connection of the power line in the primary circuit, thus a large space is also needed for installation of the first interlock switch 3.

Moreover, in order to avoid electric shock due to the charges stored in the capacitor in the secondary circuit during a lamp replacement operation, another space is also required for the installation of the second interlock switch 9 for discharging the charges stored in the capacitor. As a result, the size of the entire device becomes excessively large.

Furthermore, reinforced insulation is required in the structure of the transformer 5 of the switching regulator 4 so that the possible failure of the interlock switches may not result in the reduction of safety. A minimum of 8 mm is needed in the creepage distance, and a minimum of 5 mm is required in the space distance so as to ensure the insulation between the primary and the secondary circuits meets safety standard requirements, which results in the large size of the transformer. Referring to FIG. 2 which shows the structure of the transformer 5, the widths of interlayer tapes 13 and spacer tapes 14 must be sufficiently large to obtain a required creepage distance between the primary windings 13 and secondary windings 12. Thus, the transformer 5 becomes large in size.

As described above, large space is required for installing the first and second interlock switches so as to ensure safety, which results in the large size of the transformer, which further results in the difficulty of reduction of the size of light source device.

SUMMARY OF THE INVENTION

It is an object of the present invention to provide a safer light source device by means of a mechanism to cut off the path between a lamp electrode and a lamp driving circuit, which can prevent that an operator from coming into direct contact with live portions when the lamp is exposed during the lamp exchange operation.

It is another object of the present invention to provide a miniaturized light source device which is realized by eliminating interlock switches and by simplifying the structure of insulation in a transformer.

In a light source device of the present invention, there is provided a removable lamp-exchanging door which can be removed when a lamp is replaced. An electrode connection/separation means is also provided which connects the ],amp to a lamp drive circuit when the lamp-exchanging door is inserted in a normal position and which separates the lamp from the lamp drive circuit when the door is removed.

Other features and advantages of the present invention will become apparent from the following detailed description of the preferred embodiments.

BRIEF DESCRIPTION OF THE DRAWINGS

FIGS. 3–11 relate to a first embodiment of the present invention wherein:

FIG. 3 is a sectional side view showing a lamp house portion of a light source device;

FIG. 4 is a side view of a lamp supported with a heat sink;

FIG. 5 is a perspective view showing the structure of an inner lamp-exchanging door;

FIG. 6 is a circuit diagram showing the configuration of lamp driving circuit in a lamp source device;

FIG. 7 is a schematic diagram showing the structure of the lamp house portion of FIG. 3, seen from the upper side;

FIG. 8 is a perspective view showing the structure of an electrical contact portion in which an inner lamp-exchanging door is fit;

FIG. 9 is a cross sectional view for explanation of how a conductive portion of an inner lamp-exchanging door fits in an electrical contact element;

FIG. 10 is a perspective view showing the outside appearance of a lamp house, from which a lamp-exchanging door is removed; and FIG. 11 is a schematic diagram of a lamp house from which a heat sink is removed, seen from the front side.

FIGS. 14–17 relate to a second embodiment of the present invent ion where in:

FIG. 14 is a cross-sectional side view showing a lamp house portion of a light source device;

FIG. 15 a perspective view showing the structure of an electrical contact portion in which an inner lamp-exchanging door is fit; and FIG. 16 is a cross sectional view explaining how a conductive portion of an inner lamp-exchanging door fits in an electrical contact element;

FIG. 17 is a perspective view showing a modified inner lamp-exchanging door.

FIGS. 18–20 relate to a third embodiment of the present invention wherein:

FIG. 18 is a cross-sectional side view showing the structure of a lamp house of a light source device;

FIG. 19 is a perspective view showing the structure of an inner lamp-exchanging door; and FIG. 20 is a cross-sectional view for explanation of how a conductive portion of an inner lamp-exchanging door fits in an electrical contact element;

FIGS. 21–27 relate to a fourth embodiment of the present invention wherein:

FIG. 21 is a schematic diagram showing the structure of a lamp house of the fourth embodiment;

FIG. 22 is an elevational view showing the structure of a lamp unit;

FIG. 23 is a side view of a lamp unit, seen from the anode side;

FIG. 24 is a side view of a lamp unit, seen from the cathode side;

FIG. 25 is a perspective view showing the structure of a lamp-exchanging door and a lamp unit supporting member;

FIG. 26 is a cross-sectional side view of a lamp house; and

FIG. 27 is a schematic diagram of a lamp house from which a lamp-exchanging door and a lamp unit supporting member are removed.

FIGS. 28–34 relate to a fifth embodiment of the present invention wherein:

FIG. 28 is an elevational view showing the structure of a lamp unit;

FIG. 29 is a side view of a lamp unit seen from the anode side;

FIG. 30 is a side view of a lamp unit seen from the cathode side;

FIG. 31 is a perspective view showing the structure of a lamp-exchanging door and a lamp unit supporting member;

FIG. 32 is a side view showing the structure of a fixing band to be attached on the upper surface of a lamp unit supporting member;

FIG. 33 is a cross-sectional side view showing a lamp unit supporting member with a fixing band attached on it; and FIG. 34 is a schematic diagram of a lamp house from which a lamp-exchanging door and a lamp unit supporting member are removed, seen from the front side;

FIGS. 35–42 relate to a sixth embodiment of the present invention wherein:

FIG. 35 is an elevational view showing the structure of a lamp unit;

FIG. 36 is a side view of a lamp unit seen from the anode side;

FIG. 37 is a side view of a lamp unit seen form the cathode side;

FIG. 38 is a sectional side view showing the structure of a lamp-exchanging door and a lamp unit supporting member;

FIG. 39 is a top view of a lamp-exchanging door and lamp unit supporting member;

FIG. 40 is a cross sectional view taken in the line A—A of FIG. 38;

FIG. 41 is a sectional side view of a lamp house; and

FIG. 42 is a schematic diagram of a lamp house from which a lamp-exchanging door and a lamp unit supporting member are removed, seen from the front side.

FIGS. 43–48 relate to a seventh embodiment of the present invention wherein:

FIG. 43 is a sectional side view showing the structure of a lamp house of a light source device;

FIG. 44 is a cross sectional view taken in the line A—A of FIG. 43 seen from the upper side;

FIG. 45 is a side view of a lamp house of FIG. 43;

FIG. 46 is a perspective view showing the structure of an electrical contact element to be arranged in a lamp house;

FIG. 47 is a perspective view showing the structure of a lamp unit; and

FIG. 48 is a perspective view showing the structure of a lamp-exchanging door.

FIGS. 50 and 51 relate to a ninth embodiment of the present invention wherein:

FIG. 50 is a perspective view showing the structure of a amp unit; and

FIG. 51 is a sectional side view showing the structure of a lamp house.

FIGS. 52–56 relate to a tenth embodiment of the present invention wherein:

FIG. 52 is a perspective view of a light source device and a lamp-exchanging door;

FIG. 53 is a perspective view showing the whole structure of a light source device;

FIG. 54 is a cross-sectional view of a light source device seen from the anode side;

FIG. 55 is a sectional top view of a light source device; and

FIG. 56 is a cross-sectional view of a light source device seen from the cathode side.

FIGS. 57–60 relate to a modified clamping lock wherein:

FIG. 57 is a cross-sectional view of a heat sink seen from the cathode side;

FIG. 58 is an enlarged schematic diagram of a clamping lock;

FIG. 59 is a schematic diagram showing the shape of a pushing plate of a clamping lock; and FIG. 60 is a schematic diagram showing another structure of a clamping lock.

FIGS. 61 and 62 relate to an eleventh embodiment of the present invention wherein:

FIG. 61 is a cross sectional view showing the structure of a lamp house of a light source device; and FIG. 62 is a perspective view showing the outside appearance of a light source device.

FIGS. 63 and 64 relate to a twelfth embodiment of the present invention wherein:

FIG. 63 is a cross-sectional view showing the structure of a lamp house of a light source device; and FIG. 64 is a cross-sectional view showing a portion of an electrode to be pressed.

FIGS. 66–71 relate to a fourteenth embodiment of the present invention wherein:

FIG. 66 is a cross-sectional view showing the structure of a lamp house of a light source device;

FIG. 67 is a cross-sectional view of a first modification of an isolating electrode consisting of a leaf spring;

FIG. 68 is a cross-sectional view showing a first mode of the first modification of the isolating electrode of FIG. 67;

FIG. 69 is a cross-sectional view showing a second mode of the first modification of the isolating electrode of FIG. 67;

FIG. 70 is a cross-sectional view showing a third mode of the first modification of the isolating electrode of FIG. 67;

FIG. 71 is a cross-sectional View of a second modification of an isolating electrode provided with an insulating member capable of sliding so that the insulating member can protect the isolating electrode from exposure.

FIGS. 73–76 relate to a fifteenth embodiment of the present invention wherein:

FIG. 73 is a cross-sectional view showing the structure of a lamp house of a light source device;

FIG. 74 is a perspective view showing the outside appearance of a light source device;

FIG. 75 is a perspective view showing the structure of a heat sink; and

FIG. 76 is a cross-sectional view showing a lamp house with a lamp exchanging door closed.

FIGS. 77–79 relate to a sixteenth embodiment of the present invention wherein:

FIG. 77 is a cross-sectional view showing the structure of a lamp house of a light source device;

FIG. 78 is a perspective view showing the structure of a heat sink;

FIG. 79 is a cross-sectional view showing a lamp house with a lamp exchanging door closed.

FIGS. 80–88 relate to a seventeenth embodiment of the present invention wherein:

FIG. 80 is a cross-sectional view showing the structure of a lamp house of a light source device;

FIG. 81 is a cross-sectional view of a first modification of a connecting portion of the lamp house shown in FIG. 80;

FIG. 82 is a cross-sectional view showing a connecting portion which is further modified from that shown in FIG. 81;

FIGS. 83 and 84 relate to a second modification of the lamp house shown in FIG. 80 wherein FIG. 83 is a cross-sectional view showing the structure of an easily-detachable connecting portion, and FIG. 84 is a plan view for explanation of the function of tile easily-detachable mechanism shown in FIG. 83.

FIGS. 85 and 86 relate to a third modification of the lamp house shown in FIG. 80 wherein FIG. 85 is a cross-sectional view of an insulating member capable of sliding disposed in a hole through which a screw for fixing a lamp-exchanging door is to be inserted, and FIG. 86 a cross-sectional view of a sliding member disposed in a hole through which a screw for fixing a lamp-exchanging door is to be inserted.

FIGS. 87 and 88 relate to an application of the third modification wherein FIG. 87 is a perspective view of a lamp-exchanging door and FIG. 88 is a cross-sectional view showing the connection between a lamp house and the lamp-exchanging door of FIG. 87.

DETAILED DESCRIPTION OF THE PREFERRED EMBODIMENTS

Figure 1:
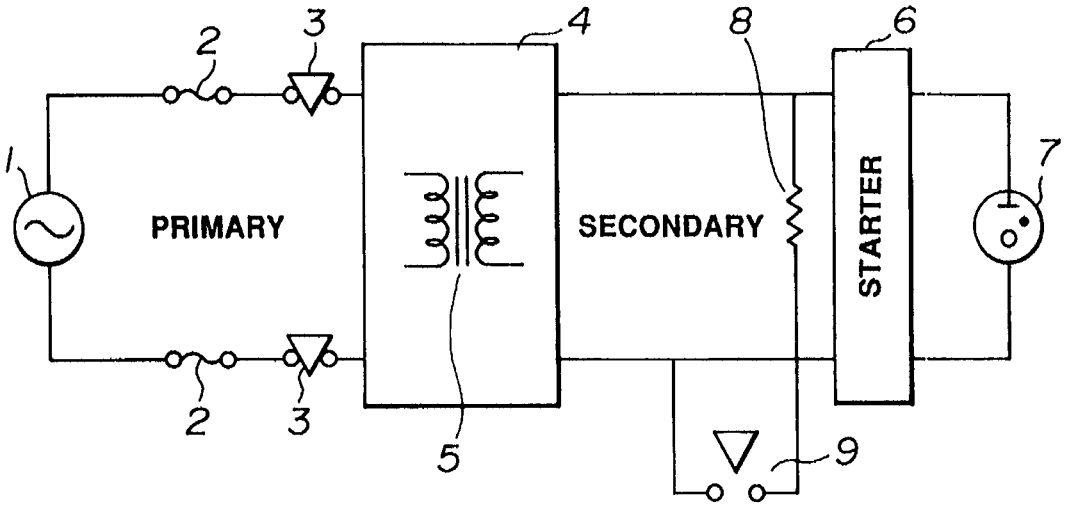
FIG.1 (PRIOR ART)
FIG. 1 is a simplified circuit diagram showing the configuration of a prior art lamp drive circuit.
Figure 2:
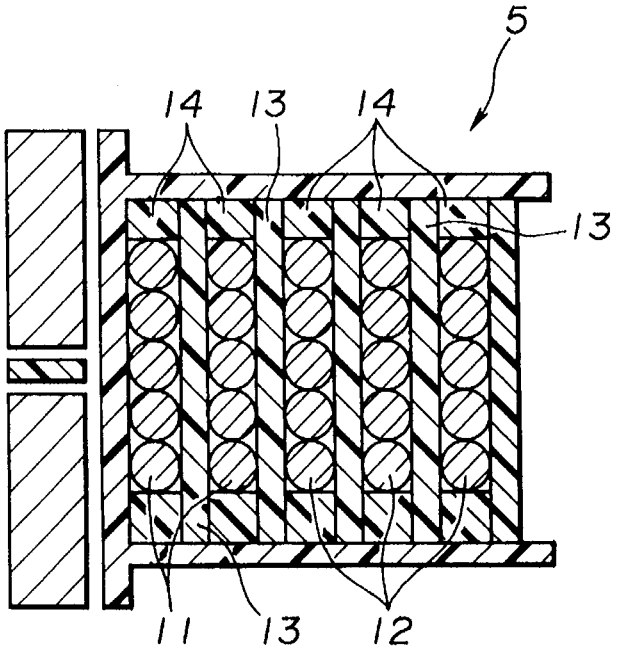
FIG.2 (PRIOR ART)
FIG. 2 is a cross sectional view showing the internal structure of a prior art transformer.
Figure 3:
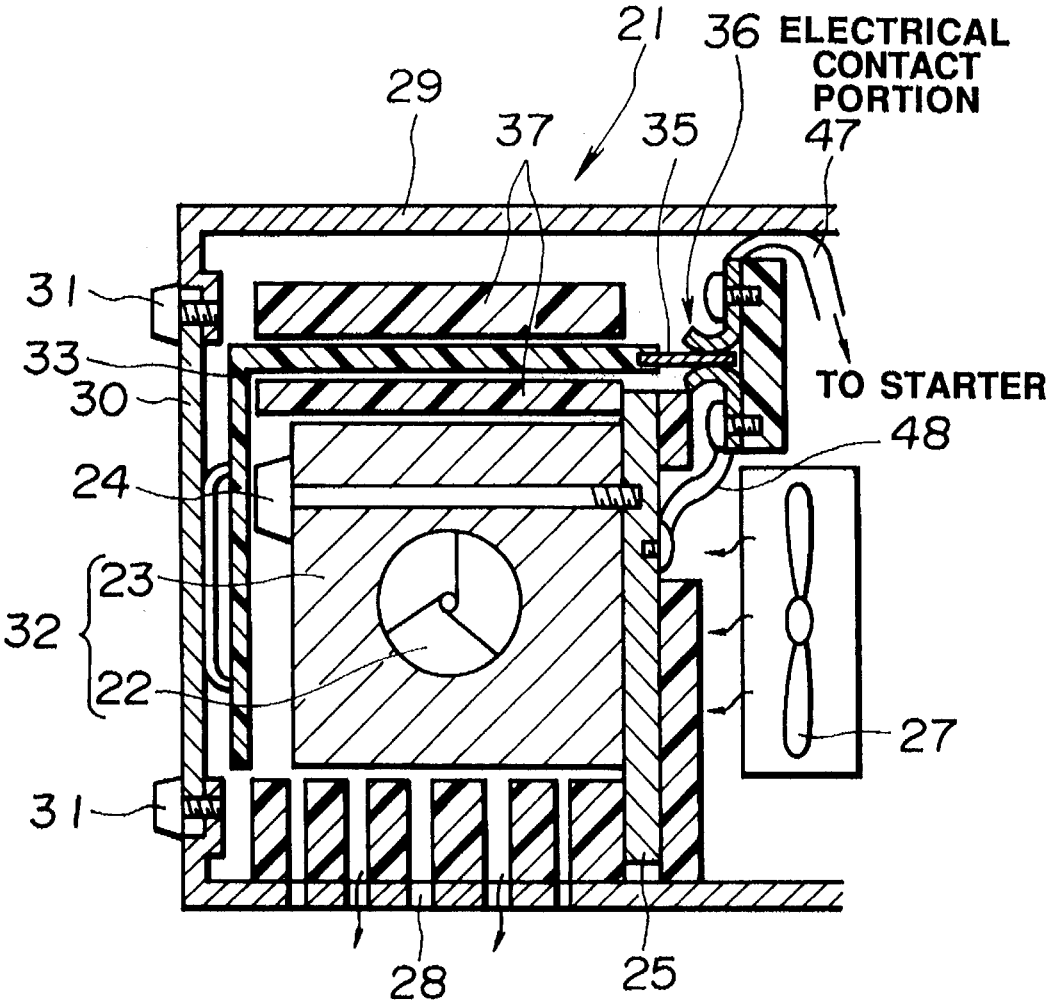

As shown in FIG. 3, in a light source device 21 of a first embodiment in accordance with the present invention, there is disposed a xenon lamp 22 connected to an endoscope (not shown) so that the xenon lamp 22 acts as a light source to the endoscope. The xenon lamp 22 is held with a heat sink 23 via which electric power is supplied to the lamp 22. This heat sink 23 is fixed with a fixing knob 24 to an electrically conductive heat-sink supporting rod 25 disposed in a lamp house, in such a manner that the heat sink 23 can be easily detached.

Figure 4:
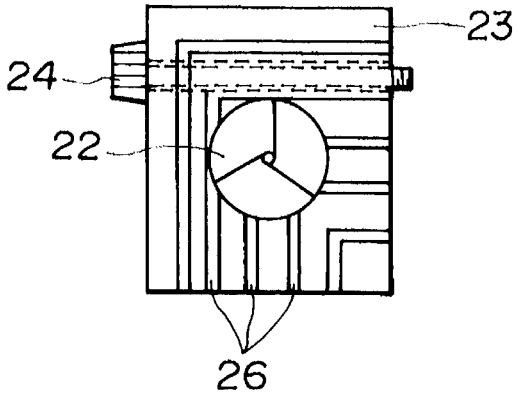

As shown in FIG. 4, grooves 26 are formed in L-shape on the heat sink 23 so that air supplied from a cooling fan 27 flows through the grooves 26 from the horizontal direction to bend down and the air is exhausted through a duct 28 formed on the bottom side of the lamp house. Thus, the xenon lamp 22 and heat sink 23 are cooled.

A lamp-exchanging door 30 is fixed with door fixing knobs 31 to a case 29 of the light source device 21 in such a way that the lamp-exchanging door 30 can be opened/closed when the xenon lamp 22 is replaced. Inside the lamp-exchanging door 30, an insulating inner lamp-exchanging door 33 is disposed to cover the front side of a lamp unit 32 consisting of the xenon lamp 22 and the heat sink 23.

Figure 5:
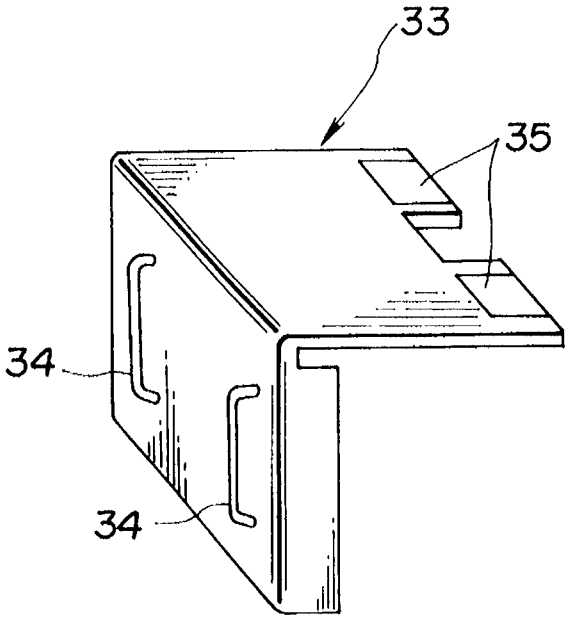

As shown in FIG. 5, the inner lamp-exchanging door 33 is formed in an L shape and has handles 34 on its front surface so that these handles may be held when the inner lamp-exchanging door 33 is pulled out. When the lamp-exchanging door 30 is fixed to the case 29, these handles come into contact with the lamp-exchanging door 30 and the inner lamp-exchanging door 33 is pushed in by the lamp-exchanging door 30, thus, the inner lamp-exchanging door 33 is fixed inside the lamp house.

When the inner lamp-exchanging door 33 is installed, its upper plate is inserted into insertion guide slits of the main portion 37 of the lamp house composed of insulating member. Electrically conductive portions 35 are formed on the end portion of the upper plate of the inner lamp-exchanging door 33. When the inner lamp-exchanging door 33 is installed at the proper position, the electrically conductive portions 35 are fit into electrical contact elements 36 disposed at the back portion on the upper side of the lamp house such that electrical connections are made via two electrical contact elements 36. Both end portions of the front panel of the inner lamp-exchanging door 33 are bent toward the sides of the inner lamp-exchanging door 33 so that insulating materials extend to the front portions of the sides of the inner lamp-exchanging door 33, thus the inner lamp-exchanging door 33 is prevented from contacting the lamp unit 32 when the inner lamp-exchanging door 33 is pulled out from the lamp house.

Figure 6:
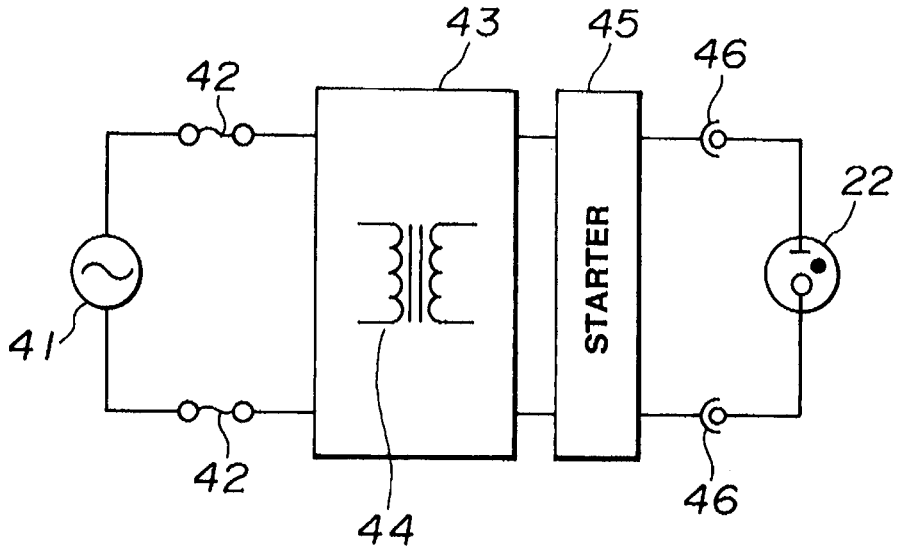

Referring to FIG. 6, a lamp driving circuit of the light source device 21 will be described next.

The lamp driving circuit of the light source device 21 has a switching regulator 43 acting as a power supply circuit for a lamp, wherein the switching regulator 43 is connected to an AC power line 41 via a fuse 42.

The switching regulator 43 includes a transformer 44 composed of an inverter transformer.

The secondary output of the switching regulator 43 is connected to the xenon lamp 22 via a starter 45 for generating a high voltage required for turning on the xenon lamp. The starter 45 and the xenon lamp 22 are electrically connected to each other via isolation connectors 46 having electrical contacts for the output of the starter 45 and for the xenon lamp 22 wherein these two electrical contacts are separated from each other with a space larger than a required minimum insulation distance. In this specific embodiment, such isolation connectors 46 are provided in the electrical contact elements 36 which are to be connected to the heat sinks 23 having electrical connection with electrodes of the xenon lamp 22.

Figure 7:
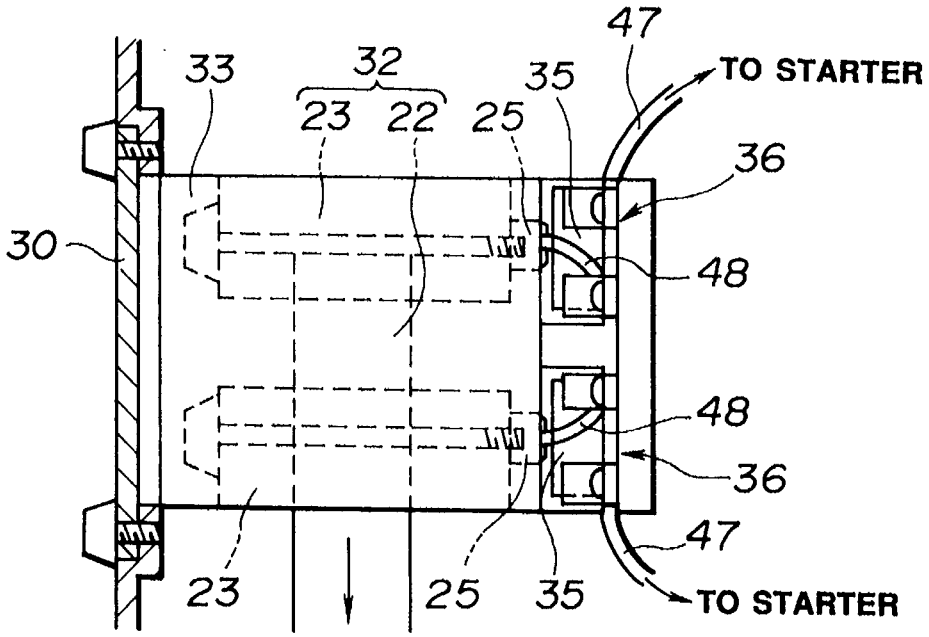

As shown in FIG. 7, one of contacts of an electrical contact element 36 is connected to an electrical wire 47 extending to the starter 45, and the other contact is connected to an electrical wire 48 extending to a heat-sink-supporting-rod 25 which is electrically connected to a heat sink 23. In the same way, the other electrode of the starter 45 is also electrically connected to the other heat sink 23 via the other electrical wipe 47 extending from the starter 45, the other electrical contact element 36, the other electrical wire 48, and the other heat-sink-supporting-rod 25.

Figure 8:
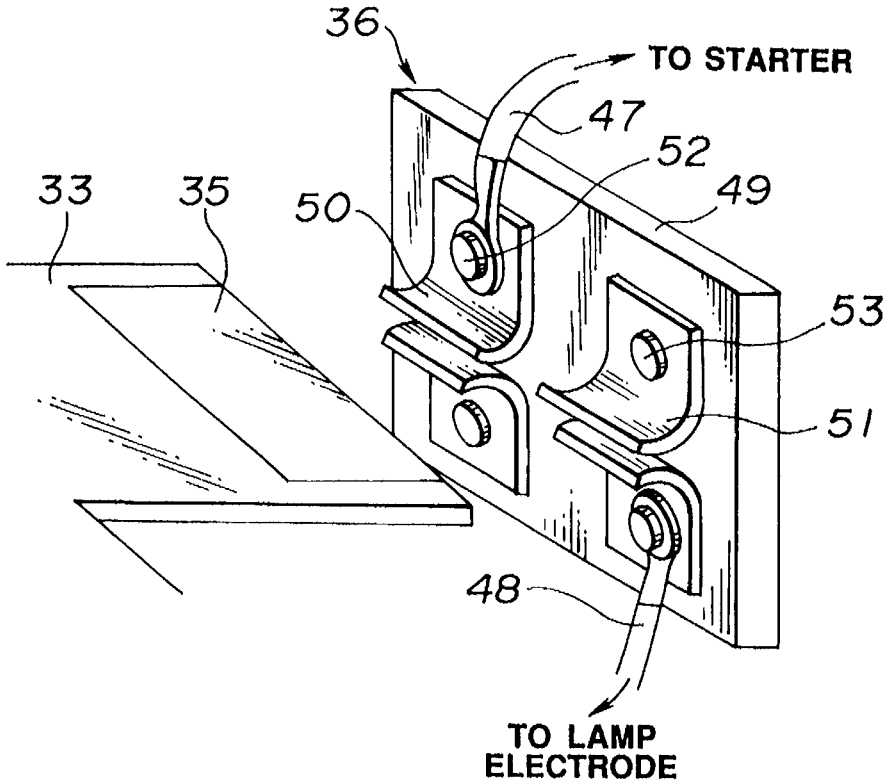

As shown in FIG. 8, each of the electrical contact elements 36 includes a contact supporting substrate 49 made of insulating material on which two pairs of the electrical contacts 50 and 51 are fixed with fixing screws 52 and 53, wherein each pair has two contacts opposing each other in the vertical direction.

Figure 9:
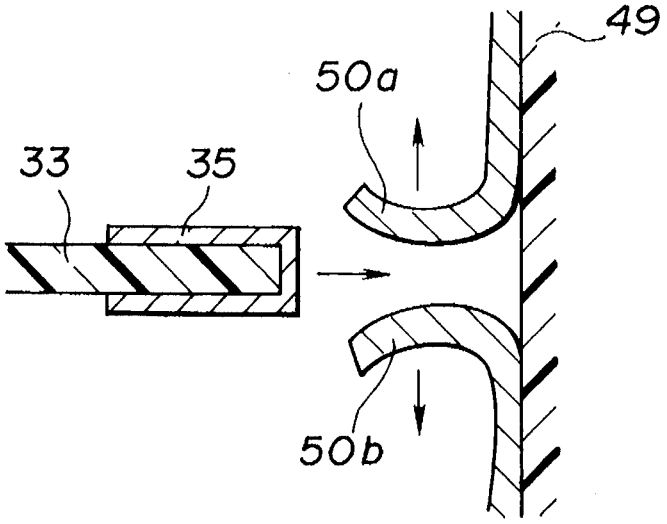

Because the electrical contacts 50 and 51 are made of an elastic material, when the end portions of the upper plate of the inner lamp-exchanging door 33 are pushed in, two opposing contacts 50*a* and 50*b* are spread and widened so that the electrically conductive elements 35 formed on both surfaces of the end portions of the inner lamp-exchanging door 33 are fit in between the opposing contacts 50*a* and 50*b* as shown in FIG. 9. Thus, two electrodes of each electrical contact elements 36 are electrically connected to be ready for supplying electric power to the lamp unit 32.

In the case where the inner lamp-exchanging door 33 is removed and the electrical connection is broken at the electrical contact elements 36, the insulation distance is defined by the space between the electrical contacts 50 and 51.

Now, the operation of the present embodiment will be described.

In the light source device 21, the switching regulator 43 connected to the AC power line 41 supplies electric power to the xenon lamp 22 via the starter 45, thus the xenon lamp 22 is turned on so as to supply light to the endoscope. When the light intensity of the xenon lamp 22 becomes too small or it burns out or due to other reasons, the xenon lamp 22 must be replaced.

In the first step of procedure for replacing the xenon lamp 22, an operator performing the replacement loosens the knob 31 of the screw fixing the lamp-exchanging door 30 to the case 29, then removes the lamp-exchanging door 30. At this time, the lamp unit 32 is still electrically live and active. However, because the lamp unit 32 is covered with the inner lamp-exchanging door 33 which is made of a non-conductive material, the operator cannot touch the active regions such as a heat sink 23.

Figure 10:
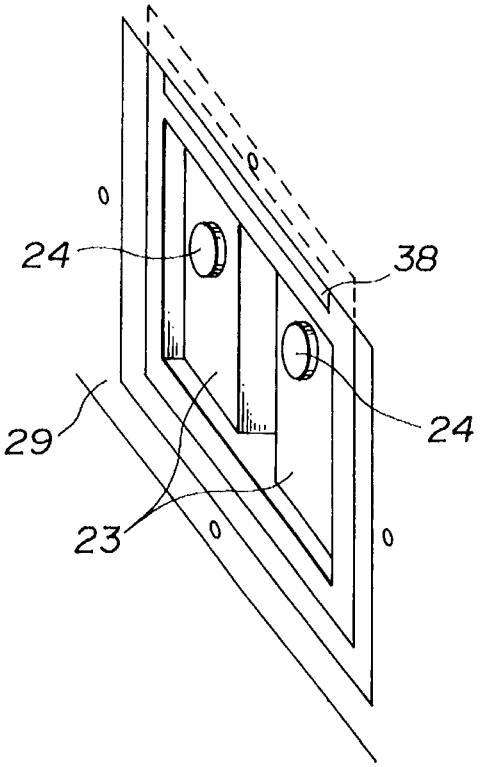

Then, the inner lamp-exchanging door 33 covering the lamp unit 32 is removed to expose the lamp unit 32. When the inner lamp-exchanging door 33 has been removed, the heat sinks 23 are exposed as shown in FIG. 10, thus it is now possible to remove the heat sinks 23. At this stage, because the inner lamp-exchanging door 33 has been removed, the electrically conductive elements 35 formed on the end portions of the inner lamp-exchanging door 33 have been also removed from the electrical contact elements 36. Thus, electrical connection has been broken between two pairs of the electrical contacts 50 and 51 of the electrical contact elements 36.

In this way, by means of electrical isolation with a required electrical distance introduced between the electrical contacts 50 and 51, the electrical wires 47 extending from the starter 45 are electrically isolated from the electrical wires 48 and the other portions connected to the electrical wire 48 such as the heat sinks 23 and the xenon lamp 22. Thus, electric power supplied to the heat sinks 23 is stopped.

The electrical contacts 50 and 51 are disposed such that the distance between them is larger than the insulation distance prescribed by safety standards. Until electrically conductive elements 35 get away from the electrical contacts 50 and 51 by a distance larger than the insulation distance defined above, the heat sinks 23 remain covered with the front portions of the sides of the inner lamp-exchanging door 33, thus there is no possibility for the operator to get in contact with the heat sinks 23.

Now, the operator turns the knobs 24 which fix the heat sinks so as to release fixing, then removes the xenon lamp 22 together with the heat sinks 23 from the light source device and replaces the xenon lamp 22. In this operation step, touching the heat sinks 23 never causes the electrical shock to the operator, because perfect electric isolation is achieved between the heat sinks 23 and the electric power source.

Figure 11:
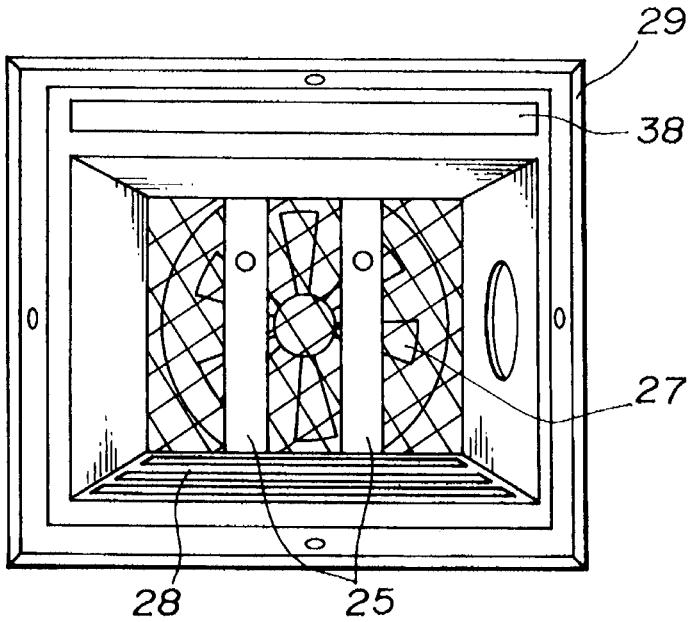
Figure 12:
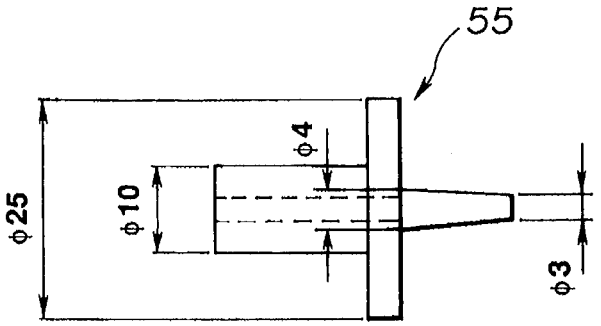
FIG. 12 is a schematic diagram showing a test pin prescribed in the safety standard.

FIG. 11 shows the light source device in a state where the lamp unit 32 is removed. The heat-sink-supporting-rods 25 are disposed on the back side in the inside of the lamp house so that heat sinks 23 may be attached to these heat-sink-supporting-rods 25. When the xenon lamp 22 is in an ON state, air is supplied to the heat sinks 23 from the cooling fan 27 arranged on the back side of the heat-sink-supporting-rods 25 so as to cool the lamp unit 32. Then, air is exhausted through the ducts 28. An aperture 38 of the insertion guide slit into which the upper plate of the inner lamp-exchanging door 33 is to be inserted is formed to have a width, for example, less than 3 mm so that the inner active regions may not be in contact with a test pin 55 and a test finger 56, as in FIG. 12, defined by the safety standard such as the IEC standard. As can be seen from the above description, distance from the aperture portion to the electrical contact elements 36 is great enough to avoid the dangerous possibility for persons to touch the electrical contact elements 36. Thus, there is no possibility for a person to get an electric shock unless he inserts a fine metallic rod or the like.

After the lamp is replaced, the inner lamp-exchanging door 33 is inserted into the aperture 38 along the insertion guide slit of the main portion 37 of the lamp house such that the electrically conductive elements 35 of the inner lamp-exchanging door 33 are fit into the electrical contacts 50 and 51 of the electrical contact elements 36, thus the starter 45 is electrically connected to the heat sinks 23 and further to the xenon lamp. Thus, the xenon lamp 22 is turned on. Furthermore, by attaching the lamp-exchanging door 30, the handles 34 of the inner lamp-exchanging door 33 get in contact with the lamp-exchanging door 30 and the inner lamp-exchanging door 33 is pushed in and pressed with the lamp-exchanging door 30. Thus the inner lamp-exchanging door 33 is secured to its position with no possibility that the electrically conductive elements 35 leave from the electrical contact elements 36 due to vibration or other reasons.

As described above, the light source device of the present embodiment has the isolation connector which functions in such a way that when the lamp-exchanging door is secured or removed, the electrically conductive elements provided on the lamp-exchanging door are fit into or removed from the electrical contact elements to connect or disconnect the lamp driving circuit to the lamp electrodes. Thus simple and perfect electrical isolation is achieved for the heat sinks and the lamp during a lamp-exchanging job.

Furthermore, because the electrical contacts are arranged far away from on the aperture, the electrically active regions such as electrical contacts are protected from operator's touch, thus better safety is achieved. When the lamp unit elements such as heat sinks are exposed to the operator during a lamp-exchanging job, the lamp unit is electrically isolated with an insulation distance larger than that prescribed in the safety standard such as IEC, UL, or the like.

All portions which are exposed to the operator during the lamp-exchanging job are perfectly isolated with a enough insulation distance, thus there is no need to use reinforced insulation in the transformer of the switching regulator in the lamp driving circuit. As a result of this, it is possible to reduce the size of the transformer.

The lamp unit is electrically isolated and the leakage current is negligibly small, thus it is not necessary to provide an interlock switch for cutting off the primary circuit during the lamp-exchanging job, which is essentially required in the conventional devices. In addition, because the starter circuit is isolated from the other portions, it is not necessary to provide an interlock switch for discharging the charges stored in a capacitor arranged in the secondary circuit which is required to avoid an electric shock in the conventional devices, thus a small-sized micro-switch is good enough to stop oscillation of the switching regulator. As a result, the reduction of the device size can be achieved.

Figure 14:
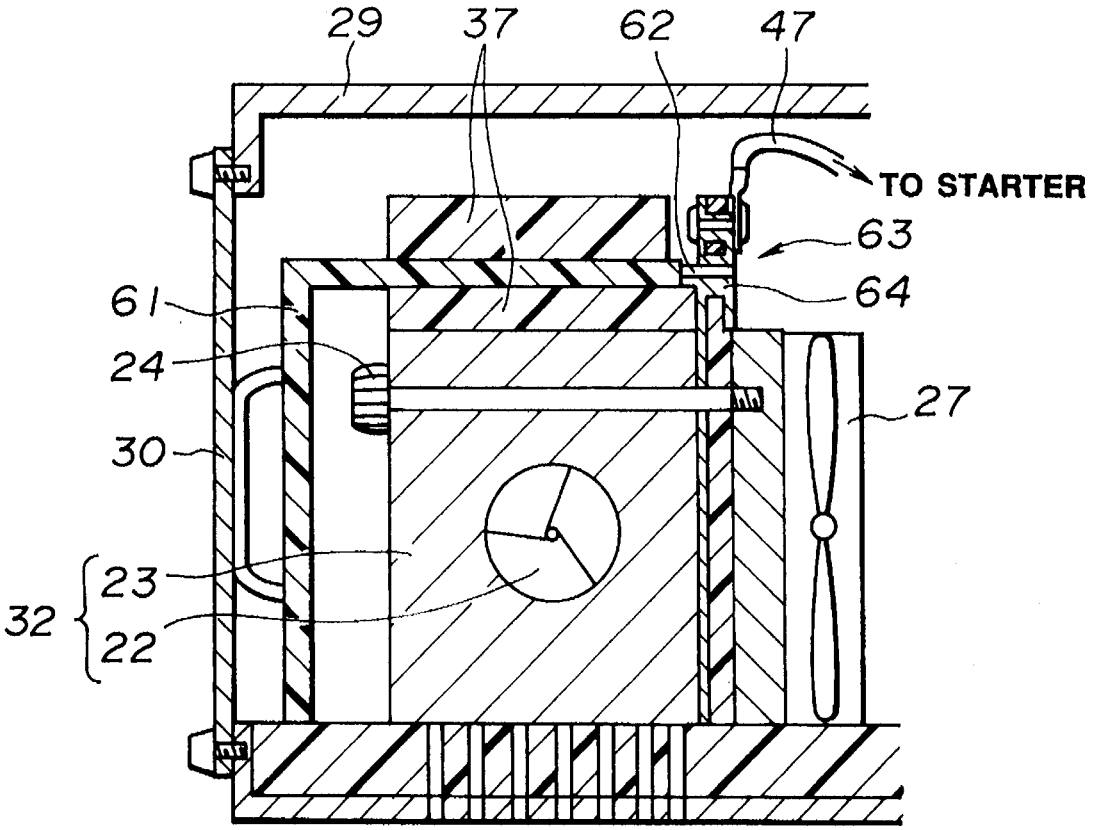
Figure 15:
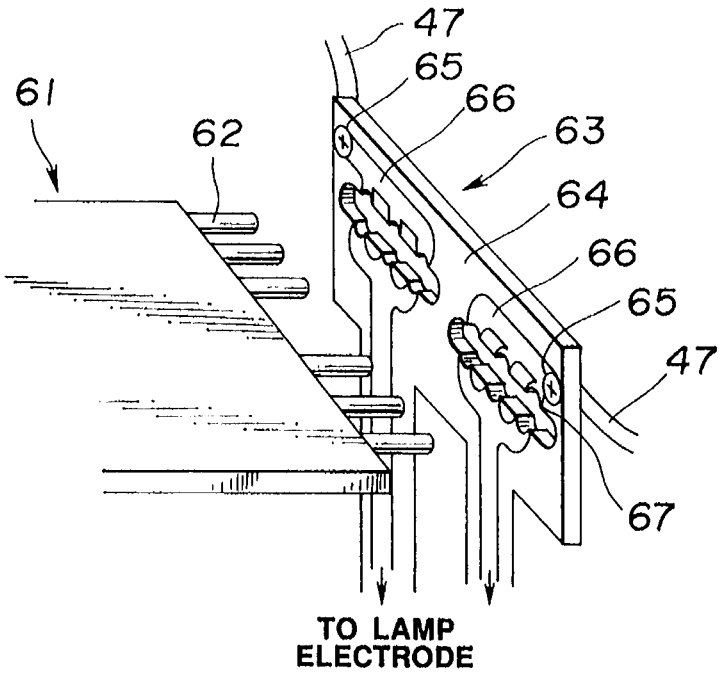

In a light source device in accordance with a second embodiment of the present invention, as shown in FIG. 14, the structure is modified in the electrically conductive elements and the electrical contact elements into which the electrically conductive elements are fit. As shown in FIG. 14, a inner lamp-exchanging door 61 is made of an insulating material having a form similar to L-shape, as in the case of the first embodiment. Metal rods 62 are arranged in such a manner that they extend from the end portion of the upper plate of the inner lamp-exchanging door 61. When the metal rods 62 fit into an electrical contacts 63, a starter is electrically connected to heat sinks. Other configurations are the same as those in the first embodiment, so explanation will not be repeated for the same portions. As shown in FIG. 15, each electrical contact 63 has three individual electrical conductive patterns 66 for each electrode arranged on a substrate 64. One of ends of the electrical conductive film patterns 66 is connected to an electrical wire 47 in such a manner that a round-shape electrode connected to the electrical wire 47 by solderless wrapped connection is fixed with a fixing screw 65 to one of ends of the electrical conductive film patterns 66. As shown in FIG. 14, the substrate 64 having the electrically conductive film patterns 66 is attached to heat sinks 23, so that the other end of electrically conductive film patterns 66 is electrically connected to the heat sinks 23 and further to a xenon lamp 22. Both ends of each electrically conductive film pattern 66 are isolated from each other by an insertion hole 67 formed through the substrate 64. When the metal rods 62 of the inner lamp-exchanging door 61 are inserted into these insertion holes 67, both the ends of each electrically conductive film pattern 66 are electrically connected to each other.

Figure 16:
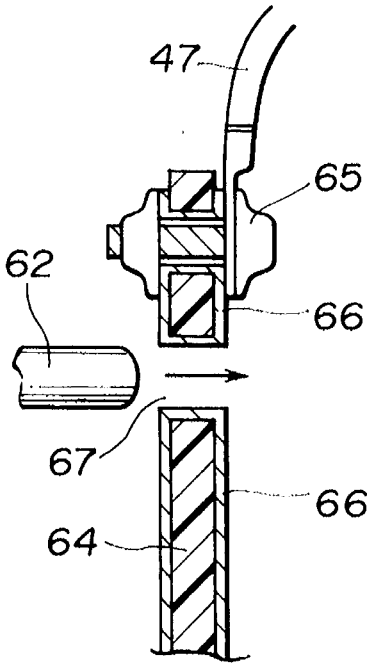

In the present embodiment, the metal rods 62 are provided to correspond to each electrode of the inner lamp-exchanging door 61. That is, as shown in FIG. 16, the substrate 64 having the electrically conductive film patterns 66 also has conductive films formed on the inner walls of the insertion holes 67 like the shape of through-holes, so that the metal rods 62 can get into contact with these conductive films to make electrical connection between both-the ends of the electrically conductive film patterns 66.

The insertion holes 67 are also provided with expanding slots so that a sufficiently long creepage distance can be achieved when the metal rods 62 are removed.

Figure 17:
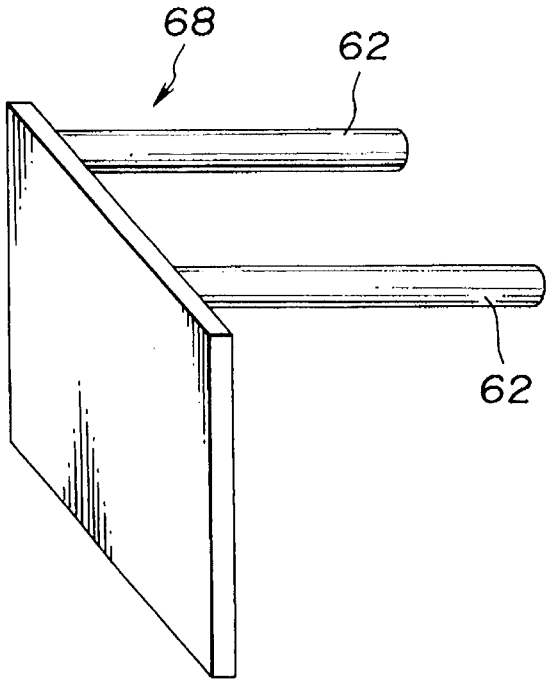

As for the metal rods 62, other modifications may be possible such as one metal rod for each electrode as in the case of an inner lamp-exchanging door 17 modified from the second embodiment which will be shown in FIG. 17, or any plural number of rods may be arranged depending on the magnitude of current. In the same manner as in the case of the first embodiment, when the inner lamp-exchanging door 61 is attached, the metal rods 62 are inserted into the insertion hole 67 such that the metal rods 62 make electrical connection between the isolated ends of the electrically conductive film patterns 66, thus electric power is supplied to the lamp. On the other hand, when the inner lamp-exchanging door 61 is removed for a lamp-exchanging job, the metal rods 62 are also removed, thus both ends of the electrically conductive film patterns 66 are electrically isolated. In this situation, sufficiently long insulation distance is achieved which is defined by the space distance between the ends and the creepage distance of the expanding slots.

As described above, as in the case of the first embodiment, the present embodiment provides simple structure which ensures the safety with no possibility of an electric shock during the lamp-exchanging job. In addition, the reduction of the transformer size is also achieved. Besides, there is no necessity of interlock switches.

Furthermore, in the present invention, the conductive film patterns connected to the starter are directly attached to the heat sinks, thus simplification is achieved in electrical wiring.

Electrical connection between the ends of the electrically conductive film patterns is achieved simply by inserting the metal rods into the insertion holes of the substrate, thus any special electric contact members are not necessary. As a result, simplification and miniaturization are achieved in the electrical contacts.

As required, the number of metal rods may be increased to adapt the case where larger amount of currents are needed for turning on the lamp.

Figure 18:
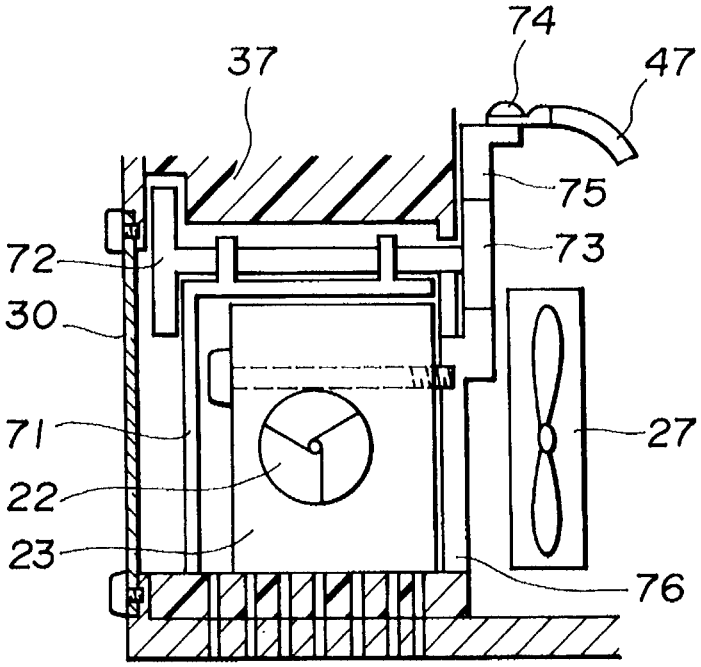

As shown in FIG. 18, in a light source device in accordance with a third embodiment of the present invention, the structure is further modified in the electrically conductive elements and the electrical contact elements into which the electrically conductive elements are fit.

Figure 19:
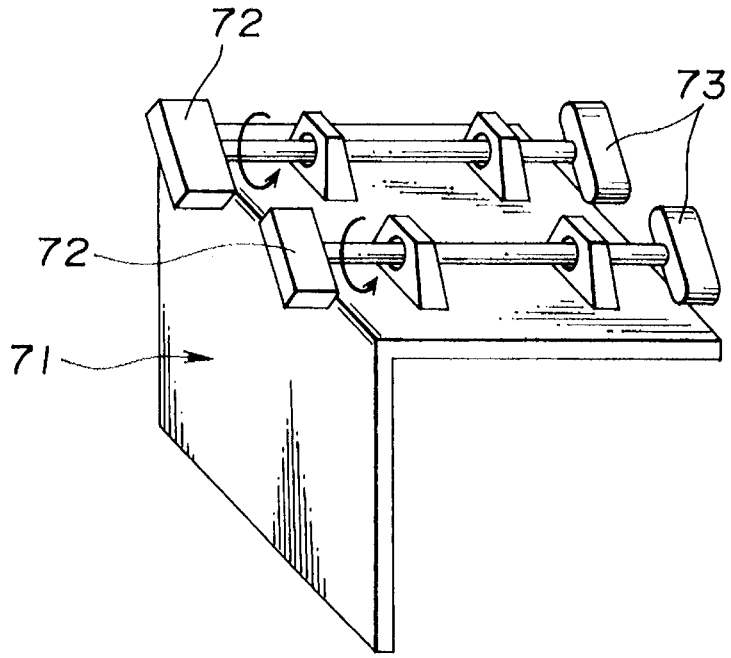

As in the case of the first embodiment, an inner lamp-exchanging door 71 is made of an insulating material having a form similar to L-shape, as shown in FIGS. 18 and 19. On the upper side of the inner lamp-exchanging door 71, there are provided fixing knobs 72 made of insulating material for fixing the inner lamp-exchanging door 71 and also provided electrical conductive elements 73 which are movable in conjunction with the fixing knobs 72. Electric wires 47 connected to a starter are fixed to metal plates 75 with fixing screws 74. On the other hand, heat sinks 23 are electrically connected to electrically conductive supporting plates 76.

When the fixing knobs 72 are turned, the electrical conductive elements 73 formed on the end portions of the fixing knobs 72 get into contact with the metal plates 75 and the electrically conductive supporting plates 76, thus the heat sinks are electrically connected to the starter. Other configurations are the same as those in the case of the first embodiment, so explanation will not be repeated here for the same portions.

Figure 20:
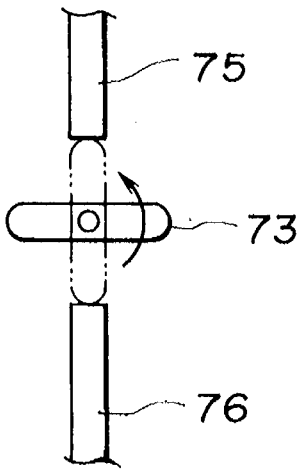

As shown in FIG. 20, an electrical contact element consists of an electrical conductive element 73, a metal plate 75, and an electrically conductive supporting plate 76. To ensure that two end faces of the electrical conductive elements 73 get into contact with an end face of the metal plates 75 and an end face of the electrically conductive supporting plates 76, end portions of the electrical conductive elements 73 are formed in a convex shape.

When the fixing knobs 72 of the inner lamp-exchanging door 71 are rotated, the electrical conductive elements 73 are also rotated according to the rotation of the fixing knobs 72, thus the end portions of the electrical conductive elements 73 are connected with pressure to end portions of the metal plates 75 and the electrically conductive supporting plates 76 so that electrical conduction occurs. In a state where the metal plates 75 are electrically connected to the electrically conductive supporting plates 76, the fixing knobs 72 which move in conjunction with the electrical conductive elements 73 are in the vertical position and the inner lamp-exchanging door 71 is fixed to the main portion 37 of the lamp house.

The metal plates 75 and the electrically conductive supporting plates 76 are arranged such that the distance between them is larger than the insulation distance prescribed in the safety standard.

As in the case of the first embodiment, the starter is electrically isolated from the heat sinks when the inner lamp-exchanging door 71 is removed for a lamp-exchanging job. On the other hand, when the inner lamp-exchanging door 71 is fixed with the fixing knobs 72 to the main portion 37 of the lamp house, the electrical conductive elements 73 formed on the end portions of the fixing knobs 72 get into contact with the metal plates 75 and the electrically conductive supporting plates 76 such that the metal plates 75 are electrically connected to the electrically conductive supporting plates 76, thus electric power is supplied to the lamp.

When the fixing knobs 72 are rotated until they get in the horizontal positions for the lamp-exchanging job, the fixing knobs 72 are released from the slots of the main portion of the lamp house, thus the inner lamp-exchanging door 71 becomes ready for being removed. At the same time, the electrical conductive elements 73 in conjunction with the fixing knobs 72 are separated from the metal plates 75 and the electrically conductive supporting plates 76, thus the electrical connection between the metal plates 75 and the electrically conductive supporting plates 76 is broken. When the inner lamp-exchanging door 71 is completely removed and the lamp electrodes are exposed to an operator or a person on the lamp-exchanging job, the metal plates 75 are electrically isolated with a certain insulation distance from the electrically conductive supporting plates 76 connected to the heat sinks 23, thus there is no possibility for an electric shock.

As described above, as in the case of the first embodiment, the present embodiment also provides simple structure which ensures the safety with no possibility of an electric shock during the lamp-exchanging job.

In addition, the reduction of the transformer size is also achieved. Besides, there is no necessity of interlock switches.

Moreover, in the present embodiment, the electrically conductive supporting plates 76 act not only as supporting plates for fixing the heat sinks but also act as electric conductors for supplying electric power to the lamp, thus further simplification of the device structure can be achieved.

The fixing knobs 72 in conjunction with the electrical conductive elements not only make it possible to turn on the power supply to the lamp, but also fix the inner lamp-exchanging door, thus it is ensured that the lamp-exchanging door is firmly fixed for protecting the lamp unit.

Figure 21:
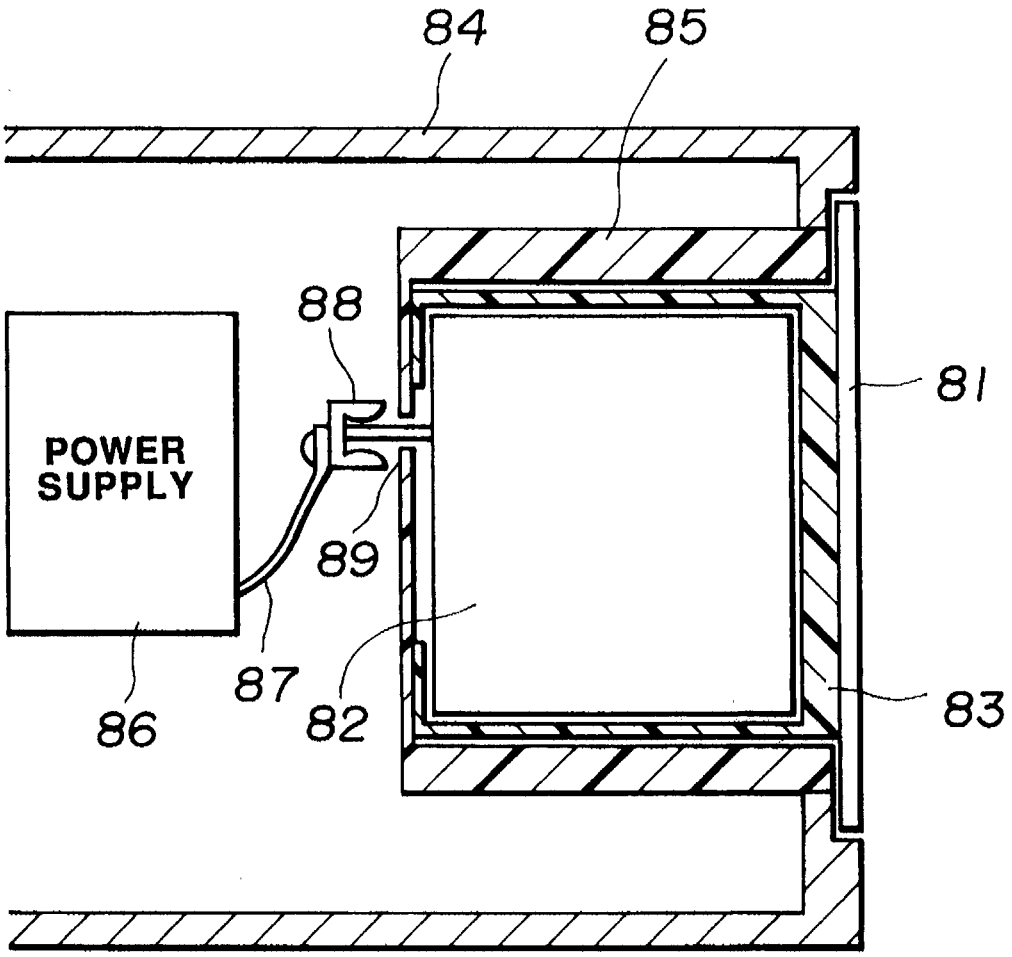

As shown in FIG. 21, in a light source device in accordance with a fourth embodiment of the present invention, a lamp-exchanging door 81 is provided with a lamp-unit-supporting-element 83 for supporting a lamp unit including a xenon lamp and heat sinks. Thus, when the lamp-exchanging door 81 is inserted/removed, the lamp unit 82 is also inserted/removed remaining situation where the lamp unit 82 is integrally attached to the lamp-exchanging door 81.

The lamp-unit-supporting-element 83 is inserted into a lamp house 85 fixed to a main unit 84 of the light source device. The lamp-unit-supporting-element 83 and the lamp house 85 are made of an insulating material.

A socket 88 is arranged behind the lamp house 85, wherein the socket 88 is connected via electric wires 87 to an electric power supply 86 for supplying electric power to a xenon lamp. Electrodes 89 are disposed extending from the heat sinks of the lamp unit 82 so that these electrodes 89 are inserted through the socket holes to fit into the socket 88.

Figure 22:
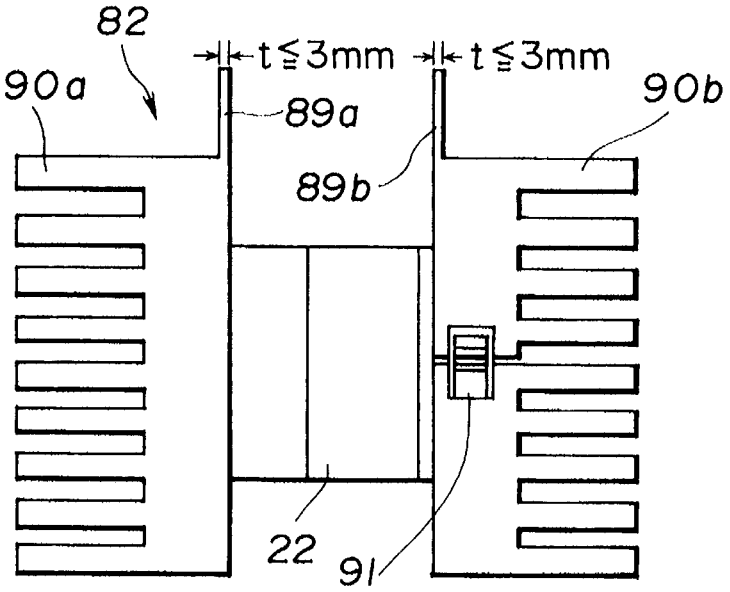

As shown in FIG. 22, the lamp unit 82 includes a xenon lamp 22, an anode heat sink **90*a* for supporting the xenon lamp 22 and for realizing electrical connection to the anode of the xenon lamp 22, and a cathode heat sink 90*b* for supporting the xenon amp 22 and for realizing electrical connection to the cathode of the xenon lamp 22. The anode electrode 89*a* is provided extending upward from the heat s ink 90*a*, and the cathode electrode 89*b* is provided extending upward from the heat sink 90*b***.

These electrodes are formed in such a manner that their widths are less than 3 mm ($t \leqq 3$ mm).

Figure 23:
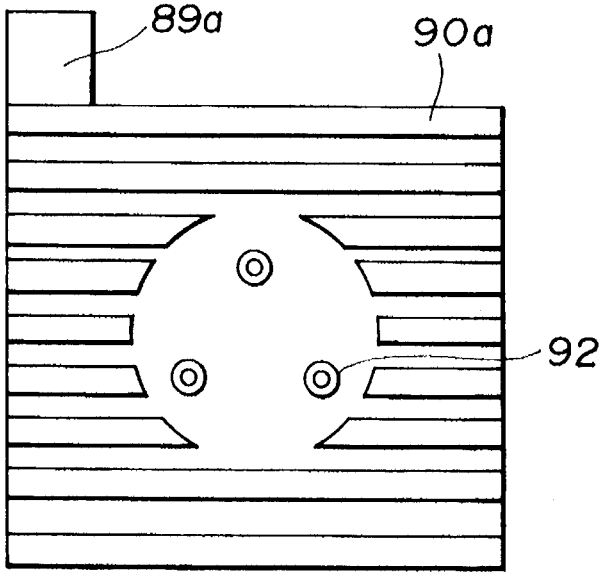

As shown in FIG. 23, the anode portion of the xenon lamp 22 is fixed with three fixing screws 92 to the heat sink **90*a*. On the other hand, the cathode portion of the xenon lamp 22** is secured into the insertion hole of the heat sink 90b together with a cathode electrode metal ring by fastening a clamping lock 91.

Figure 24:
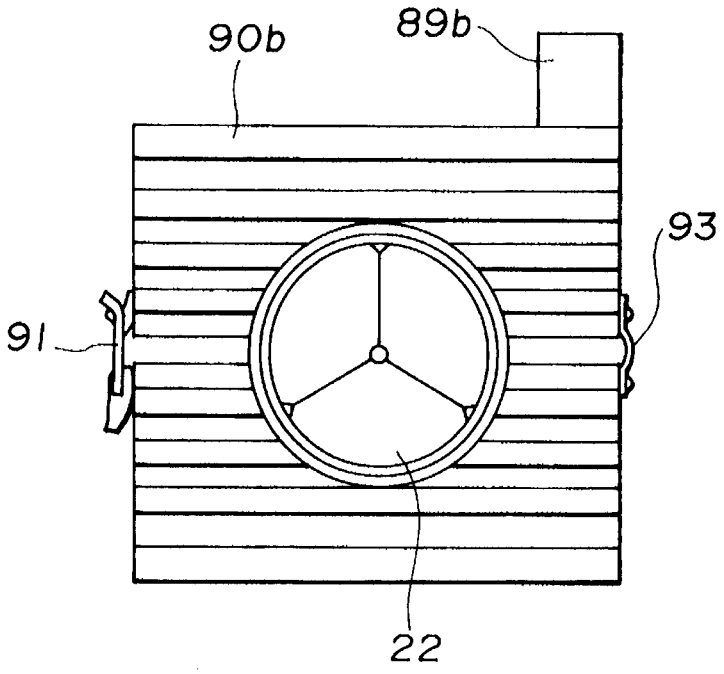

As shown in FIG. 24, the cathode heat sink 90b is divided into two portions, upper and lower ones, one side of each divided portion being connected to each other via an elastic element 93. The other side of each divided portion of the cathode heat sink 90b is provided with a clamping lock 91 so that the two divided portions can be closed or opened as required.

Figure 25:
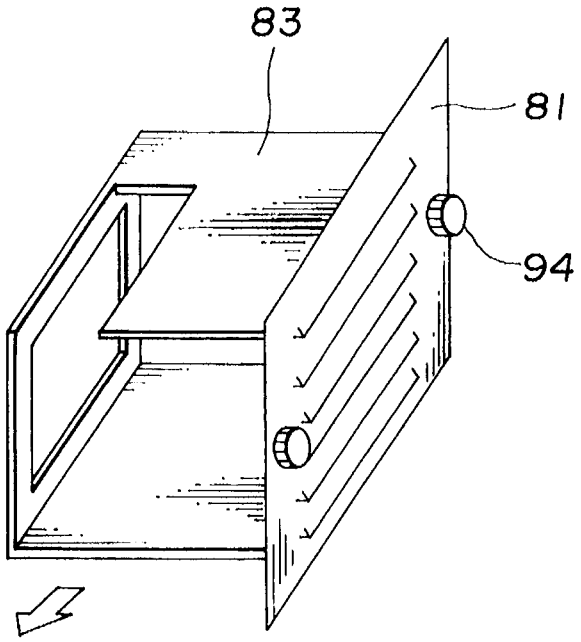

As shown in FIG. 25, the lamp-unit-supporting-element 83 for supporting the lamp unit 82 has a box-like shape with holes on the back side and a side. Through the hole formed on the side of it, the lamp unit 82 is inserted into the lamp-unit-supporting-element 83 and the lamp unit 82 is held in it. A portion of the upper plate of the lamp-unit-supporting-element 83 is cut out so that the electrodes 89a and 89b can be pass through the cutout portion when the lamp unit 82 is inserted inside the lamp-unit-supporting-element 83.

The hole on the back side of the lamp-unit-supporting-element 83 is provided for supplying cooling air through it from a cooling fan. When the lamp unit 82 is removed from the lamp-unit-supporting-element 83, the lamp unit 82 is pulled out in the direction denoted by an arrow in FIG. 25, which is opposite to the attaching direction. The lamp-exchanging door 81 is arranged on the front side of the lamp-unit-supporting-element 83. The lamp-exchanging door 81 is provided with fixing screws 94 for fixing the lamp-unit-supporting-element 83 and the lamp-exchanging door 81 to the lamp house 85. The lamp-exchanging door 81 also has a plurality of slit-like holes for exhausting the cooling air.

Figure 26:
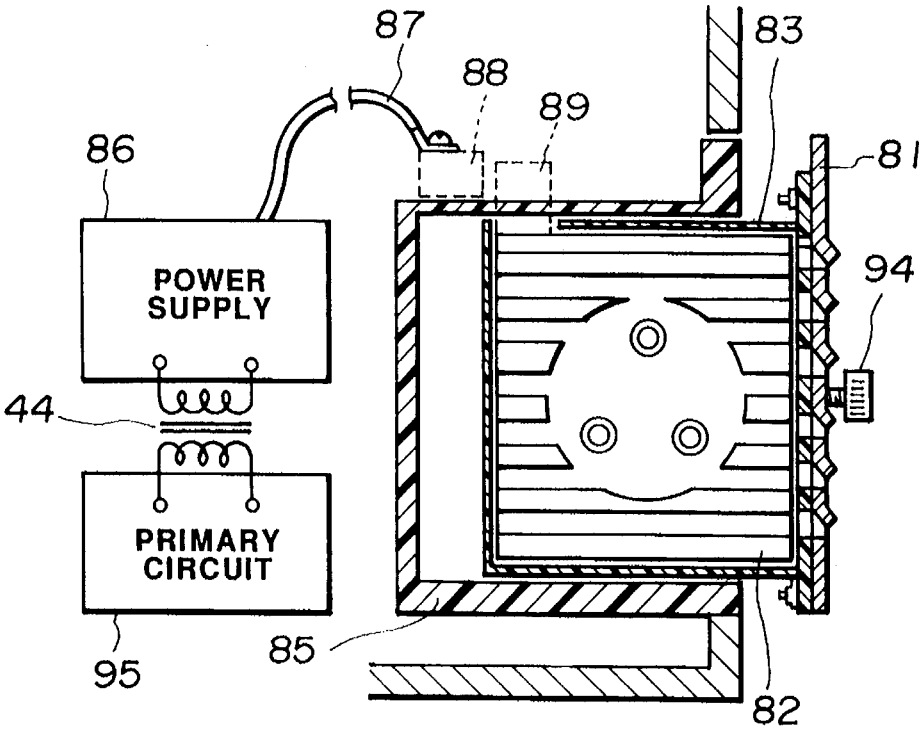

As shown in FIG. 26, the lamp-unit-supporting-element 83 with the lamp unit 82 attached in it and the lamp-exchanging door 81 can be installed into the lamp house 85. The socket 88 is arranged on the upper side of the lamp house 85 so that the electrode 89a of the heat sink 90a and the electrode 89b of the heat sink 90b can be fit into the socket 88. The socket 88 is connected via the electric wires 87 to the electric power supply 86 which is further connected to a primary circuit 95 via a transformer 44.

Figure 27:
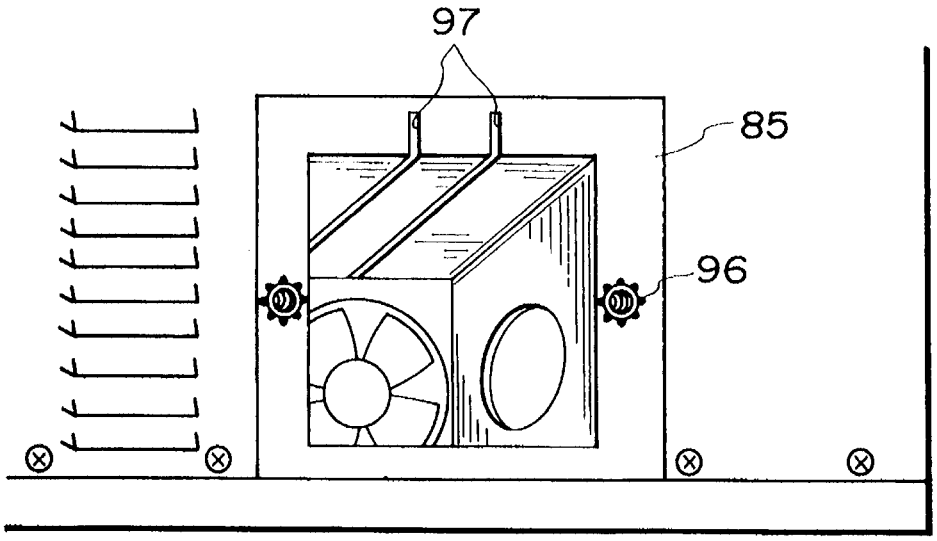

As shown in FIG. 27, grooves 97 are formed on the upper plate of the lamp house 85 so that the electrodes 89a and 89b can be fit in these grooves. Insertion nuts 96 are provided in the right-hand and left-hand regions of the front holes of the lamp house 85 so that the fixing screws 94 can be screwed into these insertion nuts 96. When the lamp-unit-supporting-element 83 and the lamp-exchanging door 81 are inserted into the lamp house 85 through the front holes, the electrode 89a of the heat sink 90a and the electrode 89b of the heat sink 90b are inserted along the grooves 97 to reach the socket 88, then these electrodes 89a and 89b are fit into the socket 88. Thus, electrical connection is achieved between the sockets and the heat sinks 90a and 90b.

The grooves 97 are formed in such a manner that their widths are less than 3 mm. After the lamp-unit-supporting-element 83 formed in one body with the lamp-exchanging door 81 is installed into the lamp house 85, the lamp-unit-supporting-element 83 is fixed to the lamp house 85 by fastening the fixing screws 94 to the insertion nuts 96.

Now, the functions of the present embodiment will be described below.

In the first step for attaching the xenon lamp to the device, the xenon lamp 22 is attached to the heat sinks 90. The anode side portion of the xenon lamp 22 is fixed to the heat sink 90a with the fixing screw 92. On the other hand, its cathode portion is inserted into the cathode electrode ring put in the opened heat sinks, then it is fixed in it by fastening the heat sink 90b with the clamping lock 91. In this way, the xenon lamp 22 is attached to the heat sinks 90a and 90b to form one body of the lamp unit 82. The lamp unit 82 is installed in the lamp-unit-supporting-element 83 by inserting it through the side hole of the lamp-unit-supporting-element 83. At this stage, the lamp-unit-supporting-element 83 is already fixed to the lamp-exchanging door 81. Thus, the lamp unit can be installed in the following way: the lamp-unit-supporting-element 83 is inserted through the front hole of the lamp house 85, then while the lamp-exchanging door 81 is pressed onto the front face of the lamp house 85, the fixing screws 94 are fastened to the insertion nuts 96 so as to stick the lamp-exchanging door 81 to the lamp house 85. Thus, the lamp unit 82 supported with the lamp-unit-supporting-element 83 is installed into the deep portion of the lamp house 85.

As a result of the above procedure, the anode electrode 89a and the cathode electrode 89b are fit into the sockets and electrical connection is achieved, thus the xenon lamp 22 is electrically connected to the electric supply 86. The electric power supply 86 supplies electric power to the lamp unit 82 maintaining a state where the electric power supply 86 is isolated from the primary circuit 95 via the transformer 44. This transformer 44 has such structure satisfying the basic insulation and has a creepage distance larger than 3 mm between the primary and secondary windings.

In this situation, the lamp unit 82 is isolated from the outer case by the lamp house 85 and the lamp-unit-supporting-element 83. The holes for exhausting cooling air are formed through the lamp-exchanging door 81 in such a manner that these exhausting air holes correspond to the holes of the lamp-unit-supporting-element 83, thus the electrical insulation at these exhausting holes is achieved with the creepage distance corresponding to the thickness of the lamp-unit-supporting-element 83. The exhausting air holes of the lamp-exchanging door 81 are formed in such a manner that their widths are less than 3 mm so as to avoid entering of test pins prescribed in the safety standard such as IEC.

Figure 13:
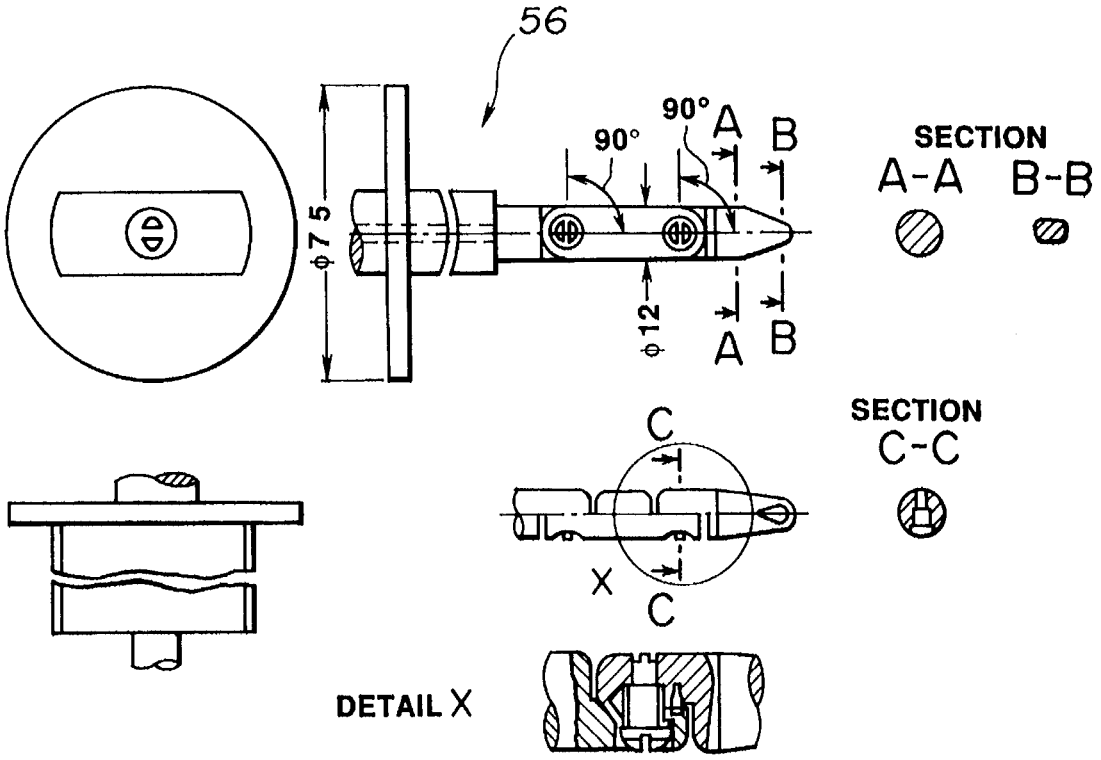
FIG. 13 is a schematic diagram showing a test finger prescribed in the safety standard.

On the other hand, when the lamp is exchanged, the fixing screws 94 are loosened then the lamp-exchanging door 81 and the lamp-unit-supporting-element 83 are removed out from the lamp house 85. As a result of this, electrodes 89a and 89b of the heat sinks 90 are separated from the socket 88, thus the electric power supply to the lamp unit 82 is cut off. For example, if it is assumed that the anode electrode 89a and the cathode electrode 89b are 3 mm wide and 6 mm long, then in order to make the distance from the socket 88 to the anode electrode 89a and the cathode electrode 89b larger than 4 mm, which is the creepage distance for reinforced insulation defined in the IEC601-1, it is necessary to dispose the lamp-exchanging door 81 at a position 10 mm or larger away from the lamp house 85. To ensure that the test pin shown in FIG. 12 and the test finger shown in FIG. 13, which are prescribed in IEC610-1, cannot get into contact with the lamp unit 82, the distance between the end face of the lamp unit 82 and end face of the lamp-exchanging door 81 should be larger than 12 mm.

When the lamp unit 82 is completely removed from the lamp house 85, the situation will be as in FIG. 27. As can be seen from this figure, the widths of the grooves 97 acting the paths to introducing the electrodes 89a and 89b is less than 3 mm, thus the holes which may cause a touch to electrically active regions have widths less than 3 mm.

As described above, the lamp-exchanging door and the lamp unit are assembled in the integral form so that when the lamp-exchanging door is removed for a lamp-exchanging job, the electrodes of the lamp unit are automatically removed from the electrical contacts connecting to the electric power supply corresponding to the removal of the lamp-exchanging door. Thus, as in the case of the fourth embodiment, simplification and miniaturization as well as safety are achieved in the device.

In the structure in accordance with the present embodiment, for both cases where the lamp is installed and where the lamp is removed out for the exchange, a creepage distance large enough for electrical isolation can be maintained, thus, there is no possibility of a electrical shock. As a result, basic insulation is good enough for the isolation transformer in the electric power supply to ensure safe operation. Furthermore, interlock switches are not necessary to meet the safety standard (such as IEC601-1), thus the total size of the device can be reduced.

A light source device in accordance with a fifth embodiment of the present invention can be obtained from the fourth embodiment by modifying the structure of the electrodes of the heat sinks in the lamp unit.

Figure 28:
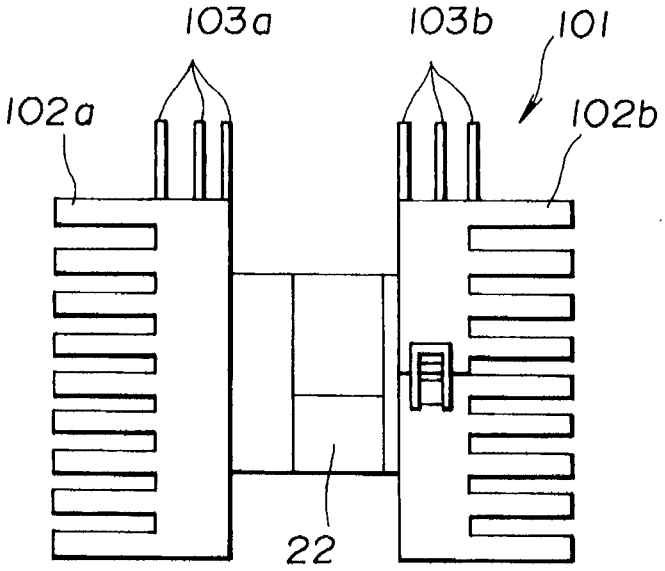
Figure 29:
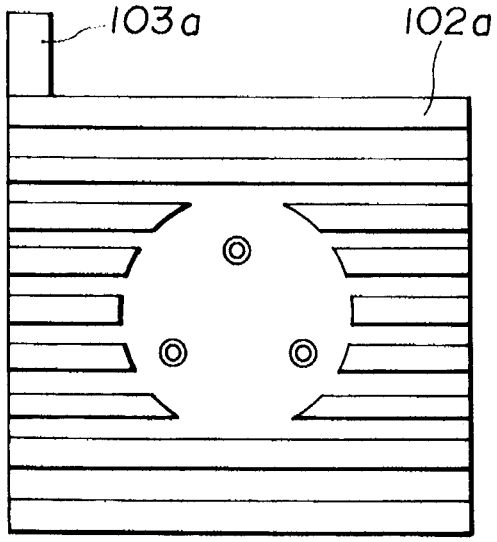
Figure 30:
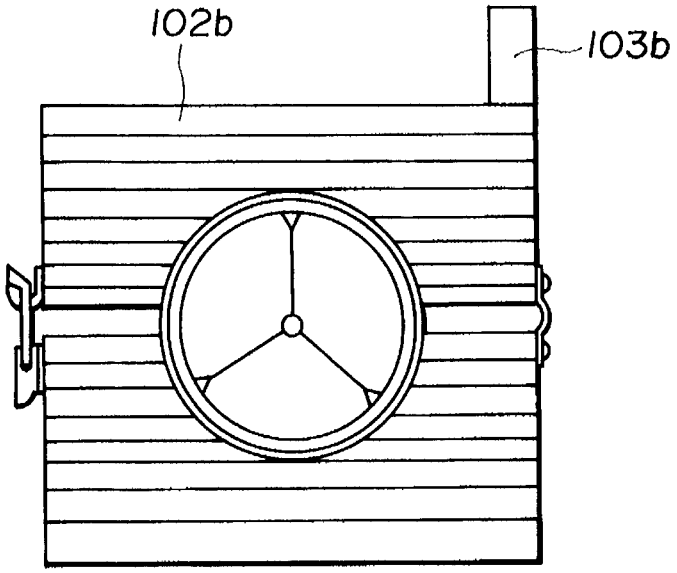

As shown in FIG. 28, a lamp unit 101 comprises a xenon lamp 22, an anode heat sink 102*a*, and a cathode heat sink 102*b*. As shown in FIGS. 29 and 30, the anode heat sink 102*a* has a plurality (three in this specific embodiment) of anode electrodes 103*a* extending upward from the upper side. Similarly, the heat sink 102*b* has a plurality (three in this specific embodiment) of cathode electrodes 103*b* extending upward from the upper side.

The plural electrodes 103*a* and 103*b* are designed so that their widths are less than 3 mm. In the present embodiment, plural electrodes are provides for both the anode electrodes 103*a* and the cathode electrodes 103*b*, thus current capacity is increased. Therefore, depending on the increase in the current capacity, the length of the electrodes is designed to be short in the horizontal direction.

Figure 31:
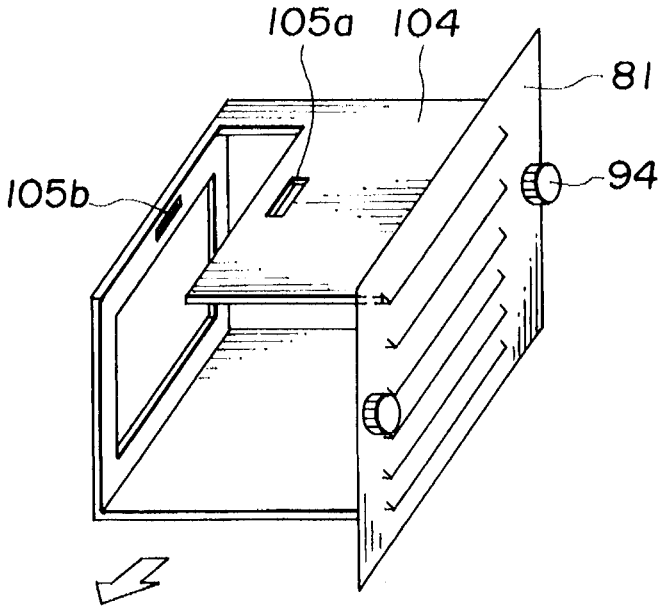

As shown in FIG. 31, a lamp-unit-supporting-element 104 for supporting the lamp unit 101 is made of insulating material in a shape similar to that of the fourth embodiment. A lamp-exchanging door 81 is attached on the front side of the lamp-unit-supporting-element 104. The lamp-unit-supporting-element 104 has band attachment holes 105*a* and 105*b* on the upper side and on the back side at upper position, used to attach fixing bands, which will be described later, over the cutout portions through which the electrodes 103*a* and 103*b* are to be inserted.

Figure 32:
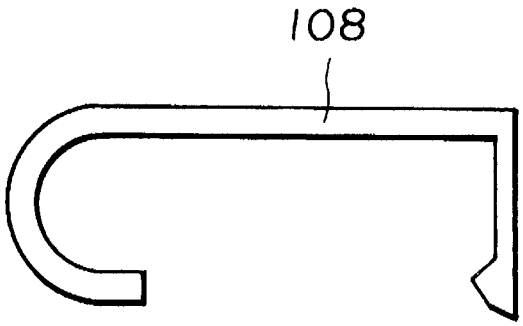

As shown in FIG. 32, a fixing band 108 to be attached to the lamp-unit-supporting-element 104 has a shape of a flat plate, one end portion being bent into J-shape, the other end portion being bent at a right angle. On the end portion bent at a right angle, there is formed a convex stopping claw which is used to fix itself into the band attachment hole 105*a*.

Figure 33:
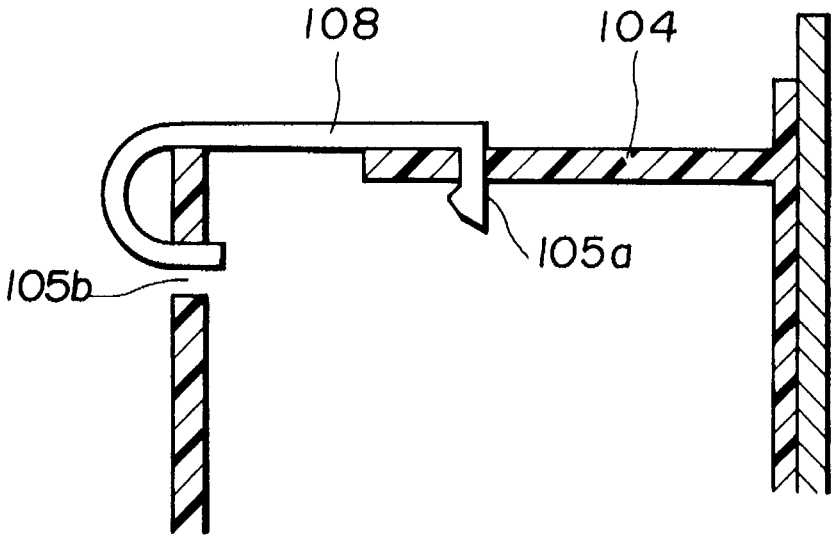

As shown in FIG. 33, when the lamp unit 101 is installed in the lamp-unit-supporting-element 104, the fixing band 108 is attached to the lamp-unit-supporting-element 104 so as to adjust the position of the lamp unit 101 and also to avoid departing of the lamp unit 101. In this attachment, the J-shaped end portion of the fixing band 108 is fit into the band attachment hole 105*b* formed on the back side at the upper position, then the end portion bent at a right angle is fit into the band attachment hole 105*a* on the upper side.

Figure 34:
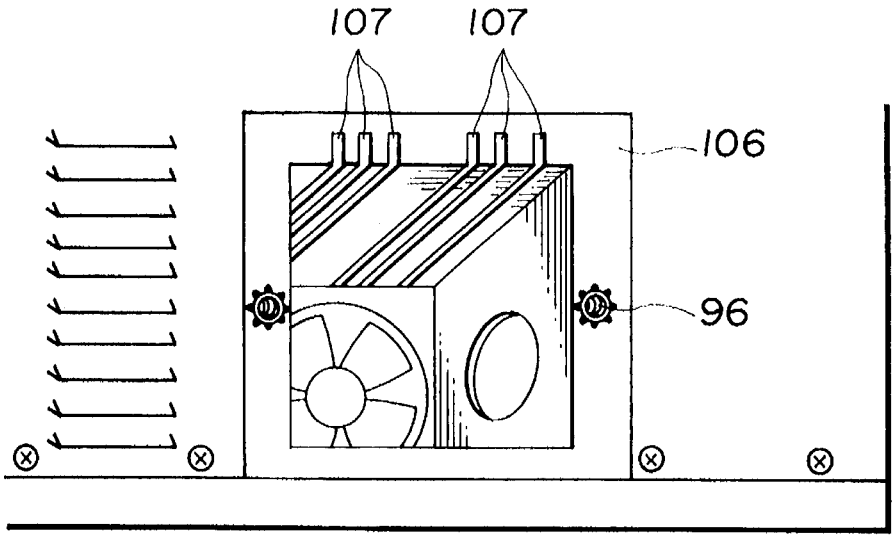

FIG. 34 shows the lamp house in a state where the lamp-unit-supporting-element 104 is removed out. Corresponding to the number of the electrodes 103*a* and 103*b* of the heat sinks 102, there are provided a plurality of grooves 107 on the inner wall of the upper side of the lamp house 106, wherein the grooves 107 are used as paths for these electrodes 103*a* and 103*b*. There is also provided a socket on the back portion of the grooves 107. The widths of these grooves 107 are designed to be less than 3 mm. Other structures are the same as those as in the case of the fourth embodiment, so the explanation will not be repeated here for the same portions.

The portions different from those of the fourth embodiment are as follows:

Because plural electrodes are provides for both the anode electrodes 103*a* and the cathode electrodes 103*b*, the current capacity is increased. Therefore, depending on this increase in the current capacity, the length of the electrodes can be shorter in the horizontal direction. That is, the pulling-out length of the lamp-unit-supporting-element 104 can be reduced, satisfying the creepage distance of 4 mm required for reinforced insulation prescribed in the safety standard (for example, IEC601-1). Therefore, the distance between the end face of the lamp-exchanging door 81 and the lamp unit 101 installed in the lamp-unit-supporting-element 104 can be also reduced to a distance less than 12 mm which is the distance required for the case of the fourth embodiment.

A light source device in accordance with a sixth embodiment of the present invention can be also obtained from the fourth embodiment by modifying the structure of the electrodes of the heat sinks in the lamp unit.

Figure 35:
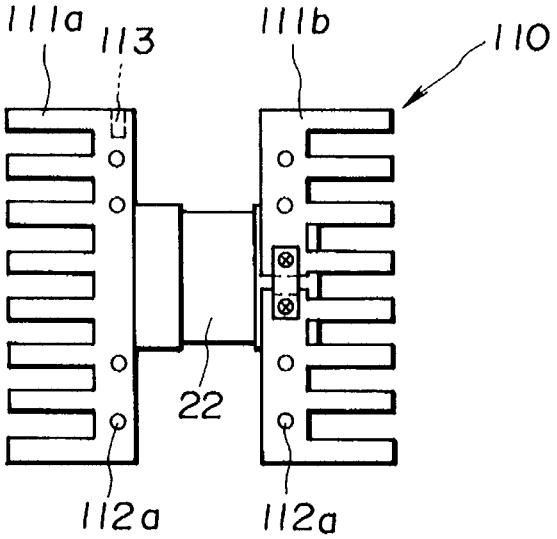

As shown in FIG. 35, a lamp unit 110 comprises a xenon lamp 22, an anode heat sink 111*a*, and a cathode heat sink 111*b*. In the present embodiment, rod-shape electrodes are provided on the side portion. The heat sink 111*a* has a plurality (four in this specific embodiment) of anode electrodes 112*a* arranged in a line and the heat sink 111*b* has a plurality (three in this specific embodiment) of cathode electrodes 112*b* arranged in a line. The diameters of electrodes 112*a* and 112*b* are set to less than 3 mm.

Figure 36:
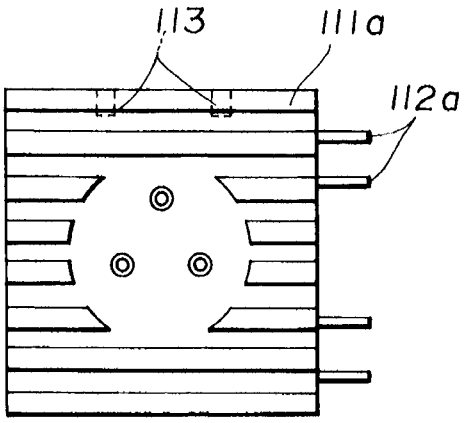
Figure 37:
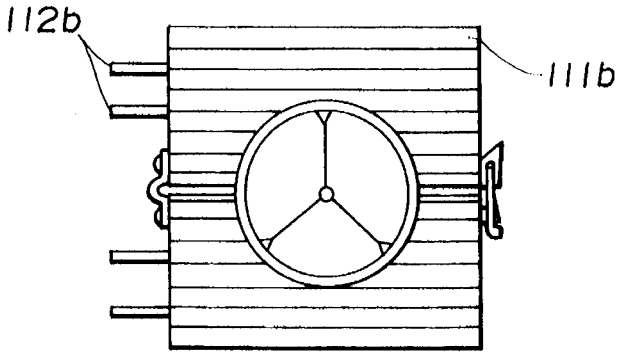

As shown in FIGS. 36 and 37, there are provided positioning holes 113 (for example two position-adjustment holes on the heat sink 111*a*) on the upper face (become the bottom face in the situation where the lamp unit 110 is installed into the lamp-unit-supporting-element) of the heat sink 111*a* and heat sink 111*b*. Other portion are the same as those in the case of the fourth embodiment, so explanation will not be repeated here for the same portions.

Figure 38:
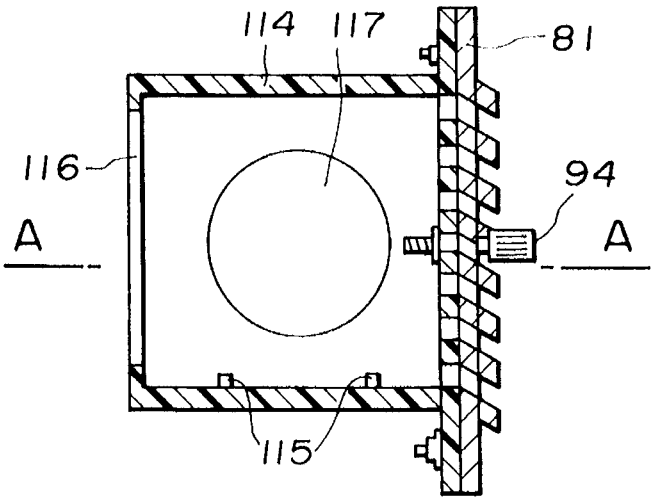

As shown in FIG. 38, the lamp-unit-supporting-element 114 for supporting the lamp unit 110 is made of insulating material in the form of a box-like shape, which has holes on a side and the back side, through the side hole the lamp unit 110 being inserted into the inside to be held there.

Figure 39:
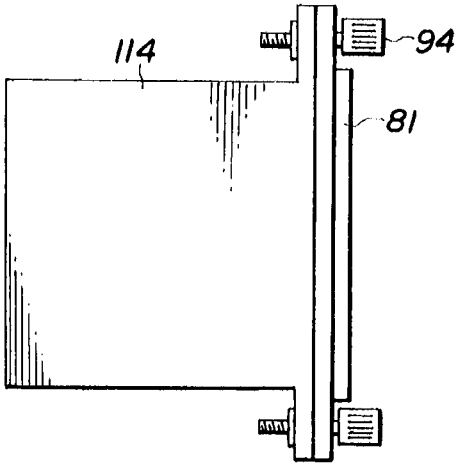
Figure 40:
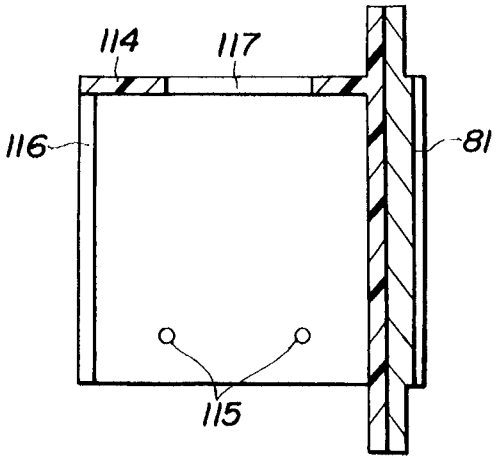

On the base of the lamp-unit-supporting-element 114, as shown in FIGS. 39 and 40, there are provided positioning projections 115 which are to be fit in positioning holes 113 formed on the heat sinks 111 for adjusting the position of the lamp unit 110. A hole 116 is provided on the back side so that electrodes 112*a* and 112*b* of the lamp unit 110 can project out through the hole 116. A lamp-exchanging door 81 is attached to the front face of the lamp-unit-supporting-element 114.

On a side of the lamp-unit-supporting-element 114, there is provided a hole 117 through which light emitted from the xenon lamp 22 passes.

Figure 41:
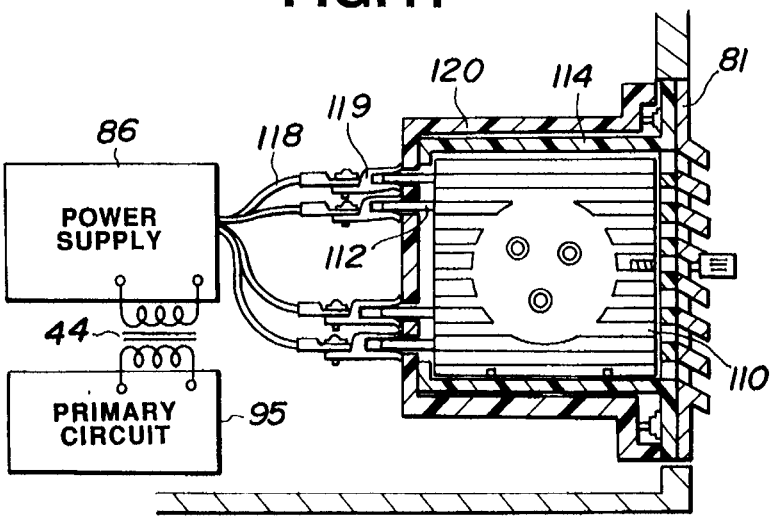
Figure 42:
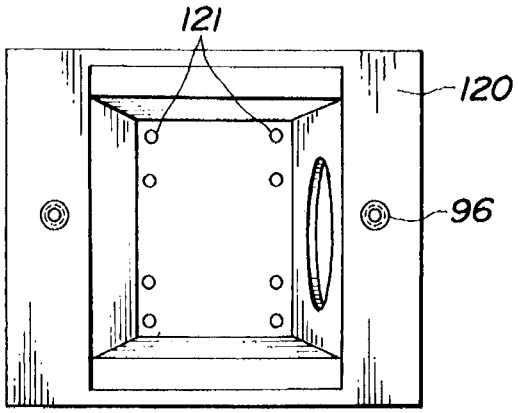

As shown in FIG. 41, the lamp-exchanging door 81 and the lamp-unit-supporting-element 114 with the lamp unit 110 installed in it can be further installed in the lamp house 120. On the back side of the lamp house 120, there are provided sockets 119 in which electrodes 112 of the heat sinks 111 are fit. These sockets 119 are connected via electric wires 118 to an electric power supply 86 which is further connected to a primary circuit 95 via a transformer 44. Socket holes 121 are formed in front of the sockets 119 arranged on the back side of the lamp house 120 so that the electrodes 112 of the heat sinks 111 pass through the socket holes 121 and further fit into the sockets 119, as shown in FIG. 42. On the right and left sides of the front hole of the lamp house 120, there are provided insertion nuts 96 in which the fixing screws 94 are fit.

When the lamp-unit-supporting-element 114 and the lamp-exchanging door 81 are inserted through the front hole of the lamp house 120, the electrodes 112 of the heat sinks 111 are inserted through the socket holes 121 and further fit into the sockets 119, thus electrical connection is achieved between the lamp unit 110 and the sockets 119.

The diameters of the socket holes 121 are designed to be less than 3 mm. After the lamp-unit-supporting-element 114 with the lamp-exchanging door 81 attached to it in the integral form is installed in the lamp house 120, it is secured to the lamp house 120 by fastening fixing screws 94 to the insertion nuts 96.

Now, the functions of the present embodiment will be described.

As in the fourth embodiment, the lamp unit is assembled by mounting the xenon lamp 22 on the heat sinks 111*a* and 111*b*. Then, the assembled lamp unit 110 is inserted into the lamp-unit-supporting-element 114 from its back side, and it is positioned by fitting the positioning projections 115 in the positioning holes 113.

Then, the lamp-unit-supporting-element 114 is inserted into the lamp house 120 through the front hole of the lamp house 120. While the lamp-exchanging door 81 is pressed to the front face of the lamp house 120, the fixing screws 94 are fastened to the insertion nuts 96 so as to secure the lamp-exchanging door 81 to the lamp house 120. Thus, the lamp unit mounted in the lamp-unit-supporting-element 114 is installed into the deep region of the lamp house 120.

At this stage, the anode electrode 112*a* and the cathode electrode 112*b* are fit into the sockets 119 via the sockets holes 121, and these electrodes are electrically connected to the sockets. Thus, the electric power supply 86 is connected to the xenon lamp 22, and electric power is supplied to the lamp 22. As in the fourth embodiment, the basic insulation is used for the transformer 44 which isolates the electric power supply 86 from the primary circuit 95, and the creepage distance between the primary and secondary windings is larger than 3 mm.

In this situation, the lamp unit 110 is electrically isolated from the outer case by the lamp house 120 and the lamp-unit-supporting-element 114. The electrical insulation at the cooling air exhausting holes is achieved with the creepage distance corresponding to the thickness of the lamp-unit-supporting-element 83, as in the case of the fourth embodiment. The widths of the cooling air exhausting holes are designed to be less than 3 mm so as to avoid entering of test pins prescribed in the safety standard such as IEC.

On the other hand, when the lamp is exchanged, the fixing screws 94 are loosened then the lamp-exchanging door 81 and the lamp-unit-supporting-element 114 are removed out from the lamp house 120. As a result of this, electrodes 112*a* and 112*b* of the lamp unit 110 are separated from the sockets 119, thus the electric power supply to the lamp unit 110 is cut off. If it is assumed, for example, that the anode electrode 112*a* and the cathode electrode 112*b* have diameters of 3 mm and widths of 6 mm, then in order to make the distance from the socket 119 to the anode electrode 112*a* and the cathode electrode 112*b* larger than 4 mm, which is the creepage distance for reinforced insulation defined in the IEC601-1, it is necessary to dispose the lamp-exchanging door 81 at a position 7 mm or larger away from the lamp house 120, where it is further assumed that the thicknesses of the lamp-unit-supporting-element 114 and the lamp house 120 are 1.5 mm.s The size of the lamp-exchanging door 81 is designed to be sufficiently large, so as to ensure that the test pin and the test finger prescribed in IEC610-1 cannot get into contact with the lamp unit 110 even in the situation where the lamp-unit-supporting-element 114 is pulled out to the position at which the distance from the sockets 119 to the anode electrode 112*a* and the cathode electrode 112*b* become 8 mm or larger than that. As a result of such a design, the size of the transformer 44 can be reduced even to such a size which does not meet the basic insulation defined by the safety standard.

When the lamp unit 110 is completely removed from the lamp house 120, the situation will be as shown in FIG. 40. As can be seen from this figure, the diameters of the socket holes 121 through which the electrodes 112*a* and 112*b* are inserted are designed to be less than 3 mm, thus the holes which may cause a touch to electrically active regions have widths less than 3 mm.

As described above, the lamp-exchanging door and the lamp unit are assembled in the integral form so that when the lamp-exchanging door is removed for a lamp-exchanging job, the electrodes of the lamp unit are automatically removed from the electrical contacts connecting to the electric power supply corresponding to the removal of the lamp-exchanging door. Thus, as in the case of the fourth embodiment, simplification and miniaturization as well as safety are achieved in the device.

Figure 43:
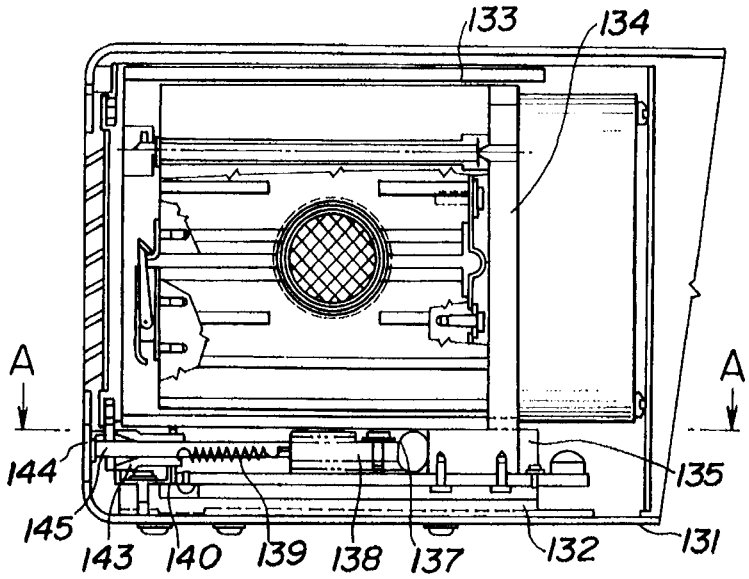
Figure 44:
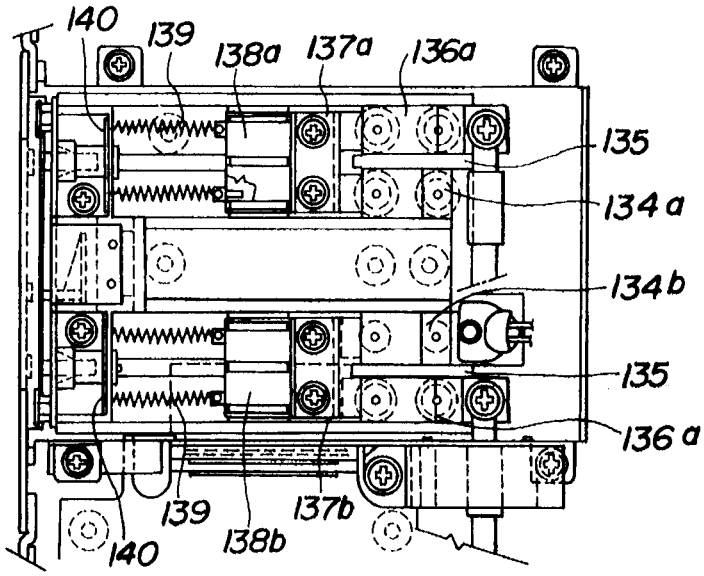
Figure 45:
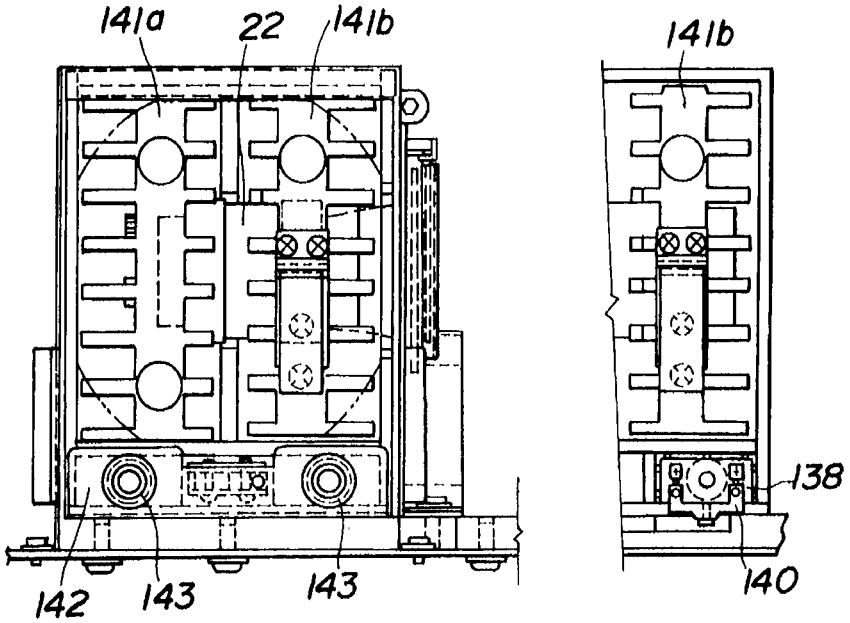

Now, the seventh embodiment of the present invention will be described. As shown in FIGS. 43–45, in a light source device of this embodiment, a lamp house is secured with screws to an insulating base plate 132 of a case 131 at its lower end portion, and a lamp house 133 made of a insulating material is secured to the base plate 132 at its upper end position. Metal poles 134 having L-shape, which will be described later in more detail, are fixed to the lamp house 133 at its lower portion.

Figure 46:
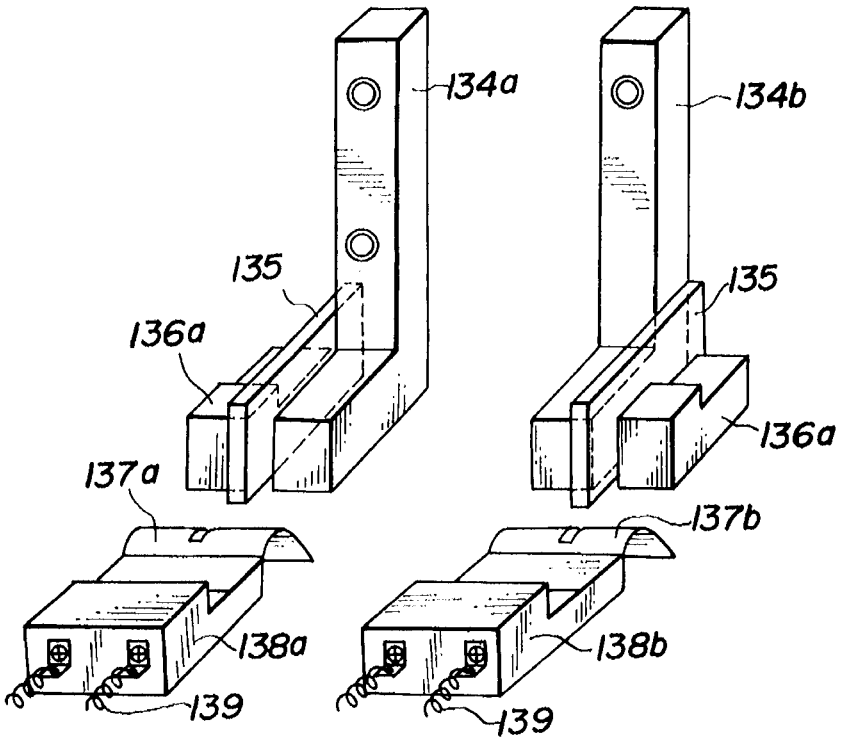

As shown in FIG. 46, a tapped hole is formed on each metal pole 134 at its upper portion, which is used for securing a heat sink. The lamp house 133 has insulating plates 135 which have a projecting shape and are in contact with the side face of each metal pole 134. At an opposite position to each metal pole 134 via the insulating plate 135, an electrode block 136 is fixed for each metal pole. These electrode blocks 136 are connected to a high voltage generator which is further connected to an electric power supply. In front of these metal poles 134 and electrode blocks 136, there are provided electrodes 137 made of an elastic material which get in contact with these metal poles 134 and electrode blocks 136 so as to make electrical connection between these metal poles 134 and electrode blocks 136.

The electrodes 137 are secured to sliding elements 138 made of insulating material. Tension springs are connected to the end portions of the sliding elements 138. The other ends of these tension springs are fixed with fixing elements 140 to the inside of the lamp house.

Inside the lamp house 133, as shown in FIG. 44, there are provided an electrode block 136*a*, an electrode block 136*b*, a metal pole 134*a*, a metal pole 134*b*, an electrode 137*a*, an electrode 137*b*, a sliding element 138*a*, and a sliding element 138*b*, each of these being arranged at symmetric positions.

Figure 47:
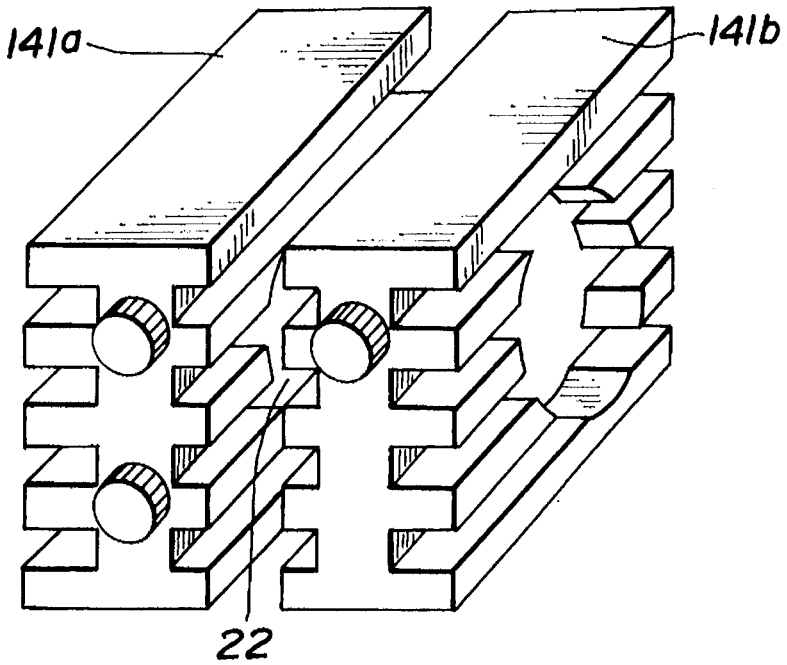

As shown in FIG. 47, a heat sink 141*a* is attached to the anode side of xenon lamp 22, and a heat sink 141*b* is attached to the cathode side of the xenon lamp 22 in such a way that both heat sinks 141*a* and 141*b* can be removed as required. The heat sinks 141*a* and 141*b* are secured with screws to the metal poles 134 at upper end portions, respectively, in such a way that these heat sinks 141*a* and 141*b* can be removed as required.

In this way, the xenon lamp 22 is electrically connected to the metal poles 134 via the heat sinks 141.

Figure 48:
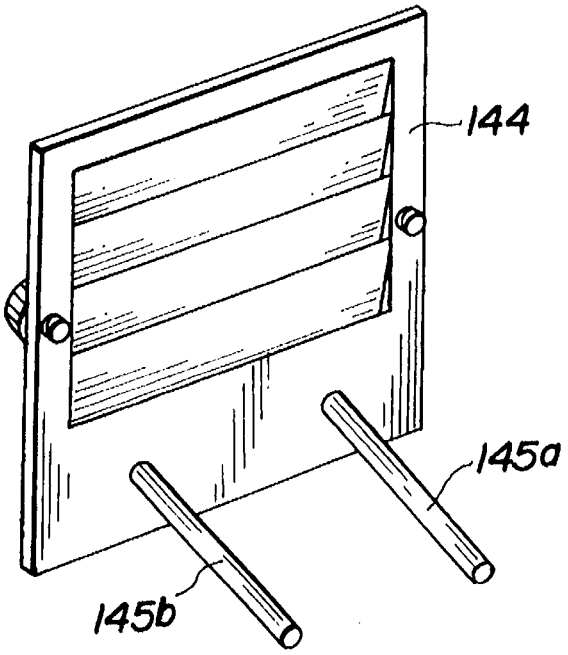

A lamp-exchanging door 144 is attached to the side hole portion of the lamp house 133 on the side of the case 131 in such a way that the lamp-exchanging door 144 can be removed as required. As shown in FIG. 48, projecting bars 145*a* and 145*b* are provided on the inner wall of the lamp-exchanging door 144 at its lower positions.

Furthermore, the lamp house 133 has guide cylinders 143 into which the projecting bars 145 are inserted, wherein these guide cylinders 143 are supported with guide-cylinder-supporting-elements 142 in such a manner that the guide cylinders 143 can move as required.

FIG. 45(*b*) shows a state where the guide-cylinder-supporting-elements 142 are removed out. When the lamp-exchanging door 144 is attached to the lamp house 133, the projecting bars 145*a* and 145*b* are inserted into the guide cylinders 143 and these projecting bars 145*a* and 145*b* are introduced to the end portions of the sliding elements 138. Thus, the sliding element 138*a* is pushed toward the metal pole 134*a* and the electrode block 136*a*, on the other hand the sliding element 138*b* is pushed toward the metal pole 134*b* and the electrode block 136*b*.

Now, the functions of the present embodiment will be described.

When the lamp-exchanging door 144 is attached to the side of the case 131, two projecting bars 145*a* and 145*b* fixed to the lamp-exchanging door 144 are introduced via the guide cylinders 143 until the end portions of the sliding elements 138. As a result of this, the projecting bar 145*a* and the projecting bar 145*b* push in the sliding element 138*a* and the sliding element 138*b*, respectively. When these sliding elements 138 are pushed in, the electrode 137*a* fixed to the sliding element 138*a* and the electrode 137*b* fixed to the sliding element 138*b* get in contact with the electrode block 136*a* and the electrode block 136*b*, respectively, and also with the metal pole 134*a* and the metal pole 134*b* respectively so that the electrode blocks 136 are electrically connected to the metal poles 134, thus electric power is supplied to the xenon lamp from the electric power supply.

On the other hand, when the lamp is exchanged, the lamp-exchanging door 144 is removed from the case 131, then, as a result of this, the projecting bars 145*a* and 145*b* of the lamp-exchanging door 144 are pulled out along the guide cylinders 143.

Then, the sliding elements 138*a* and 138*b* are released from the pressure of the projecting bars 145 and they are pulled back by the tension springs 139. In this way, the electrode 137*a* and the electrode 137*b* which are fixed to the sliding element 138*a* and the sliding element 138*b*, respectively, get far enough away from the electrode blocks 136 and the metal poles 134, thus electrical connection is broken between the electrode blocks 136 and the metal poles 134, hence electric power supplied to the Xenon lamp 22 is cut off.

Thus, after the lamp-exchanging door 144 is removed off, the heat sinks 141*a* and 141*b* are exposed and they are now ready for being removed out. In this situation, no electric power is applied to the heat sinks 141*a* and 141*b*, and furthermore, the electrode blocks 136 are isolated from the metal poles 134 with a distance larger than the required insulation distance, hence there is no possibility of an electric shock.

As described above, the present embodiment, as well as the first embodiment, provides simple structure which realizes the perfect electrical isolation between the electric power supply and the heat sinks during the lamp-exchanging job. Thus, there is no possibility of an electric shock. In addition to such safety, the reduction of the transformer size can be also achieved. Moreover, no necessity of interlock switches results in further reduction in the size of the device.

Figure 49:
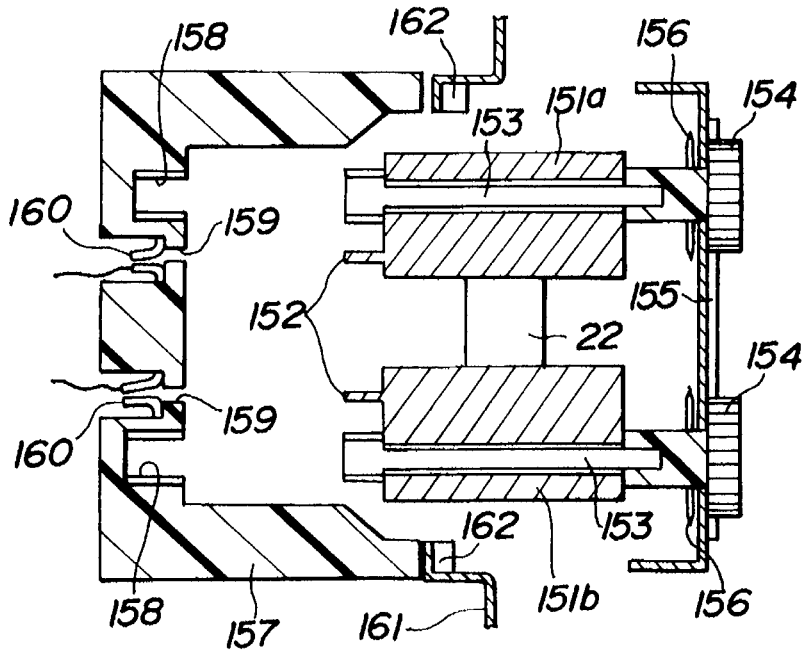
FIG. 49 is a sectional top view showing the structure of a lamp house of a light source device in accordance with a eighth embodiment of the present invention.

Now, an eighth embodiment in accordance with the present invention will be described. As shown in FIG. 49, a light source device of the eighth embodiment has a lamp house 157 for installing a lamp unit composed of a heat sink 151*a*, a heat sink 151*b*, and a xenon lamp.

Each of the heat sinks 151*a* and 151*b* has a projecting electrode 152 for supplying electrical power to the xenon lamp 22, wherein the diameter or width of the projecting electrode 152 is less than 3 mm. The heat sink 151*a* and the heat sink 151*b* are fixed with refractory screws 153 penetrating these heat sinks. The end portions of these screws 153 are fit in knobs 154 made of refractory and insulating material so that they are secured.

In front of the heat sink 151*a* and the heat sink 151*b*, there is provided a lamp-exchanging door 155 made of metal. In conjunction with screws 153, the knobs 154 passing through the lamp-exchanging door 155 fix the heat sinks 151*a* and 151*b* to the lamp-exchanging door 155, thus the heat sinks and the lamp-exchanging door 155 are assembled in the integral form. The knobs 154 and screws 153 are supported with E-rings 156 or the like so that they can freely rotate with respect to the lamp-exchanging door 155. All the periphery regions of the lamp-exchanging door 155 are bent toward the lamp house 157 in such a manner that the width of any bent portion is larger at least by 4 mm than the length of the electrodes 152 and at the same time any bent portion is at least 4 mm away from the heat sinks 151. The lamp-exchanging door 155 also has slit-shape ducts through which cooling air passes.

The lamp house 157 is made of a refractory and insulating material, and tapped holes 158 are provided on the back side in the lamp house 157 so that the screws 153 are fit into these tapped holes. Furthermore, socket holes 159 are also provided so that the electrodes 152 are fit via these socket holes 159 to sockets 160 arranged behind the socket holes 159, wherein the sockets 160 are connected to an electric power supply for supplying electric power to the lamp. The sockets holes 159 are designed such that their diameters or widths are less than 3 mm. That is, when the heat sink 151*a* and the heat sink 151*b* are inserted and fixed to the lamp house by fastening the screws 158 to the tapped holes 158, the electrodes 152 of the heat sinks 151*a* and 151*b* are fit via the socket holes 159 to the sockets 160, thus the heat sinks 151 are electrically connected to the electric power supply. The lamp house 157 is mounted to a metal case 161. Conductive rubber is provided on the regions of the case 161 which are to be in contact with the lamp-exchanging door 155 so as to ensure that when the lamp-exchanging door 155 is mounted to the case 161 the lamp-exchanging door 155 can be electrically connected to the case 161 via the conductive rubber 162, thus electromagnetic shielding is achieved.

When the lamp is exchanged, first the knobs 154 are turned to release the screws 153 from the tapped holes of the lamp house 157, then the lamp unit including the heat sink 151*a*, the heat sink 151*b*, and the xenon lamp 22 which is attached to the lamp-exchanging door 155 in the integral form is removed from the lamp house 157. At this stage, because any bent portion of the periphery of the lamp-exchanging door 155 has the width larger than the electrodes 152 at least by 4 mm, electrically active heat sinks 151 cannot be touched until the electrodes 152 get away from the sockets 160 by larger than the insulation distance of 4 mm and thus electrical power supply to the heat sinks 151 is cut off.

In a state where the lamp unit is removed out, it is very hard to touch the sockets 160, because the socket holes 159 of the lamp house 158 have the diameters or widths less than 3 mm. Thus, it is possible to exchange the lamp with no possibility of an electric shock.

As described above, the present embodiment, as well as the first embodiment, provides simple structure which realizes the perfect electrical isolation between the electric power supply and the heat sinks during the lamp-exchanging job. Thus, there is no possibility of an electric shock. In addition to such safety, the reduction of the transformer size can be also achieved. Moreover, no necessity of interlock switches results in further reduction in the size of the device.

Figure 50:
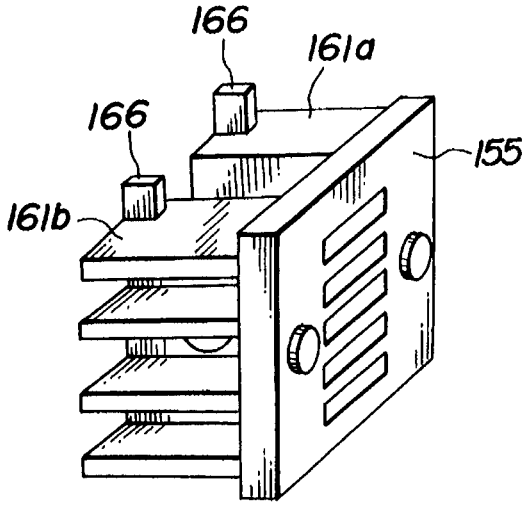

A ninth embodiment of the present invention will be described next. As shown in FIG. 50, a light source device in accordance with the ninth embodiment of the present invention can be obtained from the eighth embodiment by modifying the structure of heat sinks in a lamp unit, and also sockets of a lamp house.

As shown in FIG. 50, a heat sink 161*a* and a heat sink 161*b* are mounted to the lamp-exchanging door 155 as in the eighth embodiment. At the upper portion of each heat sink 161, there is provided a projecting electrode 162 whose width is less than 3 mm.

Figure 51:
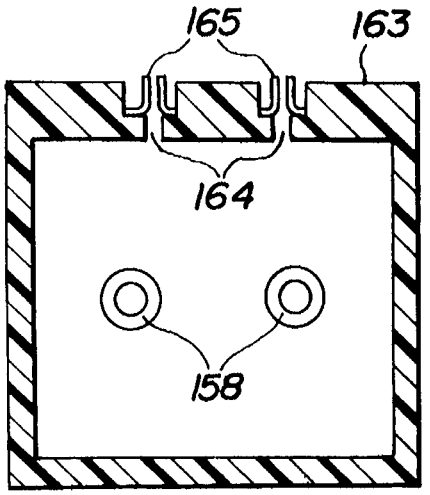

As shown in FIG. 51, the lamp house 163 has slits 164 whose width is less than 3 mm on its upper side. Above the slits 164, there are provided sockets 165 to be connected to the electric power source for supplying power to the lamp. The other portions are the same as those of the eighth embodiment, so explanation will not be repeated here for the same portions.

Incidentally, the electrodes 162 of the heat sinks 161 and the sockets to which these electrodes 162 are fit may be arranged on the side or the bottom face.

The electrodes of the heat sinks and the sockets to which these electrodes are fit may be disposed on the upper side as shown above with the same functions and the same effectiveness as those in the eighth embodiment.

Figure 52:
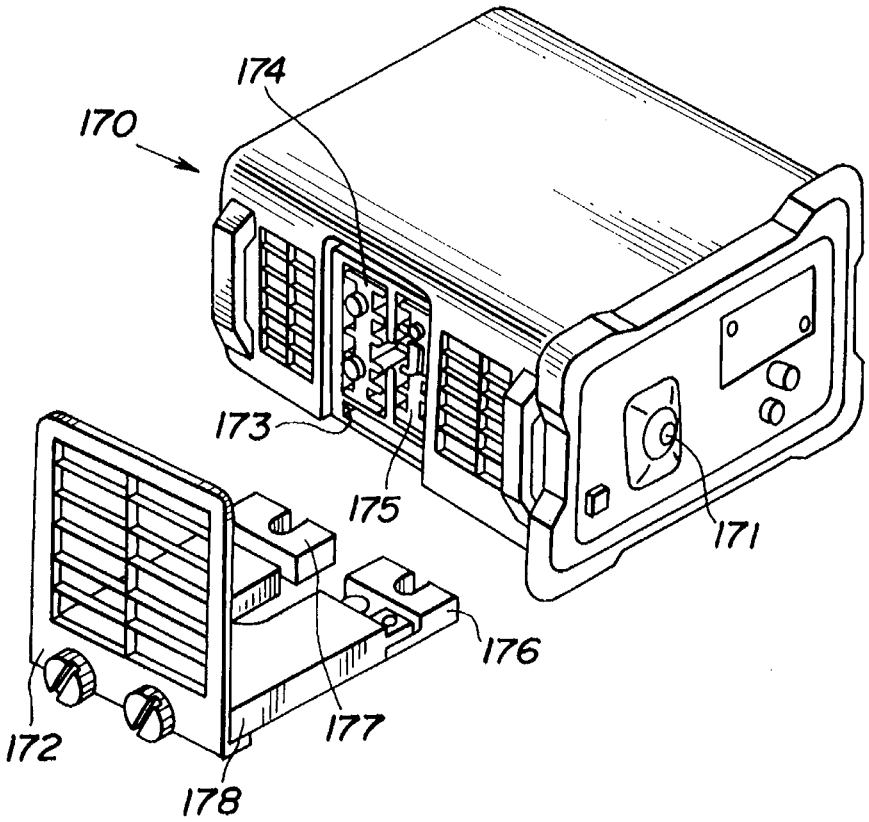

Now, a tenth embodiment of the present invention will be described. As shown in FIG. 52, in a light sources device 170 in accordance with the tenth embodiment, when a lamp such as a xenon lamp mounted in the device is replaced, first, a lamp-exchanging door 172 is removed then the lamp is replaced.

Figure 53:
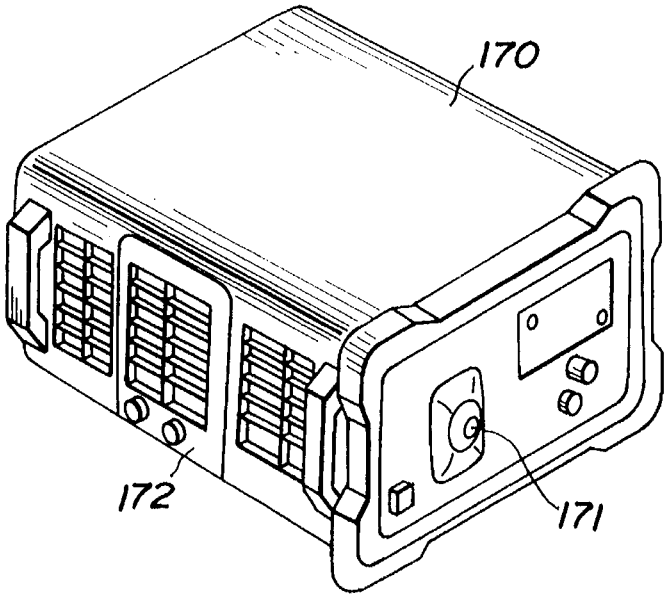

That is, as shown in FIG. 53, the lamp-exchanging door 172 can be removed from the light source device 170 by releasing the knobs 195.

As can be seen from FIG. 52 which shows the situation where the lamp-exchanging door 172 is completely removed from the light source device 170, the lamp-exchanging door 172 has insulating elements 178 made of, for example, resin, whose end portion is cut out into an approximately U-shape, wherein at each of two ends of this U-shape a cathode side contact 176 and an anode side contact 177 acting as electrical contacts are provided.

Figure 54:
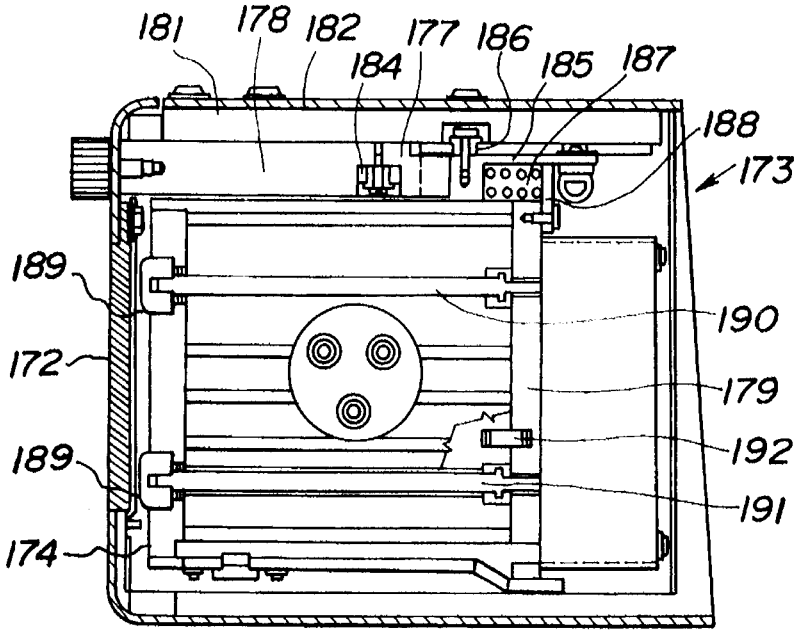

As shown in FIG. 54, the light source device 170 also has a base plate 181 made of insulating material such as resin to which an anode heat sink 174 and a conductive metal pole 179 for fixing this anode heat sink 174 are secured.

At the end portions of the insulating elements 178 of the lamp-exchanging door 172, recesses and loose holes are formed, furthermore, the anode side contact 177 and the cathode side contact 176 are fixed with screws via collars 184 whose heights are larger than the depths of these recesses approximately by 0.1 mm in such a manner that the cathode side contact 176 and the anode side contact 177 can make any required movement.

On the anode heat sink 174 to be fixed the metal pole 179, there is provided a blind hole for press fitting of a taper pin 192 which acts as a guide to introduce the heat sink 174 to a required position, and there is also provided a through-hole in which a fixing shaft 190 used for positioning and also for fixing is put wherein the clearance of less than 0.1 mm is provided, and furthermore there is another through-hole used for putting in a fixing shaft 191 wherein a rather large clearance is provided. Each fixing shaft 190 and 191 used for fixing the heat sink 174 via the through-holes to the metal pole 179 has a head provided with a knob made of high-temperature resin wherein the knob being fixed to the head in the integral form, and has an end portion whose outside is screwed.

When the heat sink 174 is fixed to the metal pole 179, first, the taper pin 192 being press-fit in the heat sink 174 is inserted in the guide of the metal pole 179, then the shaft 191 is loosely fastened, finally the shaft 190 then the shaft 191 are firmly fastened at proper position.

Figure 55:
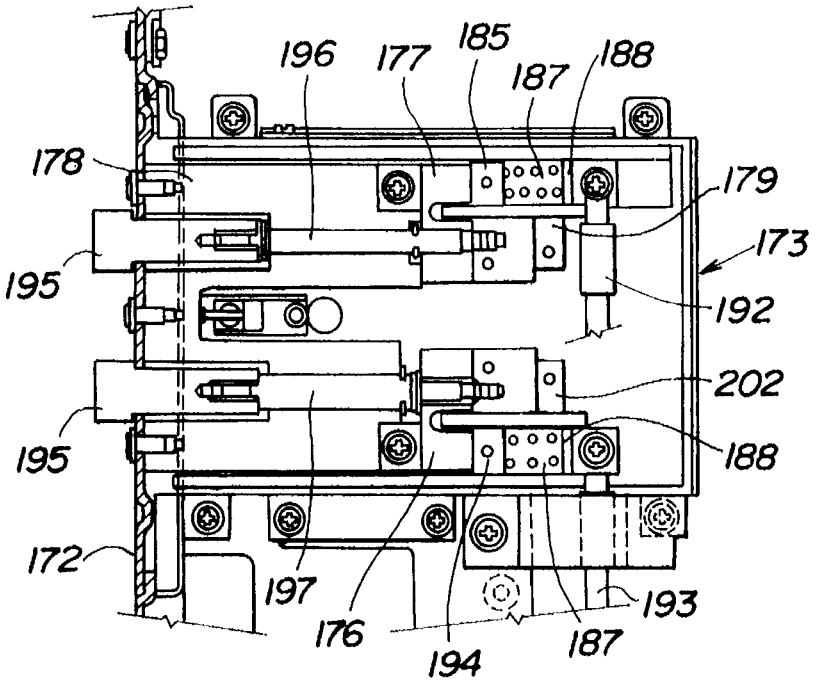

Then, as shown in FIG. 55, a lamp house 173 molded with high-temperature resin is secured to the base plate 181 with screws. At this stage, the anode electrode 185 and the cathode electrode 194 are put in the through-holes of the lamp house 173 via the collar 186 in such a manner that the anode electrode 185 and the cathode electrode 194 can make required movement, wherein the anode electrode 185 and the cathode electrode 194 are always pushed toward the lamp-exchanging door by means of the compression springs 187 which are arranged between the spring clamp elements 188 fixed to the lamp house 173 and the anode electrode 185 and the cathode electrode 194.

On the other hand, the cathode heat sink divided into the upper and lower portions 175*a* and 175*b* is fixed to the conductive metal pole in such a manner that the shaft 190 fixed with screws to the metal pole 202 is disposed through the loose hole having rather large clearance so that the cathode heat sink can move back and forth and in the right and left direction.

The lamp 205 is fixed to the anode heat sink 174 at a proper position with three screws and at the same time the lamp 205 is disposed between the upper and lower cathode heat sinks 175*a* and 175*b*. The cathode heat sinks 175*a* and 175*b* are connected to each other via a flat spring 201 with screws on the side opposite the lamp-exchanging door and are fastened with a clamping lock on the side of the lamp-exchanging door.

As shown in FIG. 55, the anode electrode 185 and the cathode electrode 194 are connected respectively to an anode electric wire 192 and a cathode electric wire 193, both wires being extending from a starter for generating a high voltage required for turning on the lamp 205.

The end portion of the shaft 196 is threaded and the knob 195 is fixed to the head portion of the shaft 196 in the integral form so that the shaft 196 can be used for fixing the lamp-exchanging door.

Now, the functions of the light source device 170 in accordance with the present embodiment will be described next.

To attach the lamp-exchanging door 172 to the light source device 170, first, the anode side contact 177 and the cathode side contact 176 disposed on the end portion of the insulating elements 178 fixed to the lamp-exchanging door 172 are inserted into the lamp house 173 arranged at the proper position until they Peach the required positions. Then, the lamp-exchanging door 172 is fixed by rotating the knobs 195 of the lamp-exchanging door 172 so as to fasten the screws formed on the end portions of the shafts 196 to the tapped holes formed on the metal pole 179 and the metal pole 202.

When the lamp-exchanging door 172 is completely fixed to the light source device 170 in such a way described above, the anode side contact 177 and the cathode side contact 176 are also disposed at the required positions. As a result of this, an electric power path is formed for the anode side via the anode electric wire 192, the anode electrode 185, the anode side contact 177, the metal pole 179, and the anode heat sink 174, similarly an electric power path for the cathode side is formed via the cathode electric wire 193, the cathode electrode 194, the cathode side contact 176, the metal pole 202, and the upper/lower cathode heat sinks 175, thus electric power is supplied to the xenon lamp.

On the other hand, if the lamp-exchanging door 172 is removed out from the light source device 170 for exchanging the lamp 205, then the anode side contact 177 and the cathode side contact 176 are separated from the anode side power path and the cathode side power path, respectively, thus electric circuit for supplying power to the lamp 205 become open and electric power supply to the heat sinks 179 and 202 holding the lamp 205 is cut off. Thus, it is possible to exchange the lamp with no possibility of an electric shock. In addition to such safety, the reduction of the transformer size can be also achieved. Moreover, no necessity of interlock switches results in further reduction in the size of the device.

The anode side contact 177 and the cathode side contact 176 formed on the end portions of the insulating elements 178 in contact with the anode electrode 185 and the cathode electrode 194 are installed in a movable manner, moreover the anode electrode 185 and the cathode electrode 194 are always pushed with the compression spring 187 toward the lamp-exchanging door, thus reliable electric connection can be achieved even if there are some variations in the size of the anode side contact 177 and the cathode side contact 176.

Furthermore, because outer lamp-exchanging door is fixed with screws, it is possible to perfectly avoid removal of the electric contacts due to vibrations or the like.

Moreover, it is possible to fix the lamp-exchanging door 172 to the lamp house 173 firmly by successively disposing a washer, a spring washer, and a washer between the knobs 195 and the insulating elements 178.

Figure 56:
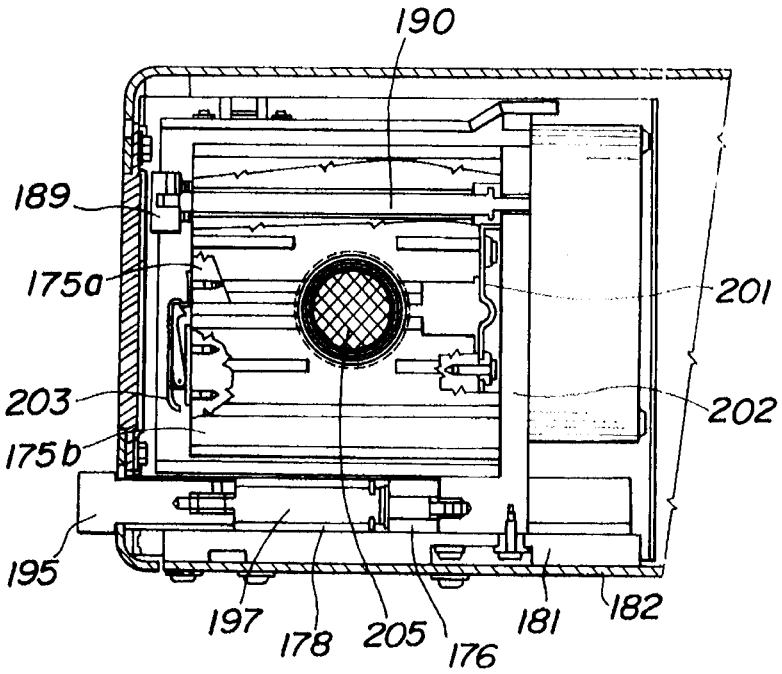

In the present embodiment, cathode heat sinks **175*a* and 175*b* are fixed with the clamping lock 203 for holding the lamp as shown in FIG. 56, however it is possible to attach and fix the lamp-exchanging door 172 even if it was forgotten to fasten the clamping lock 203** during the lamp-exchanging job.

Figure 57:
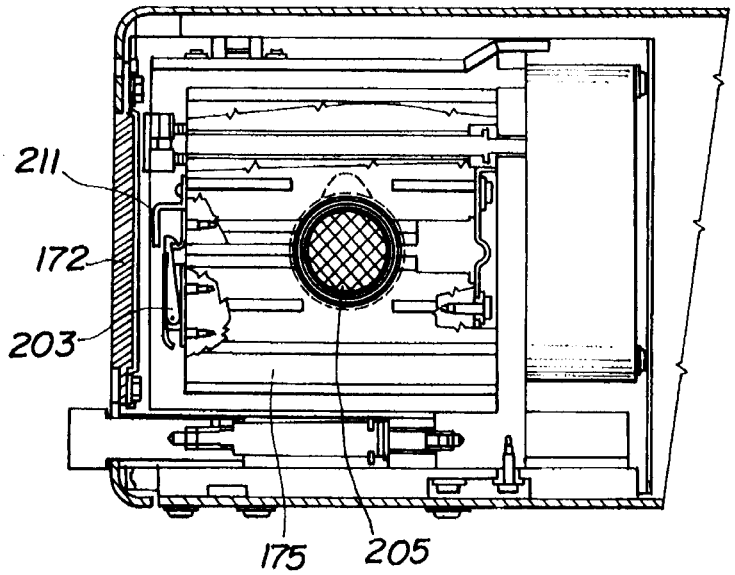
Figure 58:
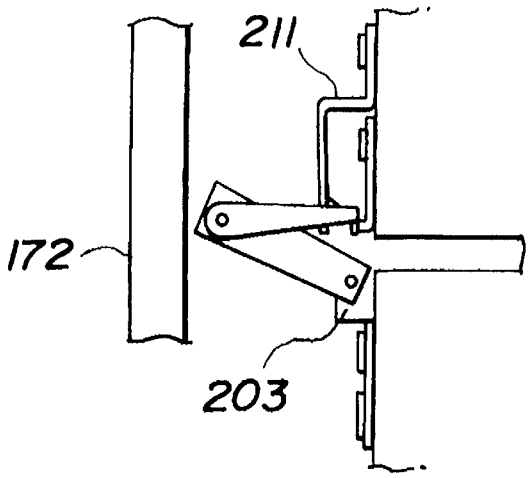

To avoid such a possibility, the present embodiment can be modified in such a way that the clamping lock 203 is covered with a pressing plate 211 as shown in FIGS. 57 and 58. The other portions are the same as those of the previous embodiment.

Because the clamping lock 203 is covered with the pressing plate 211, when it was forgotten to fasten the clamping lock 182 after exchanging the lamp, the pressing plate 211 protects the clamping lock 203 from falling off but it holds the clamping lock 203 at a position perpendicular to the lamp-exchanging door 172 between the cathode heat sinks **175*a* and 175*b*. Thus, it is impossible to attach the lamp-exchanging door 172 to the main part of light source device, because the clamping lock 203 is in contact with the lamp-exchanging door 172 and it prohibits attachment of the lamp-exchanging door 172 when the clamping lock 203** is not fastened. As a result, improvement is achieved in safety and reliability.

Figure 59:
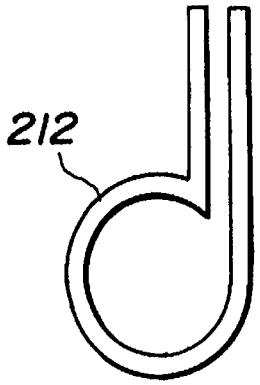
Figure 60:
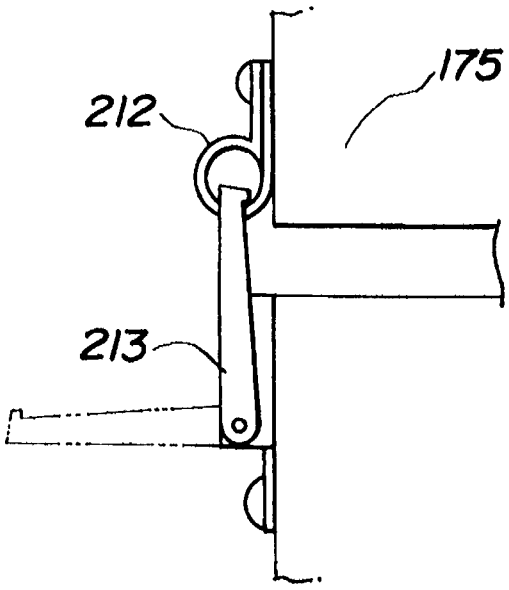

In stead of the above modification, a clamping lock 213 and a pressing plate 212 may be formed as shown in FIG. 59 and 60 so as to obtain the same function and the effectiveness as those of the above modification. In this example, the clamping lock 213 also becomes perpendicular with respect to the lamp-exchanging door when it is not fastened.

Figure 61:
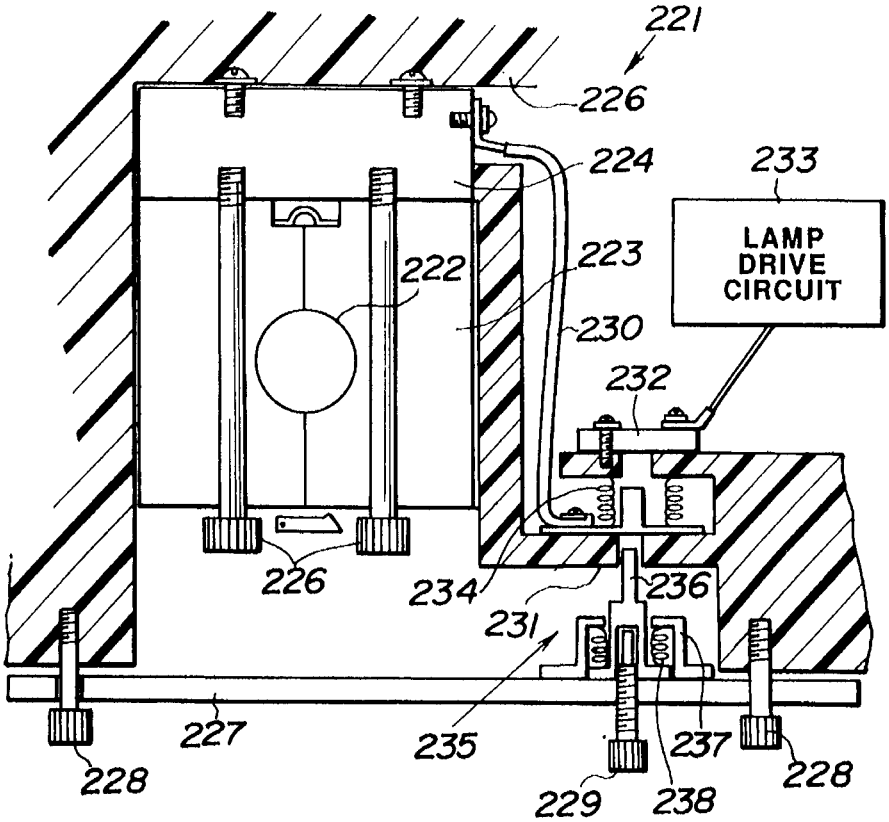

Now, an eleventh embodiment of the present invention will be described. As shown in FIG. 61, in a light source device of the eleventh embodiment, the electrode element of a xenon lamp 222 is held with heat sink 223 for cooling the lamp so that electrical power is supplied via this heat sink 223. The heat sink 223 is fixed to a heat-sink-supporting-elements 224, then they are installed together into a lamp house 225. The heat sink 223 is fixed to the heat-sink-supporting-element 224 with long and thin fixing element 226 whose end portion is threaded, thus the electrode of the xenon lamp 222, the heat sink 223, and the heat-sink-supporting-element 224 are electrically connected.

Figure 62:
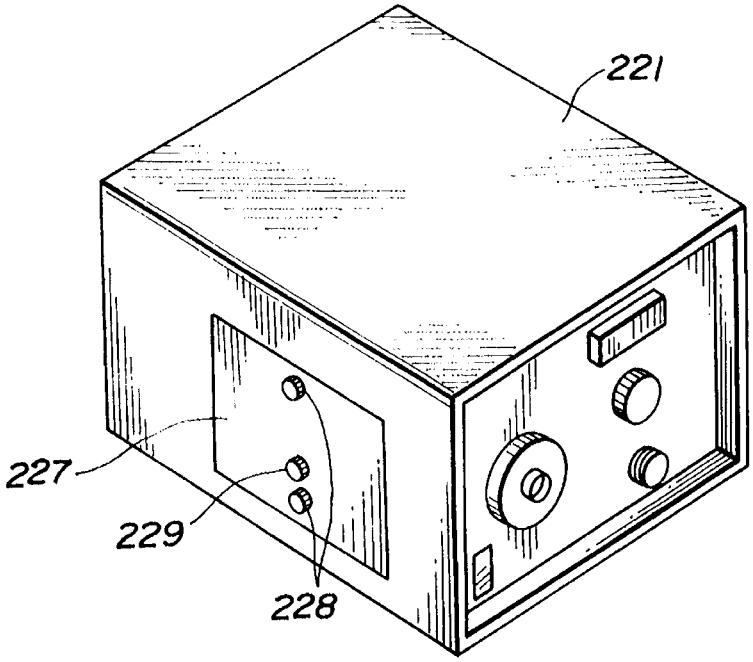

A lamp-exchanging door 227 is attached to the light source device 221 in such a way that the lamp-exchanging door 227 can be easily removed off as required. That is, when the lamp must be exchanged, if the lamp-exchanging door 227 is removed off, then the xenon lamp 222 gets in the situation where it can be exchanged. The lamp-exchanging door 227 may be arranged, for example, on the side of the light source device 231, as shown in FIG. 62. The lamp-exchanging door 227 is attached with fixing screws 228 in such a way that the lamp-exchanging door 227 can be easily removed off as required, and when this lamp-exchanging door 227 is attached, the heat sink 223 is covered so that it is not exposed. The lamp-exchanging door 227 has a knob 229 for turning on/off electrical power to the xenon lamp 222. The end portion of the knob 229 is threaded to be fit in the lamp-exchanging door 227, which will be described in more detail later.

On the side of the lamp house 225, there are provided pressing electrode 231 acting as a lamp side electrode which is electrically connected to the heat-sink-supporting-element 224 via a lead wire 230. This pressing electrode 231 is in contact with electrode plate 232 arranged on the side of the lamp house 225 in such a manner that this electrode plate 232 is opposed to the pressing electrode 231, wherein the electrode plate 232 acts as a power source side electrode connected to a lamp driving circuit 233. Because of such connection between the pressing electrode 231 and the electrode plate 232, the lamp driving circuit 233, the heat-sink-supporting-elements 224, the heat sink 223, and the xenon lamp 222 are electrically connected, thus electric power is supplied to the lamp.

The pressing electrode 231 is held with elastic element 234 like a spring, and it is pressed downward in FIG. 61. In the situation shown in FIG. 61, the elastic element 234 forces the pressing electrode 231 to be isolated from t The pressing electrode 231 is held with elastic element 234 like a spring, and it is pressed downward in FIG. 61. In the situation shown in FIG. 61, the elastic element 234 forces the pressing electrode 231 to be isolated from the electrode plate 232 such that the distance between them is larger than the reinforced insulation distance (2.5 mm).

On the back side of the lamp-exchanging door 227, there are arranged electrode-pressing element 235 which acts as an electrode isolation/connection means for pressing the pressing electrode 231 so as to electrically connect the pressing electrode 231 to the electrode plate 232. The electrode-pressing element 235 has pressing element 236 whose end portion is formed in a shape of strip. The base portion of the pressing element 236 is fit into the end portion of the knob 229 for turning on/off electrical power to the xenon lamp 222. When the lamp-exchanging door 227 is attached and the knob 229 for turning on/off electrical power is rotated to fasten it, then the end portion of the pressing element 236 is inserted into the lamp house 225 through its front hole, and the pressing element 236 pushes in the pressing electrode 231. The pressing element 236 is arranged in a supporting element 237 fixed to the back side of the lamp-exchanging door 227 in such a manner that the pressing element 236 can make required movement and that the end portion of the pressing element 236 projects out via the hole of the supporting element 237. An elastic element 238 is arranged between the collar of the base portion of the pressing element 236 and the inner wall of the upper face of the supporting element 237 in such a manner that the elastic element 238 holds the pressing element 236 and presses it toward the lamp-exchanging door 227. The front hole of the lamp house 225 through which the pressing element 236 is to be inserted is designed to be less than 3 mm in width or in diameter in order to ensure that the test pin shown and the test finger, which are prescribed in IEC610-1, cannot get into contact with inner electrically active regions.

The heat sink 223 and the heat-sink-supporting-elements 224 are divided into two portions so that each divided portion can function corresponding to the cathode electrode and the anode electrode of the xenon lamp 222, respectively, while only one is shown in Figures. Each of these divided portions is electrically isolated from each other. Furthermore, as for the pressing electrode 231 and the electrode plate 232, there are also provided two sets for these elements.

Now, the functions of the present embodiment will be described.

When light intensity of the xenon lamp 222 becomes too small or it dies at the end of the life or due to other reasons, the xenon lamp 222 must be exchanged. In the first step of procedure for exchanging the xenon lamp 222, an operator or a person on the exchanging job loosens the fixing screws 228, then removes off the lamp-exchanging door 227, and further removes the heat sink 223 from the lamp house 225. Then the lamp is exchanged.

When the knob 229 for turning on/off electrical power is loosened for the lamp exchanging job, the pressing element 236 is pressed back toward the lamp-exchanging door 227 by the elastic element 238 of the electrode-pressing element 235. As a result of this, the pressing electrode 231 is forced to move away from the electrode plate 232. Then, the elastic element 234 pushes back the pressing electrode 231 downward in FIG. 61, thus the pressing electrode 231 is separated from the electrode plate 232. When the knob 229 for turning on/off electrical power is completely loosened, the pressing electrode 231 gets away from the electrode plate 232 by a distance larger than 2.5 mm which is required for the reinforced insulation. This insulation distance is maintained by the elastic force of the elastic element 234. Thus, the electrical path between the lamp driving circuit and the heat sink 223 becomes open, and the electric power supplied to the heat sink 223 is cut off.

Then, the fixing screws 228 are loosened to remove the lamp-exchanging door 227. In this situation, because the heat sink 223 is isolated from the lamp driving circuit 233 by means of the separation between the pressing electrode 231 and the electrode plate 232, there is no possibility of an electric shock. Furthermore, because the front hole of the lamp house 225 is less than 3 mm in diameter, it is impossible to touch the inner electrically active regions.

When exchanging of the lamp is completed, the lamp-exchanging door 227 is attached and fixed with the fixing screws 228 in opposite order to the steps described above. Then the knob 229 for turning on/off electrical power is fastened. As a result of this, the pressing element 236 is pushed up so that its end portion is inserted into the lamp house 225 through the front hole of the lamp house 225, thus the pressing electrode 231 is pushed in. Then, the pressing electrode 231 gets into contact with the electrode plate 232 opposing the elastic force of the elastic element 234, thus electrical connection is achieved. In this situation, the lamp driving circuit 233 is connected to the xenon lamp 222 via the electrode plate 232, the pressing electrode 231, the lead wire 230, the heat-sink-supporting-elements 224, and the heat sink 223. Thus, electric power is supplied to the xenon lamp 222.

As for the electrode-pressing element 235, two electrode-pressing element may be arranged corresponding to two pressing electrode 231 and two electrode plate 232, or otherwise, one electrode-pressing element may be arranged in such a manner that one electrode-pressing element presses at the same time both two pressing electrode 231.

As described above, the lamp-exchanging door is provided with the electrode-pressing element so that via the hole of the lamp house having the width or diameter less than 3 mm, the electrode connected to the xenon lamp is connected to or separated from the electrode connected to the lamp driving circuit. Because of this structure, when the lamp-exchanging door 227 is removed and the lamp and the heat sink are exposed during the lamp exchanging job, it is possible to easily achieve perfect isolation of the lamp and the heat sink. All touchable portions during the lamp exchanging job are perfectly isolated with the insulation distance defined in the safety standard such as UL or IEC. Therefore, there is no need to use reinforced insulation structure in the insulation transformer in the switching regulator, and the basic insulation is good enough for the present purpose. Thus, the reduction of the transformer size can be achieved.

Furthermore, because the lamp unit is electrically isolated and there is only negligibly small leakage current, there is no need to provide the interlock switches for cutting off the primary circuit during the lamp exchanging job which is required in the conventional devices. The interlock switch for discharging which is needed in the conventional devices to avoid an electrical shock due to the charge stored in the capacitor in the secondary circuit is also unnecessary in the present embodiment because the starter is separated from the other circuit during the lamp exchanging job. This results in further reduction of the device size.

A twelfth embodiment of the present invention will be described next. The twelfth embodiment can be obtained from the eleventh embodiment only by modifying the structure of the electrode-pressing element.

Figure 63:
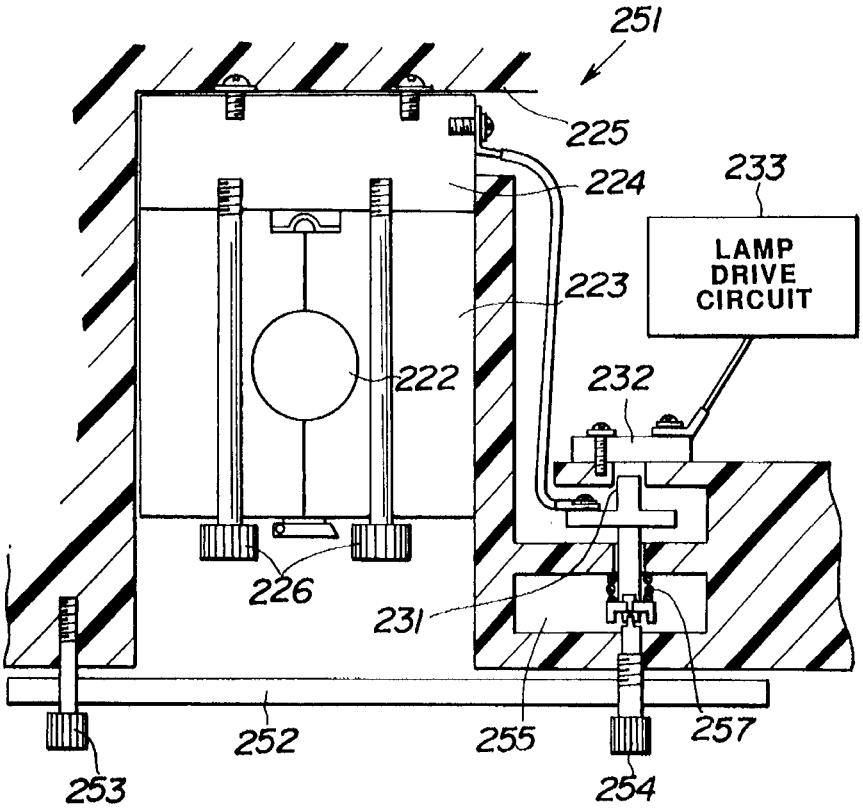

As shown in FIG. 63, in a light source device 251 in accordance with the twelfth embodiment, there is provided a heat sink 223 holding a xenon lamp 222, which is installed in a lamp house 225 after it is fixed to a heat-sink-supporting-elements 224. A lamp-exchanging door 252 is designed such that as required the lamp-exchanging door 252 can be freely removed from or attached to a case of the light source device 251. One of screws 254 for fixing the lamp-exchanging door 252 is fit in an electrode-pressing element 255, thus the screw 254 is designed to also act as a knob for turning on or turning off an electrode element so as to turn on or turn off electrical power to the xenon lamp 222.

The electrode-pressing element 255 has a pressing element 256 made of an insulating material with a rod-shape. This pressing element 256 is connected to a pressing electrode 231 electrically connected to a heat-sink-supporting-elements 224. Between a flange portion of a base portion of the pressing element 256 and a wall of the lamp house 225 opposing the flange portion, there is arranged an elastic element 257 composed of a spring or the like so that the pressing element 256 is pressed downward in FIG. 63, that is, toward the lamp-exchanging door 252. When electrode-pressing element 255 is in a state where it is not pushed in with a fixing screw 254, the elastic element 257 forces the pressing electrode 231 to get away from the electrode plate 232 by a distance larger than the reinforced insulation distance (2.5 mm).

Figure 64:
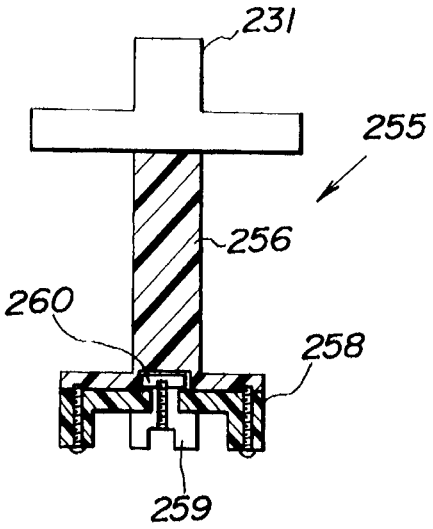

As shown in FIG. 64, in the electrode-pressing element 255, the end portion of the pressing element 256 is connected to the pressing electrode 231, and there is provided a rotation element 260 being fit in a round-shaped recess formed on a base portion of the pressing element 256. The rotation element 260 is held with a pressing element 258 fixed with screws to pressing element 256 so that the rotation element 260 does not fall off from the recess of the pressing element 256 and so that the rotation element 260 can freely rotate. The rotation element 260 is connected with screws to a clutch element 259, the front end portion of the clutch element 259 having a shaft with a diameter less than a diameter of the hole of the pressing element 258, the back end portion of the clutch element 259 having a square recess which the end portion of the fixing screw 254 is to be fit in. As a result of such structure, the clutch element 259 of the electrode-pressing portion 255 and the rotation element 260 can rotate with respect the pressing element 256.

The other portions are the same as those in the eleventh embodiment, so the explanation will not be repeated here for the same port ions.

When it is needed to exchange the lamp, the fixing screws 253 and 254 are loosened to remove the lamp-exchanging door 252. When the fixing screw 254, which also acts as a knob for turning on and turning off electrical power, is loosened, the fixing screw 254 gets back away, thus the elastic element 257 presses back the pressing element 256 toward the lamp-exchanging door 252, and the pressing electrode 231 is forced to move away from the electrode plate 232. In this situation, rotation of the fixing screw 254 is absorbed because the clutch element 259 of the electrode-pressing portion 255 and the rotation element 260 rotate and slide with respect to the pressing element 256.

When the lamp-exchanging door 252 is completely removed off from the lamp house 255, the flange at the base of the pressing electrode 231 moves until it gets into contact with the face of the holding portion of the pressing electrode, thus the pressing electrode 231 is separated away from the electrode plate 232 by a distance larger than the reinforced insulation distance. Thus, the lamp driving circuit 233 is separated away from the heat sink 223 by a distance larger than the reinforced insulating distance and electrical power to the heat sink 223 is cut off.

When exchanging of the lamp is completed, the amp-exchanging door 252 is attached and fixed with the fixing screws 253 and 254 in opposite order to the steps described above. When the fixing screw 254 is fastened, the clutch element 259 being fit into the fixing screw 254 and the rotation element 260 rotate and push the pressing element 256 of the electrode-pressing element 255 opposing elastic force of the elastic element 257, thus the pressing electrode 231 connected to the pressing element 256 approaches the electrode plate 232. When the lamp-exchanging door 252 is completely fastened with the fixing screw 254, the pressing electrode 231 gets into complete contact with the electrode plate 232, thus the lamp driving circuit 233 is electrically connected to the heat sink 223. In this state, electric power is supplied from the lamp driving circuit 233 to the xenon lamp 222 via the electrode plate 232, the pressing electrode 231, the lead wire 230, heat-sink-supporting-elements 224, and the heat sink 223.

As described above, in the present embodiment, there is provided fixing screw for fixing the lamp-exchanging door, the screw being capable of getting into contact with the electrode-pressing element, the screw also acting as a knob for turning on and off electric power. In such structure, when the lamp-exchanging door is for the lamp exchanging job, the lamp driving circuit is separated away from the heat sink by a distance than the insulation distance defined in the safety standard, thus there is no possibility of an electric shock if an operator touches the heat sink or other portions. Therefore safe lamp exchanging job is possible. Moreover, because the front hole of the lamp house is less than 3 mm in diameter, it is impossible to touch the inner electrical active regions, thus safety is ensured. Therefore, as in the first embodiment, there is no need to use reinforced insulation structure in the insulation transformer in the switching regulator of the lamp driving circuit, and the basic insulation is good enough for the present purpose. Thus, the reduction of the transformer size and device size can be achieved.

Figure 65:
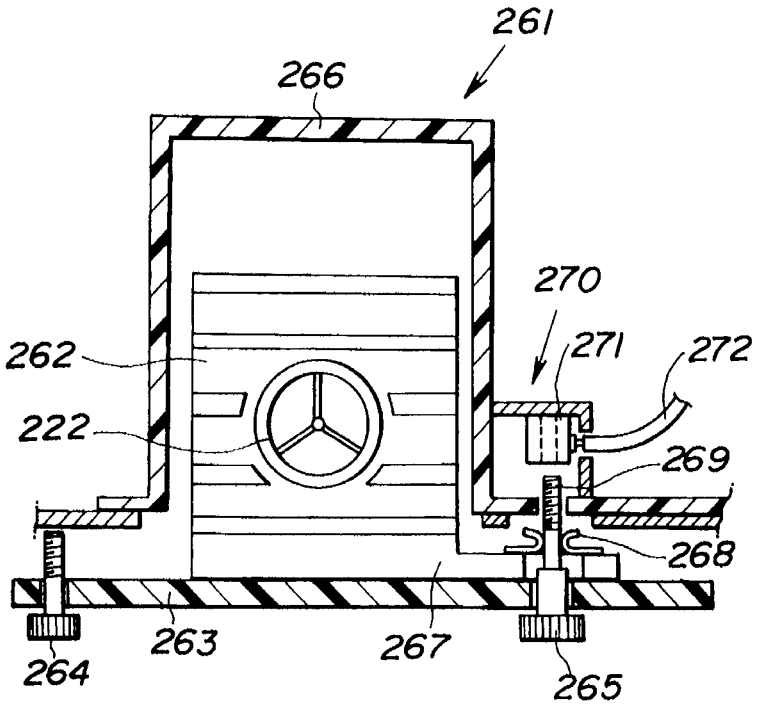
FIG. 65 is a cross sectional view showing the structure of a lamp house of a light source device in accordance with a thirteenth embodiment of the present invention.

In a thirteenth embodiment of the present invention, as shown in FIG. 65, a heat sink of a lamp house has electrode elements formed in the integral shape so that these electrodes can separate from each other and can contact each other in connection with the removal and attachment of a lamp-exchanging door.

A light source device 261 of the present embodiment has a heat sink 262 holding a xenon lamp 222, wherein the heat sink 262 is formed in an integral shape, and it is fixed to a lamp-exchanging door 263 made of a refractory and insulating material. The lamp-exchanging door 263 is designed such that the lamp-exchanging door 263 can be attached with fixing screws 264 and 265 to a case of the light source device 261 and also can be removed from it. The heat sink 262 can be installed into a lamp house 266 by attaching the lamp-exchanging door 263 with the heat sink 262 fixed to it.

The heat sink 262 has an extending electrode element 267 on its one side near the lamp-exchanging door 263. This electrode element 267 may be formed in integral with the heat sink 262, and also may be formed separately from the heat sink 262 if proper electrical connection is made between the electrode element 267 and the heat sink 262. On the electrode element 267, there is arranged an elastic contact brush 268 electrically connected to the electrode element 267. A fixing screw 265 is inserted in the electrode element 267 in such a way that the threaded portion on the end side of the fixing screw 265 can contact the contact brush 268. The threaded portion on the end side of the fixing screw 265 is made of an electrical conductive material, and it can slide with respect to the contact brush 268. The threaded end portion 269 of the fixing screw 265 is electrically connected to the heat sink 262 via the electrode element 267 and the contact brush 268. The fixing screw 265 has a knob which is made of an insulating material to avoid an electric shock.

On the side portion of the lamp house 266, there is provided a separating electrode 270. The threaded end portion 269 of the fixing screw 265 can be inserted into the separating electrode 270 through a front hole of the lamp house 266. Inside the separating electrode 270, there is arranged an electrode plate 271 which the threaded end portion 269 can be fit in. The electrode plate 271 is connected to a lamp driving circuit (not shown) via a lead wire 272. The front hole of the lamp house 266 has approximately the same size as the diameter of the threaded end portion 269. The size of the front hole of the lamp house 266 is designed to be small enough such as less than 3 mm in diameter or in width so that the inner electrical active regions such as the electrode plate 271 cannot be touched with test pin or test finger, which is a requirement of the safety standard.

When the lamp-exchanging door 263 is attached, the integrally fixed heat sink 262 is installed in the lamp house 266 and it is secured with the fixing screws 264 and 265. At this stage, the fixing screw 265 is inserted into the separating electrode 270 and the threaded end portion 269 contacts the contact brush 268. When the fixing screw 265 is fastened, the threaded end portion 269 is fit in the electrode plate 271, thus the electrode plate 271 is electrically connected to the electrode element 267 of the heat sink 262 via the threaded end portion 269 and the contact brush 268. As a result, the lamp driving circuit is electrically connected to the heat sink 262 and the electric power is supplied to the xenon lamp 222.

When the lamp exchanging job is done, the fixing screws 264 and 265 are released to remove the lamp-exchanging door 263 and the heat sink 262. When the fixing screw 265 is removed out, the threaded end portion 269 gets away from the electrode plate 271, thus the electrode plate 271 is separated from the electrode element 267 of the heat sink 262. As a result, the lamp driving circuit 271 is isolated from the heat sink 262, thus electric power to the heat sink 262 is cut off.

In this state, the electrode plate 271, which is still connected to the lamp driving circuit and electrically active, is protected with insulation in the separating electrode 270 on the side portion of the lamp house 266. Moreover, the hole size is so small that person's fingers cannot enter it, thus it is possible to make safe lamp exchanging job with no possibility of touching the electrically active regions during the lamp exchanging job. The heat sink 262 is isolated from the lamp driving circuit, therefore there is no possibility of an electric shock.

Figure 66:
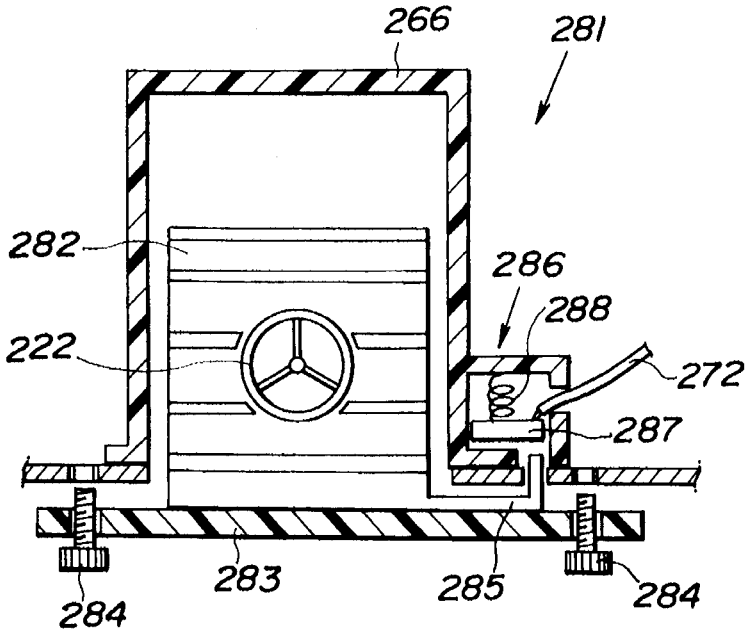

As shown in FIG. 66, a fourteenth embodiment of the present invention can be obtained from the thirteenth embodiment by modifying the structure of the electrode element of the heat sink and the separating electrode arranged on the side of the lamp house.

As shown in FIG. 66, a light source device 281 of the present embodiment has a heat sink 282 holding a xenon lamp 222, the heat sink 282 being fixed to a lamp-exchanging door 283. The lamp-exchanging door 283 is designed such that the lamp-exchanging door 283 can be attached with fixing screw 284 to a case of the light source device 281 and also can be removed from it. The heat sink 282 can be installed into a lamp house 266 by attaching the lamp-exchanging door 283 with the heat sink 282 fixed to it.

The heat sink 282 has an extending electrode element 285 on its one side near the lamp-exchanging door 283. The end portion of this electrode element 285 is bent at a right angle so that this bent end portion stands perpendicular to the lamp-exchanging door 283.

On the side portion of the lamp house 266, there is provided a separating electrode 286. The end portion of the electrode element 285 can be inserted into the separating electrode 286 through a front hole of the lamp house 266. Inside the separating electrode 286, there is arranged an electrode plate 287 held with an elastic element 288 such as a spring in such a manner that the electrode plate 287 can slide. The electrode plate 277 is connected to a lamp driving circuit (not shown) via a lead wire 272. The front hole of the lamp house 266 has approximately the same size as the diameter of the threaded end portion 269. The size of the front hole of the lamp house 266 is designed to be small enough such as less than 3 mm in diameter or in width so that the inner electrical active regions such as the electrode plate 287 cannot be touched with test pin or test finger, which is a requirement of the safety standard.

When the lamp-exchanging door 283 is attached, the integrally fixed heat sink 282 is installed in the lamp house 266 and it is secured with the fixing screw 264. At this stage, the end portion of the electrode element 285 of the heat sink 282 is inserted into the separating electrode 286 and the electrode element 285 is electrically connected to the electrode plate 287. When the fixing screw 284 is fastened, elastic force of the elastic element 288 makes the electrode element 285 firmly contact the electrode plate 287. As a result, the lamp driving circuit is electrically connected to the heat sink 282, thus electric power is supplied to the xenon lamp 282.

When the lamp exchanging job is done, the fixing screw 284 is released to remove the lamp-exchanging door 283 and the heat sink 282. Then the electrode element 285 of the heat sink 282 is separated from the electrode plate 287, thus the electrode plate 287 is separated from the heat sink 282. As a result, the lamp driving circuit is isolated from the heat sink 282, thus electric power to the heat sink 282 is cut off.

In this state, the electrode plate 287, which is still connected to the lamp driving circuit thus electrically active, is protected with insulation in the separating electrode 286 on the side portion of the lamp house 266. Moreover, the hole size is so small that person's fingers cannot enter it, thus it is possible to safely make lamp exchanging job with no possibility of touching the electrically active regions during the lamp exchanging job.

Figure 67:
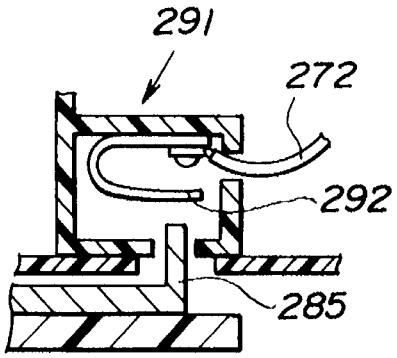
Figure 68:
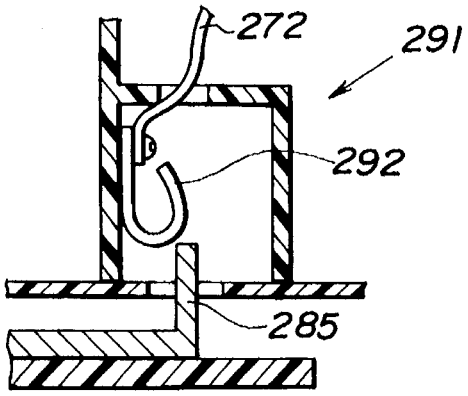
Figure 69:
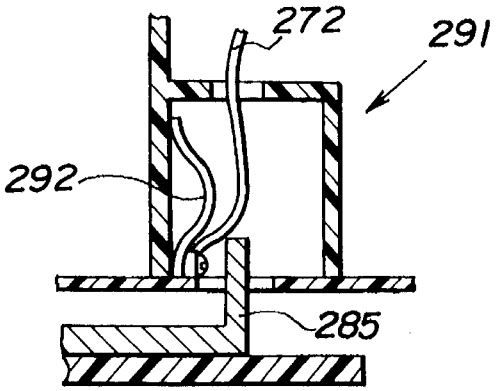
Figure 70:
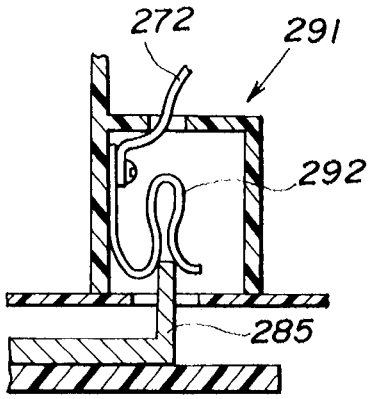

FIG. 67 shows a first example of modified separating electrode. This modified separating electrode 291 has an elastic electrode plate 292 having a leaf-spring-like shape. This electrode plate 292 is connected to a lamp driving circuit (not shown) via a lead wire 272. The end portion of the electrode element 285 of the heat sink 282 is pressed to the electrode plate 292 to make electrical connection. The electrode plate 292 which also acts as an elastic element can give the similar functions and effectiveness to those in the case of the fourteenth embodiment. Moreover, the electrode plate 292 can be further modified as shown in FIGS. 68–70 to get the similar functions and effectiveness.

Figure 71:
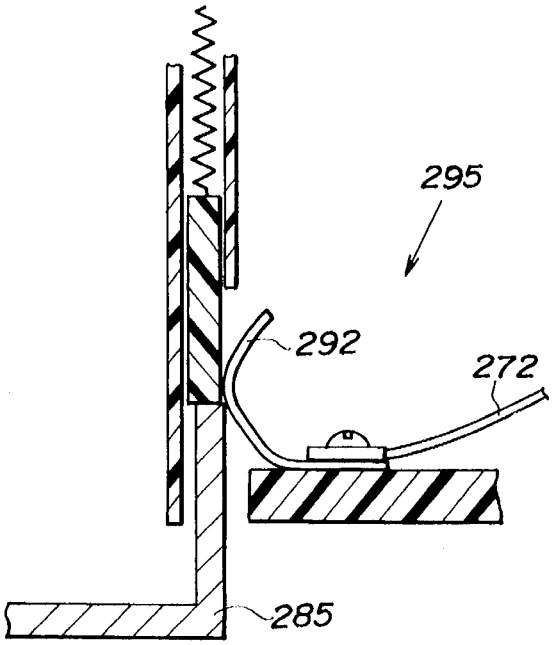

FIG. 71 shows a second example of modified separating electrode. This modified separating electrode 295 has an elastic electrode plate 292 having a leaf-spring-like shape. This electrode plate 292 is connected to a lamp driving circuit (not shown) via a lead wire 272. When the electrode element 285 of the heat sink 282 is not inserted in the separating electrode 295, the electrode plate 292 is protected from being exposed by means of insulating material being pressed outward with a spring. When the electrode element 285 of the heat sink 282 is pushed into the separating electrode 295, the insulating material moves so that the electrode plate 292 having a leaf-spring-like shape is electrically connected to the electrode element 285. Such an electrode plate 292 which also acts as an elastic element can be used to obtain the similar functions and effectiveness to those in the case of the fourteenth embodiment. Moreover, further improvement of electrical safety can be achieved because the electrode element is protected from being exposed by means of the insulating material.

Figure 72:
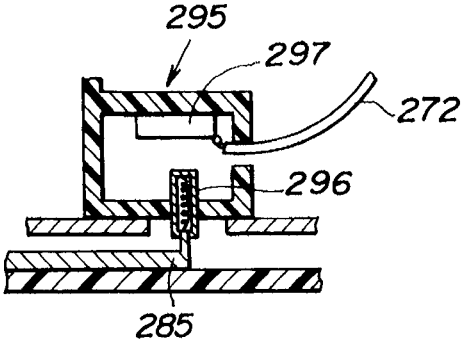
FIG. 72 is a cross-sectional view of a third modification of an isolating electrode having a sliding contact.

FIG. 72 shows a third example of modified separating electrode. This modified separating electrode 295 has an electrode plate 297 fixed to the inside of the separating electrode 295. The end portion of the electrode element 285 of the heat sink 282 has an electric contact element 296 containing an elastic material inside it, the electric contact element 296 being capable of sliding in its axis direction. The electric contact element 296 disposed on the end portion of the electrode element 285 is pressed to the electrode plate 297 to make electrical connection. Such structure in which the electric contact element 296 containing the elastic material disposed on the end portion of the electrode element 285 of the heat sink 282 can be also used to obtain the similar functions and effectiveness to those in the case of the fourteenth embodiment.

Figure 73:
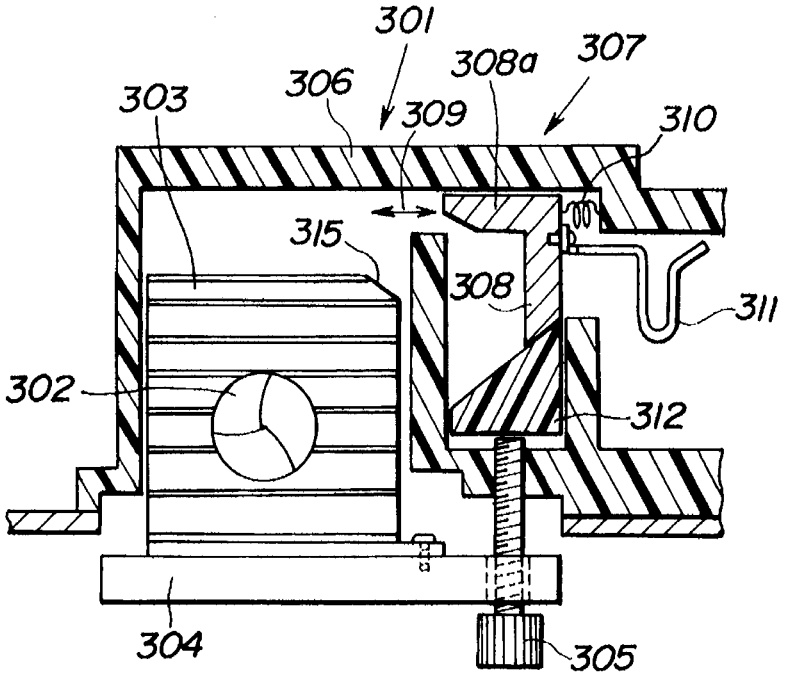

As shown in FIG. 73, in a light source device 301 in accordance with a fifteenth embodiment of the present invention, a xenon lamp 302 is held with a heat sink 303 for cooling, and electrical power is supplied to the xenon lamp via this heat sink 303. The heat sink 303 is fixed to a lamp-exchanging door 304 composed of a refractory and insulating material.

Figure 74:
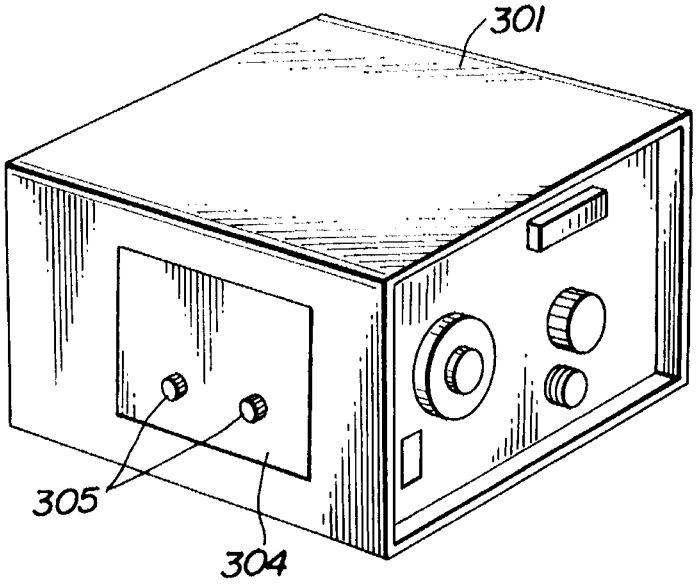

The lamp-exchanging door 304 can be removed when the xenon lamp 302 is exchanged. As shown in FIG. 74, the lamp-exchanging door 304 may be disposed for example on the side of the light source device 301. The lamp-exchanging door 304 can be fixed with a fixing screw 305 to a case of the light source device 301 in such a manner that the lamp-exchanging door 304 can be easily removed as required. The heat sink 303 can be installed into a lamp house 306 by attaching the lamp-exchanging door 304 with the heat sink 303 fixed to it.

There is provided a sliding electrode 307 on the side of the lamp house 306. A L-shaped electrode 308 is arranged in the sliding electrode element 307 in such a manner that the electrode 308 can slide in the right and left direction in FIG. 74. When the L-shaped electrode 308 is slid to the left direction, contact portion **308*a* on the end side of the L-shaped electrode 308 is inserted into the lamp house 306 through the side hole 309 and the inserted portion gets into contact with the heat sink 303 to make electrical connection with it. An elastic element 310 such as a spring is connected to the base portion of the L-shaped electrode 308 so that the elastic element 310 pulls the L-shaped electrode 308 in the right direction to hold it. A lead wire 311 is connected to the L-shaped electrode 308** so as to supply electric power from a lamp driving circuit (not shown).

Inside the sliding electrode element 307, there is provided sliding electrode 312 having a sliding plane on its end portion in such a manner that the a sliding electrode 312 can slide up and down in FIG. 73. The inclined plane of this a sliding electrode 312 is in contact with an end face of the L-shaped electrode 308, the end face being formed to be inclined. When the lamp-exchanging door 304 is attached, the sliding electrode 312 is pushed in with the head of the fixing screw 305 for fixing the lamp-exchanging door 304. As a result of this, the inclined end face of the electrode 308 moves on the inclined plane of the sliding electrode 312 so that the electrode 308 can slide toward the heat sink 303.

Figure 75:
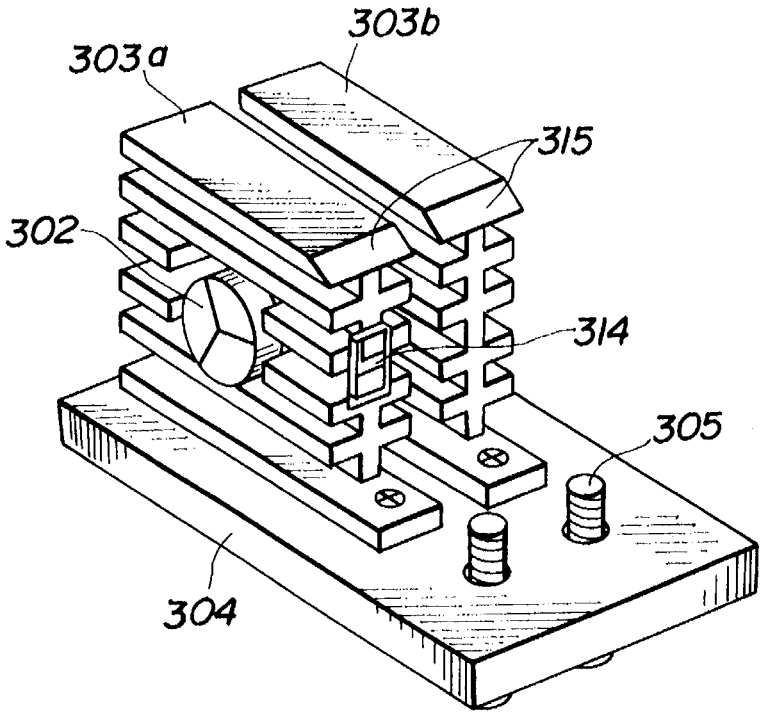

As shown in FIG. 75, two fixing screws 305 are provided corresponding to the cathode and anode electrodes of the xenon lamp 302. In order to correspond to these two fixing screws 305, two sliding electrode element 307 are provided, while only one is shown in FIG. 75. The heat sink 303 is divided into two portions, **303*a* and 303*b* to hold the xenon lamp 303, furthermore these two divided portions are electrically connected to each electrode of the xenon lamp 302. One edge of the heat sink 303 is chamfered to form a contact portion 315. This contact portion 315 is in contact with the contact portion 308*a* of the L-shaped electrode 308**.

The functions of the present embodiment will be described next.

When light intensity of the xenon lamp 302 becomes too small or it dies at the end of the life or due to other reasons, the xenon lamp 302 must be exchanged. In the first step of procedure for exchanging the xenon lamp 302, an operator or a person on the exchanging job loosens the fixing screws 305, then removes off the lamp-exchanging door 304, and further removes out the heat sink 303 together with the lamp-exchanging door 304 from the lamp house 306.

Referring to FIG. 73, the situation where the lamp-exchanging door 304 is removed will be described. Once the fixing screw 305 is pulled out from the inside of the sliding electrode element 307, the sliding electrode 312 can no longer press the electrode 308, thus the electrode 308 slides in the right direction by being pulled by elastic force of the elastic element 310. Thus, the contact portion **308*a* leaves away from the heat sink 303 and it comes back inside the sliding electrode element 307. As a result, the sliding electrode element 307 is electrically isolated from the heat sink 303, thus electric power to the heat sink 303** is cut off.

In this situation, the distance between the heat sink 303 and the contact portion **308*a* being back into the sliding electrode element 307 is designed to be larger than the insulation distance prescribed in the safety standard. The lamp house 306 is composed of a refractory and insulating material to ensure the safety. The size of the side hole of the lamp house 306 is designed to be small enough such as less than 3 mm in width so that the inner electrical active regions such as the inner electrode 308 cannot be touched with test pin or test finger, which is prescribed in the safety standard such as IEC. Therefore, unless very thin and long metal rod is inserted, it is impossible to touch the electrode 308** or other portions. Thus, there is no possibility of electric shock.

Then, the operator exchanges the xenon lamp 302 mounted on the heat sink 303 pulled out. In this situation, the heat sink 303 that the operator touches is electrically isolated from the electric power supply and there is no possibility of an electric shock. FIG. 75 shows the situation of the lamp-exchanging door 304 and the heat sink 303 removed out. To remove the xenon lamp 302 from the heat sink 303, the clamping lock 314 is released and the upper heat sink portion 303*a* is opened. Then, the screw on the back side of the lamp is released.

Figure 76:
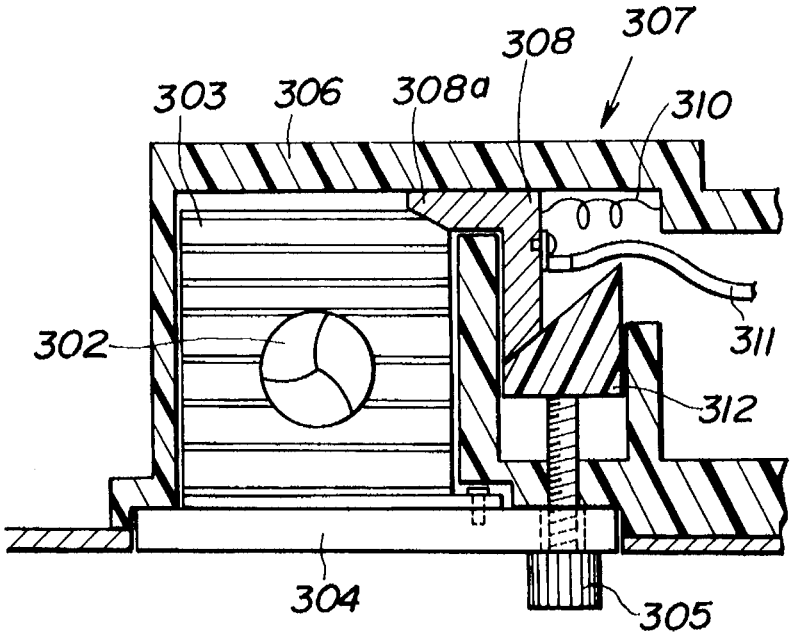

After the lamp is exchanged, the heat sink 303 is inserted into the lamp house 306 and the lamp-exchanging door 304 is attached to the case of the light source device. When the fixing screw 305 is fastened to secure the lamp-exchanging door 304, the sliding electrode 312 in the sliding electrode element 307 is pushed upward in FIG. 73, thus the electrode 308 slides in the left direction in FIG. 73, and the contact portion 308*a* of the electrode 308 gets into contact with the contact portion 315 of the heat sink 303 to make electrical connection. FIG. 76 shows the situation where the lamp-exchanging door 304 is attached. That is, when the fixing screw 305 is fastened, the head of the fixing screw 305 pushes the sliding electrode 312. Then, the inclined end face of the electrode 308 moves on the inclined plane of the sliding electrode 312. According to this movement, the electrode 308 slides toward the heat sink 303 and gets into the lamp house 306, thus the contact portion 308*a* contacts the heat sink 303. As a result, the heat sink 303 is electrically connected to the lamp driving circuit, and electric power is supplied to the xenon lamp 302 via the lead wire 311, the electrode 308, and the heat sink 303.

When the fixing screw 305 is fastened enough, the electrode 308 is pressed by both of the heat sink 303 and the sliding electrode 312, thus large enough contact pressure between the heat sink 303 and the contact portion 308*a* can be obtained. Furthermore, the contact portion 308*a* is pressed from two directions and confined between the contact portion 315 of the heat sink 303 and the inner face of the lamp house 306, thus firm connection can be achieved. Guide rails may be arranged on the inclined plane of the sliding electrode 312 to fit the inclined end portion of the electrode 308 to the sliding electrode 312 so that reduction of the contact resistance between the electrode 308 and the sliding electrode 312 can be obtained thus smooth sliding can be achieved.

As described above, in the present embodiment, the sliding electrode element is provided which slides in connection with the movement of the lamp-exchanging door which occurs when the lamp-exchanging door is removed or attached. According to the above sliding movement, the electrode inside the sliding electrode element gets into contact with or separates from the heat sinks to separate the lamp driving circuit from the lamp electrodes. As a result of such a separating electrode structure, perfect separation and isolation can be easily achieved for the heat sink and the lamp.

Furthermore, every electrode to be connected to the heat sink is inside the sliding electrode element covered with an insulating material during the lamp exchanging job, thus it is impossible for an operator to touch the electrically active regions. Therefore, there is no possibility of an electric shock. Moreover, all portions that the operator can touch during the lamp exchanging job are isolated with the insulating distance defined by the safety standard such as IEC. Thus, there is no need to use reinforced insulation structure for the insulation transformer in the switching power supply circuit in the lamp driving circuit. Therefore the reduction of the transformer size can be achieved. Furthermore, because the lamp unit is electrically isolated and there is only negligibly small leakage current, there is no need to provide the interlock switches for cutting off the primary circuit during the lamp exchanging job which is required in the conventional devices. The interlock switch for discharging which is needed in the conventional devices to avoid an electrical shock due to the charge stored in the capacitor in the secondary circuit is also unnecessary in the present embodiment because the starter is separated from the other circuit during the lamp exchanging job. This results in further reduction of the device size.

In the present embodiment, it is possible to simultaneously perform three different functions: electrical connection to the lamp; fixing of the heat sink; shielding of the lamp-exchanging door. Thus, effective operation is achieved.

A sixteenth embodiment of the present invention can be obtained from the fifteenth embodiment by modifying the structure of the sliding electrode element.

Figure 77:
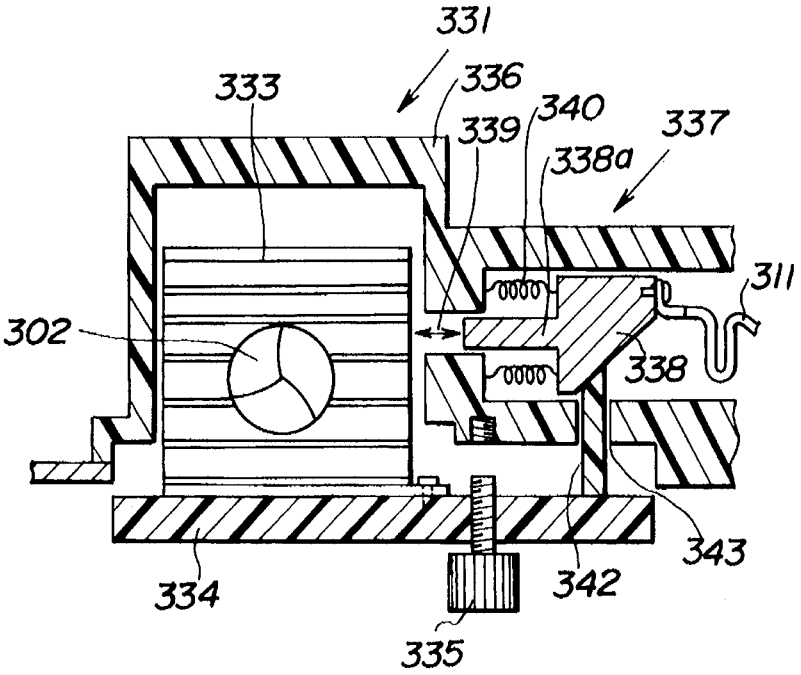

As shown in FIG. 77, in a light source device 331 in accordance with a sixteenth embodiment of the present invention, there is provided a heat sink 333 holding a xenon lamp 302. The heat sink 333 is fixed to a lamp-exchanging door 334 composed of a refractory and insulating material. The lamp-exchanging door 334 can be fixed with a fixing screw 335 to a case of the light source device 331 in such a manner that the lamp-exchanging door 334 can be easily removed as required. The heat sink 333 can be installed into a lamp house 336 by attaching the lamp-exchanging door 334 with the heat sink 333 fixed to it.

On the side of the lamp house 336, there is provided a sliding electrode element 337. Inside the sliding electrode element 337, there is provided an electrode 338 which can slide in the right and left directions in FIG. 77. The electrode 338 has a contact portion 338*a* formed in a thin rod-shape or thin plate-shape. When the electrode 338 slides in the left direction, the contact portion 338*a* gets into the lamp house 336 through the side hole of the lamp house 336 to contact the heat sink 333 so that electrical connection is achieved between the electrode 338 and the heat sink 333. There is provide an elastic element 340 such as a spring between the outer side face of the lamp house 336 and the electrode 338. The elastic element 340 presses the electrode 338 in the right direction to hold it. The electrode 338 is connected to a lead wire 311 so that electric power is supplied from the lamp driving circuit (not shown).

Figure 78:
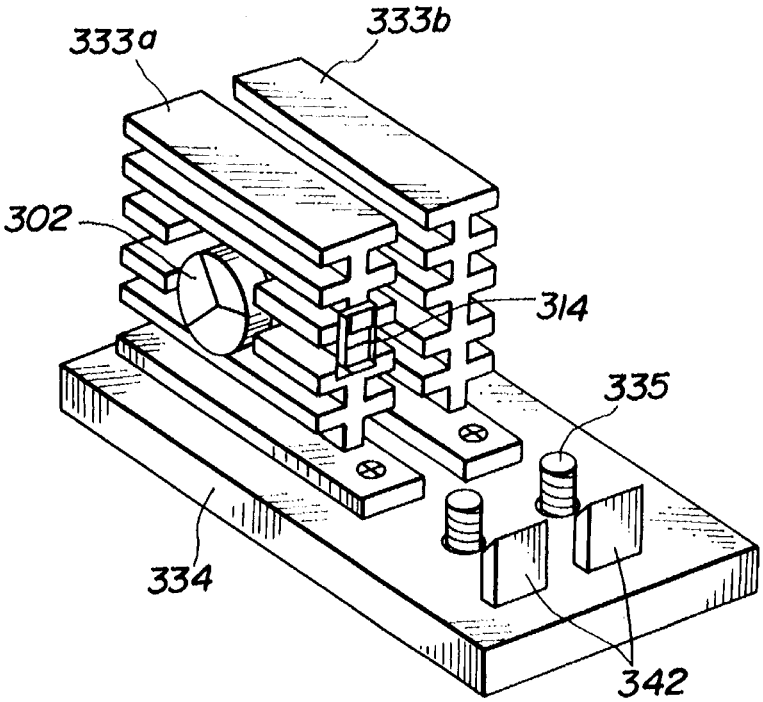

On the other hand, as shown in FIGS. 77 and 78, inside the lamp-exchanging door 334, there is provided a pushing element 342 having an inclined end face. When the lamp-exchanging door 334 is attached, this pushing element 342 is inserted in sliding electrode element 337 through a front hole 343 of the lamp house 336 to contact an inclined plane formed on the bottom portion of the electrode 338. By pushing the pushing element 342, the inclined plane of the electrode 338 is moved on the inclined end face so as to slide the electrode 338 toward the heat sink 333.

As in the fifteenth embodiment, also in the present embodiment, there are provided two sets of pushing elements 342 and the fixing screws 335 in order to correspond to the cathode and anode electrodes of the xenon lamp 302. There are also provided two sliding electrode element 337, while only one is shown in Figures. The heat sink 333 is divided into two portions 333*a* and 333*b* so as to hold the xenon lamp 302, these divided portions being electrically connected to the corresponding electrode of the xenon lamp.

The other portions are the same as those of the fifteenth embodiment, so the explanation will not be repeated here for the same portions.

To exchange the lamp, as in the fifteenth embodiment, first, an operator loosens the fixing screw 335 to remove off the lamp-exchanging door 334, then remove the heat sink 333 together with the lamp-exchanging door 334 out of the lamp house 336.

When the lamp-exchanging door 334 is removed off, the pushing element 342 of the lamp-exchanging door 334 gets away from the sliding electrode element 337, thus elastic force of the elastic element 340 make the electrode 338 slide in the right direction in FIG. 77. Then, the contact portion 338*a* leaves from the heat sink 333 and it gets back inside the sliding electrode element 337. As a result of this, the heat sink 333 is electrically separated from the sliding electrode element 337 and electric power to the heat sink 333 is cut off.

In this situation, the distance between the heat sink 333 and the contact portion 338*a* being back into the sliding electrode element 337 is designed to be larger than the insulation distance prescribed in the safety standard. The lamp house 336 is composed of a refractory and insulating material to ensure the safety. The sizes of the side hole 339 and front hole 343 of the lamp house 336 are designed to be small enough such as less than 3 mm in width so that the inner electrical active regions such as the inner electrode 338 cannot be touched with test pin or test finger, which is prescribed in the safety standard such as IEC. The heat sink 333 that the operator can touch is electrically isolated from the electric power supply and there is no possibility of an electric shock.

After the lamp is exchanged, the heat sink 333 is inserted into the lamp house 336 and the lamp-exchanging door 334 is attached to the case of the light source device. When the fixing screw 335 is fastened to secure the lamp-exchanging door 334, the electrode 338 of the sliding electrode element 337 slides in the eft direction in FIG. 73, and the contact portion 338*a* of the electrode 338 gets into contact with the heat sink 333 to make electrical connection.

Figure 79:
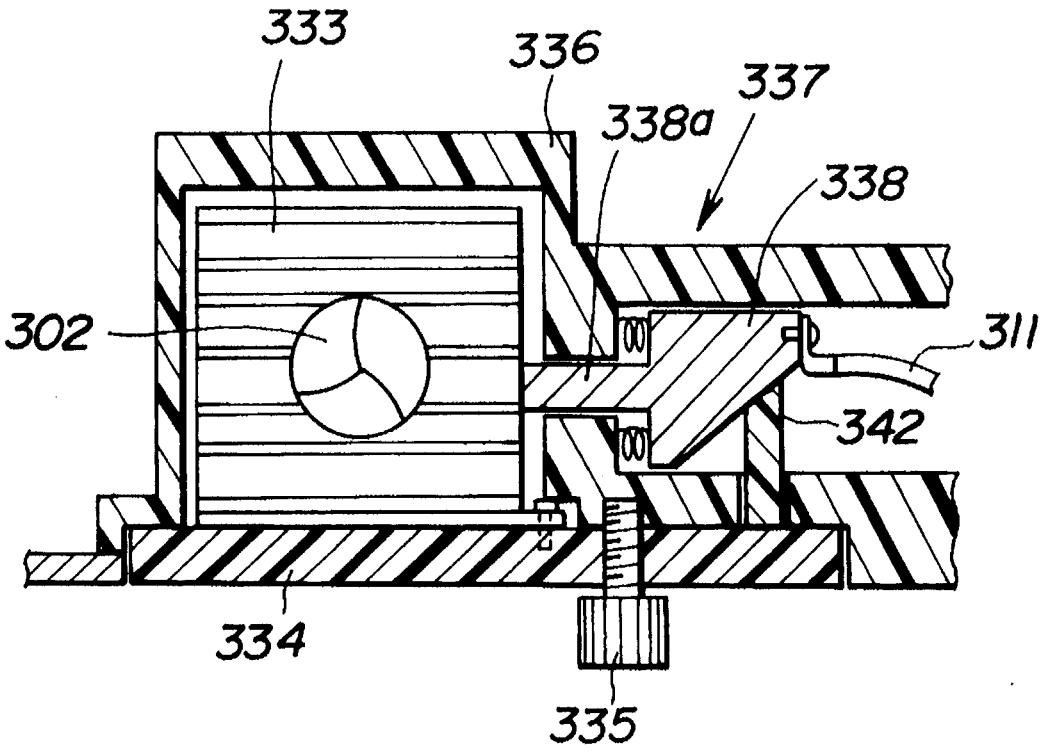

FIG. 79 shows the situation where the lamp-exchanging door 334 is attached. That is, when the fixing screw 335 is fastened to press the lamp-exchanging door 334 to the lamp house 336, the pushing element 342 is inserted into the sliding electrode element 337 to contact the inclined plane of the electrode 338. As a result of this, the electrode 338 is pushed, then the end face of the pushing element 342 moves along the inclined plane of the electrode 338. According to this movement, the electrode 338 slides toward the heat sink 333 to get into the lamp house 336. Thus, the contact portion 338*a* contacts the heat sink 333. As a result, the heat sink 333 is electrically connected to the lamp driving circuit and electric power is supplied to the xenon lamp 302 vie the lead wire 311, the electrode 338, and the heat sink 333.

As described above, as in the fifteenth embodiment, in the present embodiment, the sliding electrode element is provided which slides in connection with the movement of the lamp-exchanging door which occurs when the lamp-exchanging door is removed or attached. According to the above sliding movement, the electrode inside the sliding electrode element gets into contact with or separates from the heat sinks to separate the lamp driving circuit from the lamp electrodes. As a result of such a separating electrode structure, perfect separation and isolation can be easily achieved for the heat sink and the lamp. Thus, there is no need to use reinforced insulation structure for the insulation transformer in the switching power supply circuit in the lamp driving circuit. Therefore the reduction of the transformer size can be achieved. Furthermore, there is no need to provide the interlock switches, thus further reduction of the device size can be achieved. Furthermore, in the present embodiment, the electrode of the sliding electrode element is forced to slide directly by the pushing element formed integrally with the lamp-exchanging door 334. Therefore, there is no need to use the sliding electrode which is required in the fifteenth embodiment. Thus, the reduction of the number of elements can be achieved and simpler structure can be also achieved.

Figure 80:
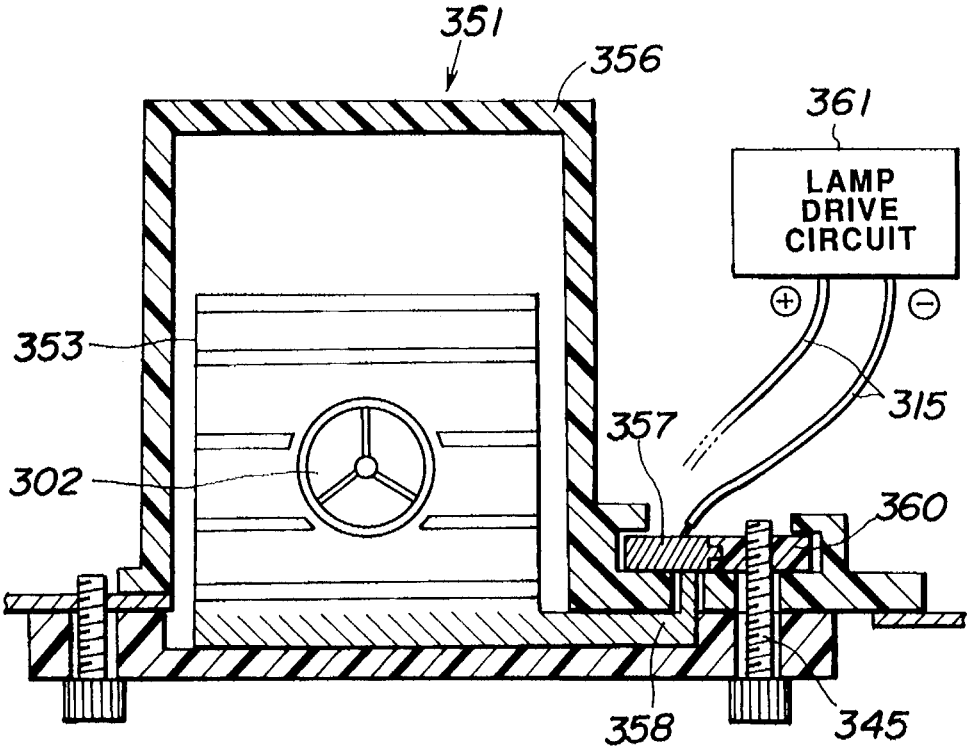

As shown in FIG. 80, in a seventeenth embodiment of the present invention, isolation between a lamp and a lamp driving circuit is achieved by fixing the lamp-exchanging door with fixing screws.

That is, there is provided a heat sink 353 holding a xenon lamp, which is fixed to a lamp-exchanging door 354 made of a refractory and insulating material. The lamp-exchanging door 354 is fixed to a case of a light source device 351 with a fixing screw 345 having a knob made of an insulating material in such a manner that the lamp-exchanging door 354 can be freely removed and attached as required. When the lamp-exchanging door 354 is attached, the heat sink 353 fixed to the lamp-exchanging door 354 is installed into the lamp house 336.

On the side of the lamp house 336, there is arranged an case-side electrode 357 connected to an insulating material 360. This insulating material 360 has a tapped hole to receive the fixing screw 345. An electrode formed on the heat sink 353 has a thin rod-shaped or plate-shaped contact portion 358*a*. When the lamp-exchanging door 354 is fixed, this contact portion 358*a* gets into contact with the case-side electrode 357. This case-side electrode 357 is connected to a lead wire 315 so that electric power is supplied from a lamp driving circuit 361.

When the fixing screw 345 is loosened, the lamp-exchanging door 354 is removed off and separation occurs in an electrode portion.

As described above, in the present embodiment, electrodes are provided which operate in connection with the movement of the lamp-exchanging door which occurs when the lamp-exchanging door is removed or attached. As a result of such a separating electrode structure, perfect separation and isolation can be easily achieved for the heat sink and the lamp during the lamp exchanging job. Thus, there is no need to use reinforced insulation structure for the insulation transformer in the switching power supply circuit in the lamp driving circuit. Therefore the reduction of the transformer size call be achieved. Furthermore, there is no need to provide the interlock switches, thus further reduction of the device size can be achieved.

Figure 81:
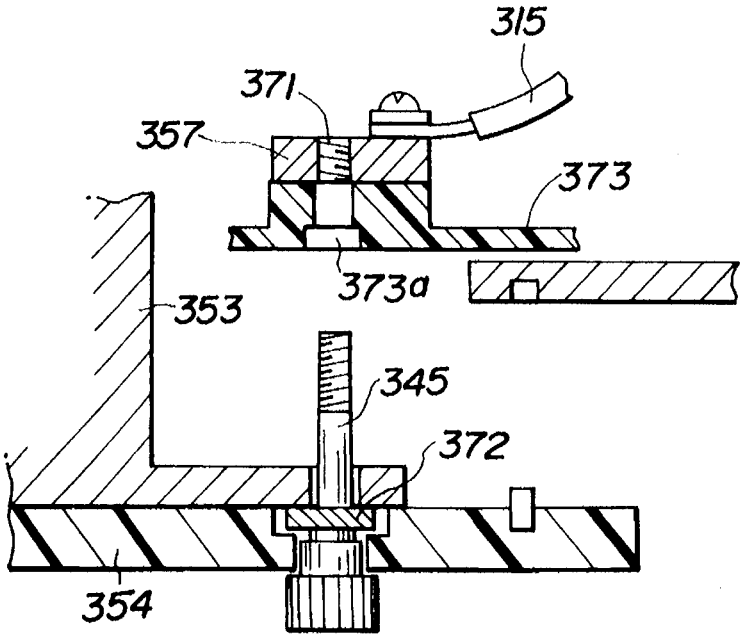

The present embodiment can be further modified. FIG. 81 shows a first example of such modifications. In this example, instead of forming a tapped hole on the insulating material connected to the electrode as in the seventeenth embodiment, a tapped hole is formed on the electrode 357 itself. Furthermore, the fixing screw 345 is provided a washer 372 which contact the heat sink 353. That is, as shown in FIG. 81, the electrode 357 is fixed to an insulating material 373 which is placed at a position far enough from the case. The insulating material 373 has a loose hole 373*a* via which the fixing screw is inserted. The other portions are the same as those of the seventeenth embodiment, so the explanation will no be repeated here for the same port ions.

In such a structure described above, the fixing screw 345 is fit in the tapped hole of the electrode 357 to make electrical connection between the electrode 357 connected to the lamp driving circuit and the washer 372 connected to the heat sink on the lamp side.

In this way, electrical connection/separation is achieved with simple structure in which there is just provided an electrode with a tapped hole at a position far enough from the case. Thus, great cost reduction can be achieved. Other functions and effectiveness are the same as those in the seventeenth embodiment.

Figure 82:
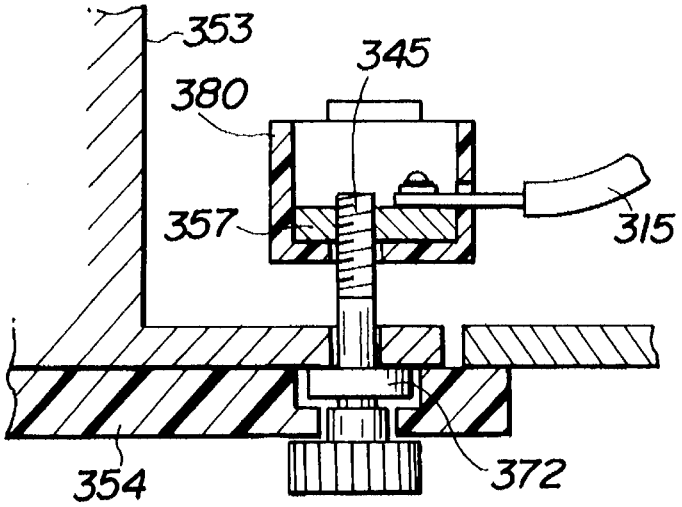

FIG. 82 shows an example where the electrode 357 with a tapped hole which is exposed in the case of FIG. 81 is disposed in an electrode unit 380 made of an insulating material. As a result of use of an insulating material for covering the electrode and for fixing it to the case, electrical safety can be improved.

Figure 83:
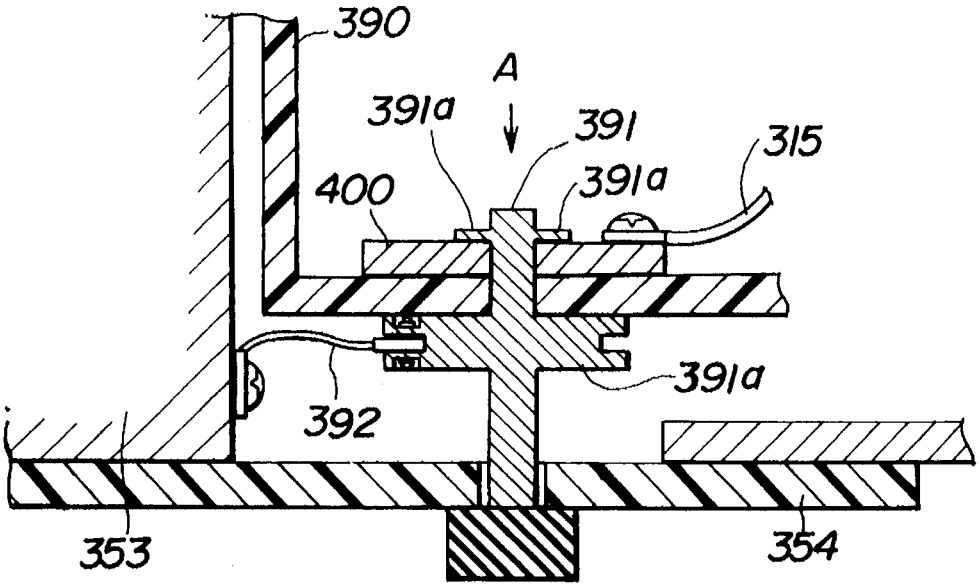
Figure 84:
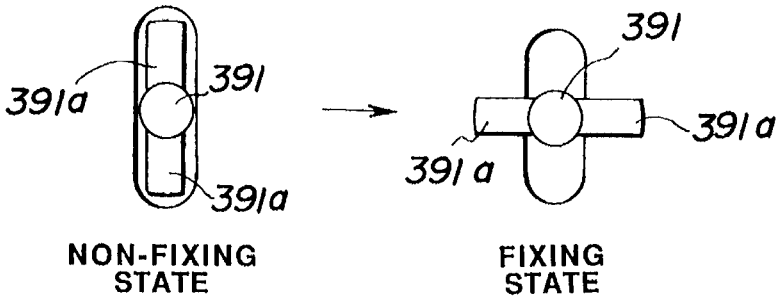

FIGS. 83 and 84 show example where a lamp-exchanging door can be removed off very easily just by rotating a knob.

As shown in FIGS. 83, 84, an electrode 400 and also a lamp house 390 made of an insulating material have a slit-like hole. There is also provided a rotatable fixing element 391 having a holding bar 391*a* for holding the above material after the fixing element 391 is inserted into the slit-like hole. This fixing element is arranged in such a manner that rotation of the fixing element 391 does not cause twist of a lead wire connected to a heat sink 353 disposed below the fixing element. Easy and simple operation is achieved by this mechanism.

FIGS. 85–88 show examples where safety is further improved.

That is, electrodes are covered with an insulating material to protect the electrodes from being exposed during the lamp exchanging job.

Figure 85:
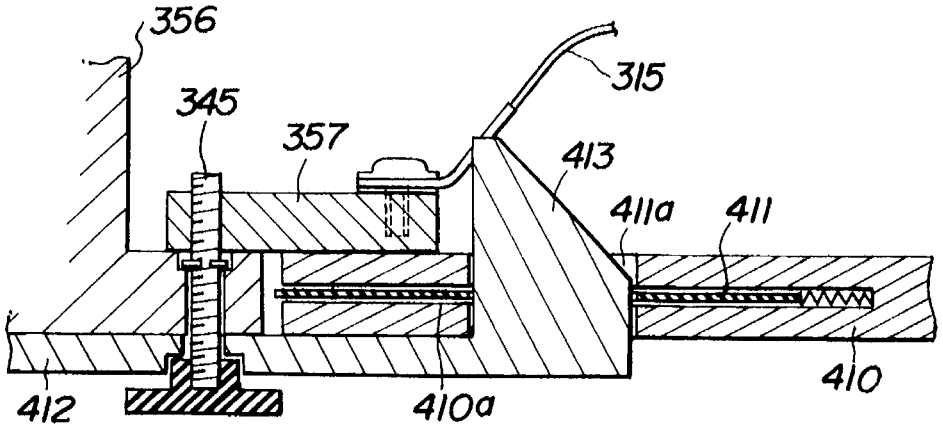
Figure 86:
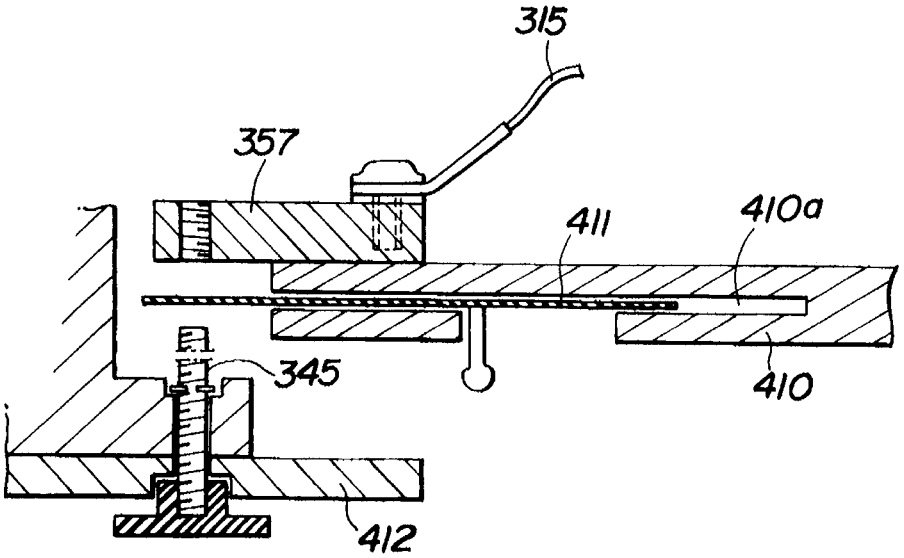

In the case of FIGS. 85 and 86, there is provided a sliding element 411 made of an insulating material on a case 410.

The sliding element 411 of FIG. 85 has a loose hole 411*a* for accepting a guide portion 413 formed on the lamp-exchanging door 412 in a inclined form. This sliding element 411 is arranged together with a pressing means in a slit 410*a* formed on the case. Other portions are the same as those of the seventeenth embodiment, so the explanation will no be repeated here.

In the structure described above, when the lamp-exchanging door 412 is attached to the case 410, the guide portion 413 moves in the loose hole 411*a* and the slide element 411 also moves, thus the tapped hole of the electrode 357 appears.

FIG. 86 shows an example where a sliding element 411 has a knob. When the lamp-exchanging door is attached, the knob is held by a hand for moving the sliding element.

When the lamp-exchanging door is removed off, the loose hole for accepting the fixing screw is automatically covered with the pressing means to isolate the connection with the outside.

Figure 87:
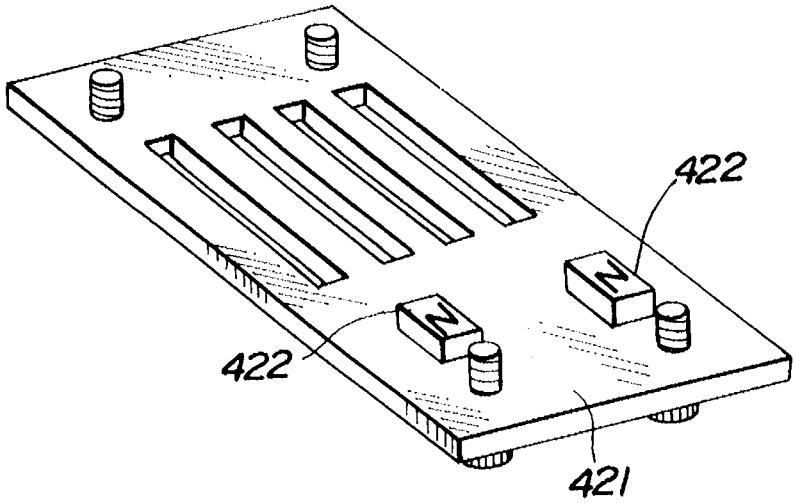
Figure 88:
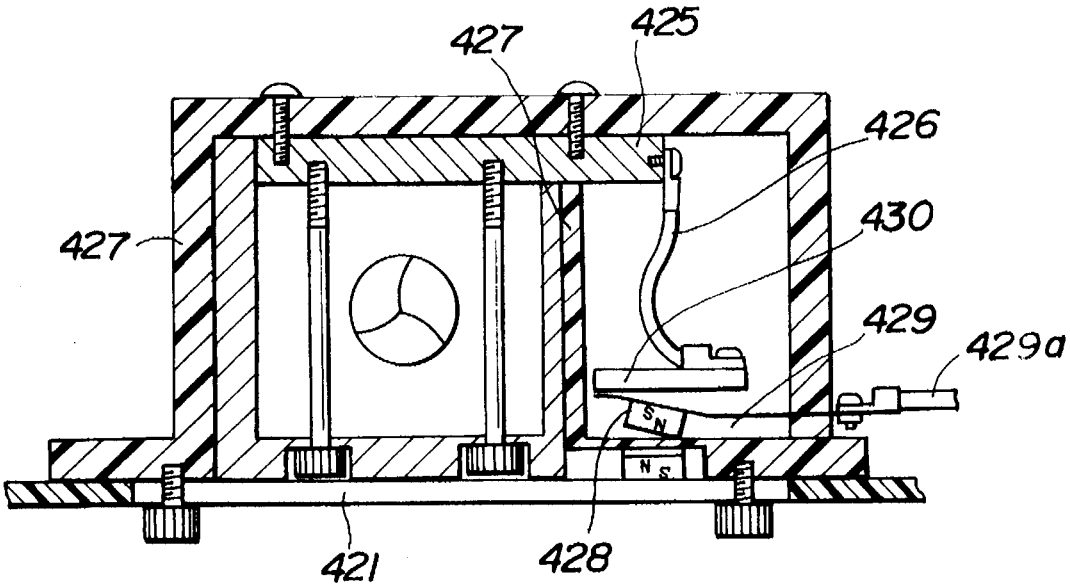

FIGS. 87 and 88 show another example for protecting an electrode from being exposed.

In this example, there is no hole for accepting fixing screw. Thus, electrical safety can be improved.

That is, as shown in FIG. 87, a magnet 422 is attached to a lamp-exchanging door 421 in such a manner that the N-pole of the magnet points to the case.

As shown in FIG. 88, when the lamp-exchanging door 421 is attached to the case 423, a lamp driving circuit 424 is connected to a heat-sink-fixing-electrode.

As shown in FIG. 88, the heat-sink-fixing-electrode 425 is connected to an electrode element 430 via a lead wire 426. The electrode element 430 is arranged in a lamp house at a proper position. Between the electrode element 430 and the lamp house 427 there is provided a leaf spring 429. This leaf spring 429 is provided with a magnet 428 on the its end portion in such a manner that the N-pole of the magnet 428 points to the lamp-exchanging door 421. The leaf spring 429 is connected to a lead wire 429*a* extending from a lamp driving circuit (not shown).

In the above structure, when the lamp-exchanging door 421 is attached to the case 423, magnetic field from the N-pole of the magnet 422 mounted on the case 423 repels the magnetic field from the N-pole of the magnet 428 mounted on the leaf spring 429, thus the leaf spring 429 is moved toward the electrode element to make electrical connection between the lamp driving circuit and the electrode of the lamp.

It is apparent that various modifications may be made without departing from the spirit and scope of the present invention. The present invention is not limited to any specific embodiment, unless defined by attached claims.

What is claimed is:

1. A light source device including a detachable lamp assembly, comprising:

a lamp-exchanging door detachably connected to said device which is attached/removed when a lamp is replaced, wherein said lamp-exchanging door is removable from said device separately from said lamp assembly; and an electrode-connection/-separation means for making connection/separation between an electrode of a lamp driving circuit and an electrode of a lamp when said lamp-exchanging door is attached/removed.

2. A light source device as defined in claim 1, wherein said electrode-connection/-separation means comprises:

an electronically conductive portion formed on an end portion of a projecting portion formed on said lamp-exchanging door; and an electronic contact portion arranged on a lamp house;

said electronically conductive portion being fixed to said electronic contact portion by fitting means.

3. A light source device as defined in claim 1, wherein said electrode-connection/-separation means comprises:

a heat sink acting as an electronically conductive portion; and an electrode portion arranged in a lamp house, said electrode portion acting as an electronic contact portion, said electrode portion being connected to a lamp circuit;

said heat sink being connected to and separated from said electrode portion by fitting a fixing screw arranged on said lamp-exchanging door.

4. A light source device as defined in claim 3, wherein:

an electrode connected to said heat sink acting as said electronically conductive portion is arranged in such a manner that said electrode can freely move; and said freely movable electrode moves in accordance with the movement of said screw.

5. A light source device as defined in claim 3, wherein:

said electronically conductive portion is formed on a heat sink; and said heat sink is connected to said electrode portion acting as an electronic contact portion by fastening said lamp-exchanging door.

* * * * *